US008727689B2

(12) United States Patent
Yoshie et al.

(10) Patent No.: US 8,727,689 B2
(45) Date of Patent: May 20, 2014

(54) PAPER SHEET HANDLING DEVICE

(75) Inventors: Toru Yoshie, Gunma (JP); Kazuhiko Kishi, Gunma (JP)

(73) Assignee: Max Co., Ltd., Tokyo (JP)

( * ) Notice: Subject to any disclaimer, the term of this patent is extended or adjusted under 35 U.S.C. 154(b) by 688 days.

(21) Appl. No.: 12/528,788

(22) PCT Filed: Feb. 19, 2008

(86) PCT No.: PCT/JP2008/052775

§ 371 (c)(1),
(2), (4) Date: Aug. 26, 2009

(87) PCT Pub. No.: WO2008/120504

PCT Pub. Date: Oct. 9, 2008

(65) Prior Publication Data

US 2010/0043909 A1 Feb. 25, 2010

(30) Foreign Application Priority Data

Feb. 28, 2007 (JP) ..... 2007-050272
Feb. 28, 2007 (JP) ..... 2007-050273
Feb. 28, 2007 (JP) ..... 2007-050274
Feb. 28, 2007 (JP) ..... 2007-050277

(51) Int. Cl.

| | |
|---|---|
| ***B42B 5/08*** | (2006.01) |
| ***B42C 9/00*** | (2006.01) |
| ***B42C 13/00*** | (2006.01) |
| ***B42B 5/00*** | (2006.01) |
| ***B42B 5/06*** | (2006.01) |
| ***B42B 5/10*** | (2006.01) |
| ***B42B 9/00*** | (2006.01) |

(52) U.S. Cl.

USPC ..... 412/38; 412/1; 412/6; 412/7; 412/9; 412/14; 412/16; 412/33; 412/34; 412/39; 412/40

(58) Field of Classification Search

USPC ..... 412/1, 6, 7, 9, 14, 16, 33, 34, 38, 39, 40
See application file for complete search history.

(56) References Cited

U.S. PATENT DOCUMENTS 4,327,780 A 5/1982 Lehman
4,351,371 A 9/1982 Mann et al.

(Continued)

FOREIGN PATENT DOCUMENTS

CA 1134568 A 11/1982
CH 648517 A5 3/1980

(Continued)

OTHER PUBLICATIONS

Chinese Office Action for corresponding Chinese Application No. 200880006519.3. Office Action issued Jul. 21, 2010.

(Continued)

*Primary Examiner* — Edward Tolan
*Assistant Examiner* — Justin V Lewis
(74) *Attorney, Agent, or Firm* — Chernoff Vilhauer McClung & Stenzel LLP

(57) ABSTRACT

It, as shown in FIG. 11, is provided with a feed roller 31 that is movable, rotates the spiral coil 11 passing through punched holes 3*a* of the bundle of paper-sheets 3, and guides the spiral coil 11 to feed it toward a coil advance direction, a screw guide 49 at a movable and adjustable side that guides and conducts a forward end of the spiral coil 11 fed by the feed roller 31 toward the coil advance direction into the punched holes 3*a* thereof, and a control part that receives diameter-of-coil-setting information for setting a diameter of a coil of the spiral coil 11 and controls positions of the feed roller 31 and the screw guide 49 based on the diameter-of-coil-setting information. Such a configuration enables the feed roller 31 and the screw guide 49 to move to the guided positions of the spiral coil 11 indicated by the diameter-of-coil-setting information. Accordingly, it is possible to pass the spiral coils having the different diameters thereof through the holes of the bundle of paper-sheets stably.

2 Claims, 44 Drawing Sheets

(56) References Cited

U.S. PATENT DOCUMENTS

| | | | | |
|---|---|---|---|---|
| 4,501,304 | A | 2/1985 | Lehmann | |
| 4,874,279 | A | 10/1989 | Pfaffle | |
| 5,785,479 | A | 7/1998 | Battisti et al. | |
| 6,036,423 | A | 3/2000 | Westra | |
| 6,312,204 | B1 | 11/2001 | Spiel et al. | |
| 2002/0129865 | A1 | 9/2002 | Mori et al. | |
| 2004/0197163 | A1* | 10/2004 | Spiel | 412/40 |
| 2004/0240969 | A1 | 12/2004 | Desjarlais et al. | |
| 2006/0127201 | A1* | 6/2006 | Lemens et al. | 412/33 |

FOREIGN PATENT DOCUMENTS

| | | | |
|---|---|---|---|
| DE | 2837018 | B1 | 12/1979 |
| DE | 2950120 | A1 | 6/1981 |
| DE | 2953777 | A1 | 11/1982 |
| DE | 3903506 | A1 | 10/1989 |
| EP | 1241019 | A2 | 9/2002 |
| FR | 2434712 | A1 | 8/1979 |
| GB | 711288 | A | 6/1954 |
| GB | 2029323 | A | 3/1980 |
| GB | 2074483 | A | 11/1981 |
| GB | 2128912 | A | 5/1984 |
| JP | 43-14143 | B1 | 6/1968 |
| JP | 55-033897 | A | 3/1980 |
| JP | 01-290499 | A | 11/1989 |
| JP | H01290499 | | 11/1989 |
| JP | 02-007734 | B2 | 2/1990 |
| JP | H027734 | | 2/1990 |
| JP | H02134297 | | 5/1990 |
| JP | H0656344 | | 3/1994 |
| JP | H0737441 | | 2/1995 |
| JP | H07277599 | | 10/1995 |
| JP | H10102372 | | 4/1998 |
| JP | 2002-274091 | A | 9/2002 |
| JP | 2002-337474 | A | 11/2002 |
| JP | 2002337474 | | 11/2002 |

OTHER PUBLICATIONS

English Translation of Chinese Office Action for corresponding Chinese Application No. 200880006519.3. Office Action issued Jul. 21, 2010.

Chinese Office Action for corresponding Chinese Application No. 200880006519.3. Office Action issued Dec. 17, 2010.

English Translation of Chinese Office Action for corresponding Chinese Application No. 200880006519.3. Office Action issued Dec. 17, 2010.

Notification of Rejection Reasons for JP 2007-050274, Apr. 20, 2011.

Notification of Rejection Reasons for JP 2007-050272, Apr. 22, 2011.

Chinese Office action for CN 200880006519.3, Jul. 8, 2011.

Callan, Feargel, European Search Report for EP 08720750, Mar. 16, 2011.

* cited by examiner

FIG. 24B
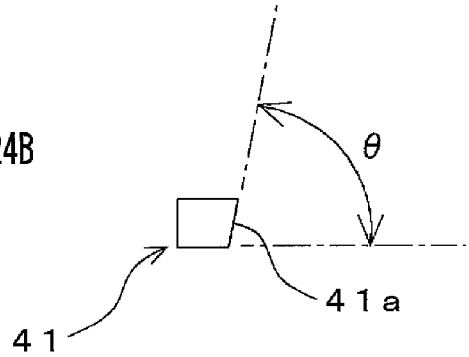
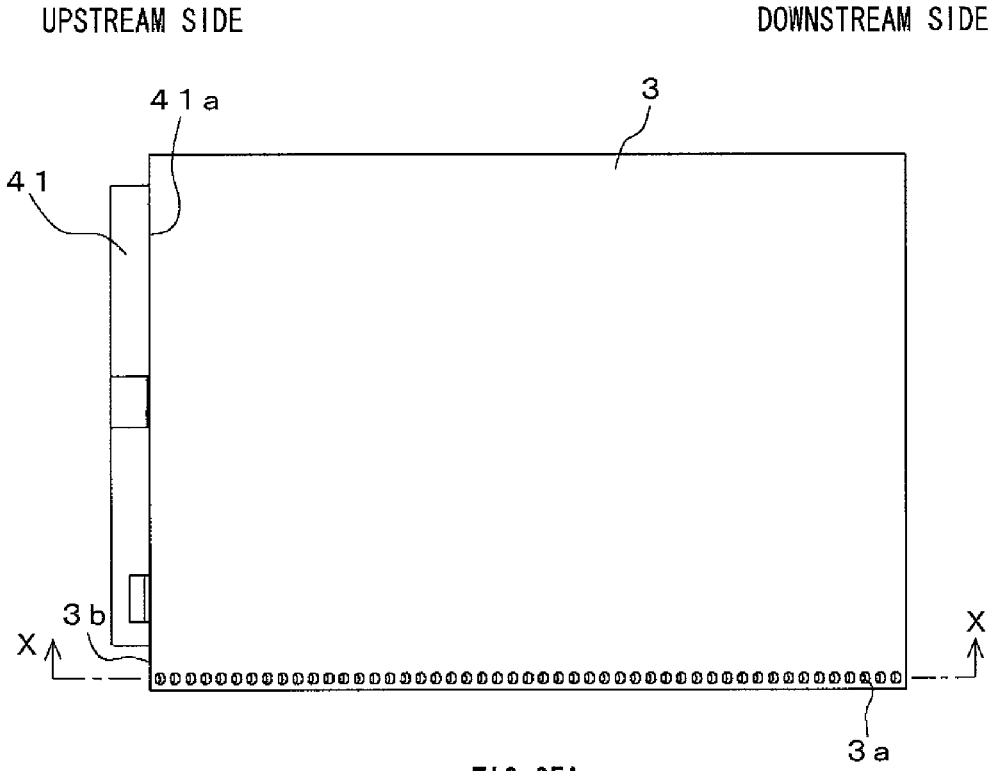
FIG. 25A

PAPER SHEET HANDLING DEVICE

This is a national stage application filed under 35 USC 371 based on International Application No. PCT/JP2008/052775 filed Feb. 19, 2008, and claims priority under 35 USC 119 of Japanese Patent Application No. 2007-050272 filed Feb. 28, 2007, Japanese Patent Application No. 2007-050273 filed Feb. 28, 2007, Japanese Patent Application No. 2007-050274 filed Feb. 28, 2007, and Japanese Patent Application No. 2007-050277 filed Feb. 28, 2007.

TECHNICAL FIELD

The present invention relates to a paper-sheet-handling apparatus which is applicable to a coil binder, a finisher or the like that performs a binding processing on the bundle of paper-sheets by passing the spiral coil through the holes of the bundle of paper-sheets bundling paper-sheets on each of which the holes are perforated on predetermined portions. It particularly relates to the one which is provided with a control part that receives diameter-of-coil-setting information for setting a diameter of a coil of the spiral coil when performing a binding processing on the bundle of paper-sheets by passing the spiral coil through the holes of the bundle of paper-sheets and by controlling positions of the rotating guide part and the first screw guide part based on the diameter-of-coil-setting information, it is possible to move the rotating guide part and the first screw guide part to a guide position of the spiral coil indicated by the diameter-of-coil-setting information and to pass the spiral coils having different diameters through the holes of the bundle of paper-sheets stably.

BACKGROUND ART

It has often performed in recent years that punched holes are perforated on recording paper-sheet on which an image is formed by a copying machine for black-and-white and colors, a printing machine or the like and a coil automatically passes through the holes of a plurality of the paper-sheets (a bundle of paper-sheets) thus perforated to prepare a booklet. This is because the booklet is made well looked as compared with a case where a corner of the bundle of paper-sheets is bound by hand using a stapler or the like.

For example, when automatically binding the coil through holes in a bundle of paper-sheets, the bundle of paper-sheets is first set on a predetermined position with the positions of the holes in the bundle of paper-sheets being aligned. The spiral coil formed from the wire rod drawn out of the wire rod cartridge so as to have a pitch similar to a pitch between the holes of the paper-sheet is next dispatched toward the bundle of paper-sheets while it is rotated. A forward end of the coil then passes through the hole in an end of the bundle of paper-sheets and by rotation of the coil, the coil moves forward and passes through the remained holes in the bundle of paper-sheets. After passing therethrough, a rear end of the coil is cut and any predetermined end-processing thereon is carried out.

In connection with such a conventional case, a dispatching device for coil bookbinding is disclosed in page 3 and FIG. 1 of Japanese Patent Application Publication No. 2002-337474. In this dispatching device for coil bookbinding, three rolls that are mounted so as to movable vertically hold the spiral coil and by rotating respective rolls, the spiral coil rotates so as to be dispatched to the punched holes of the bundle of paper-sheets. At this moment, the bundle of paper-sheets is pushed by a guide shaft. This enables the spiral coils corresponding to the different diameters of the coils to be dispatched to the bundle of paper-sheets guided by the guide shaft and enables the spiral coil to be guided to the punched holes surely.

DISCLOSURE OF THE INVENTION

Problems to be Solved by the Invention

According to the dispatching device for coil bookbinding disclosed in the page 3 and FIG. 1 of Japanese Patent Application Publication No. 2002-337474 relating to the conventional case, however, it has a roll function and fixed guide shaft. Accordingly, it is configured that when the spiral coil is dispatched by using the roll function, the spiral coil is pushed against the bundle of paper-sheets by the guide shaft set on a position fixed at all times.

Therefore, even if it is possible to guide a forward end of the spiral coil smoothly to a punched hole through which the spiral coil passes just after the dispatch thereof when passing the spiral coil therethrough, the forward end of the spiral coil is caught by edges of the punched holes to make the passage less accurate so that there is a risk of running into a situation where the spiral coil cannot pass through the punched holes. Particularly, this problem is remarkable when diameters of the coil in the spiral coils are different.

Further, according to a coil-binding processing relating to the conventional case, the spiral coil is dispatched to the punched holes, which are aligned as to be perpendicular to a paper-sheet-mounting surface of the paper-sheet-mounting base, of the bundle of paper-sheets. For this reason, when the spiral coil advances through the punched holes, which are aligned as to be perpendicular thereto, of the bundle of paper-sheets, the forward end of the spiral coil comes into contact with an inner surface of any of the punched holes so that there is a risk of obstructing the advance of the coil. Such a phenomenon of obstructing the advance of the coil is caused by the forward end of the spiral coil having an inclination with respect to the punched holes, which are aligned as to be perpendicular thereto, of the bundle of paper-sheets.

Additionally, in an end processing of cutting a rear end of the coil after the coil passes through the bundle of paper-sheets, it is necessary to realize a function of stopping coming the cut end thereof off. There are many cases where a person detects with his own eyes whether or not there is a wire rod wound on the wire rod cartridge. Thus, the detection of a remained amount of the wire rod must be depended on the user's detection with his own eyes.

Means for Solving the Problems

In order to solve the above-mentioned problems, a paper-sheet-handling apparatus according to claim 1 is a paper-sheet-handling apparatus that performs a binding processing on a bundle of paper-sheets by passing a spiral coil through plural holes for binding which are perforated on predetermined portions of each of the paper-sheets, the bundle of paper-sheets bundling the paper-sheets, characterized in that the apparatus being provided with a rotating guide part that is movable, rotates the spiral coil passing through the plural holes of the bundle of paper-sheets, and guides the spiral coil to feed it toward a coil advance direction, a first screw guide part that is movable and guides and conducts a forward end of the spiral coil fed by the rotating guide part toward the coil advance direction into the holes of the bundle of paper-sheets, and a control part that receives diameter-of-coil-setting information for setting a diameter of a coil of the spiral coil and controls positions of the rotating guide part and the first screw guide part, based on the diameter-of-coil-setting information.

According to the paper-sheet-handling apparatus relating to the claim 1, when performing a binding processing on the bundle of paper-sheets by passing the spiral coil through plural holes for binding which are perforated on predetermined portions of each of the paper-sheets, the bundle of paper-sheets bundling the paper-sheets, the rotating guide part that is movable, rotates the spiral coil passing through the holes of the bundle of paper-sheets and guides the spiral coil to feed it toward a coil advance direction. The first screw guide part that is movable, guides and conducts a forward end of the spiral coil fed by the rotating guide part toward the coil advance direction into the holes of the bundle of paper-sheets. On an assumption of this, the control part receives diameter-of-coil-setting information for setting a diameter of a coil of the spiral coil and controls positions of the rotating guide part and the first screw guide part, based on the diameter-of-coil-setting information.

Thus, the rotating guide part and the first screw guide part can be moved to the guided position of the spiral coil indicated by the diameter-of-coil-setting information. For example, the rotating guide part and the first screw guide part can move from their respective stand-by positions to respective positions away therefrom by a first distance when the diameter-of-coil-setting information indicates the spiral coil having a small diameter. Further, the rotating guide part and the first screw guide part can move from their respective stand-by positions to respective positions away therefrom by a second distance when the diameter-of-coil-setting information indicates the spiral coil having a middle diameter. Additionally, the rotating guide part and the first screw guide part can move from their respective stand-by positions to respective positions away therefrom by a third distance when the diameter-of-coil-setting information indicates the spiral coil having a large diameter. This enables the spiral coils having different diameters to be passed through holes of the bundle of paper-sheets stably.

In order to solve the above-mentioned problems, a paper-sheet-handling apparatus according to claim 6 is the one characterized in that when a portion of the bundle of paper-sheets, on which the holes are set, is a forward end portion of the paper-sheet and a portion of the paper-sheet, which faces perpendicular to the forward end portion, is a side end portion thereof, the apparatus is provided with a paper-sheet-mounting base that mounts the bundle of paper-sheets, a first paper-sheet-aligning section that limits each of the paper-sheets in the bundle of paper-sheets mounted on the paper-sheet-mounting base to align the forward end portion thereof, and a second paper-sheet-aligning section that limits each of the paper-sheets in the bundle of paper-sheets limited by the first paper-sheet-aligning section and mounted on the paper-sheet-mounting base to align the side end portion thereof, wherein the second paper-sheet-aligning section includes a paper-sheet-aligning surface having a predetermined inclination with respect to a paper-sheet-mounting surface of the paper-sheet-mounting base and limits the side end portion of the bundle of paper-sheets obliquely along the inclination of the paper-sheet-aligning surface.

According to the paper-sheet-handling apparatus relating to the claim 6, the first paper-sheet-aligning section limits each of the paper-sheets in the bundle of paper-sheets mounted on the paper-sheet-mounting base to align the forward end portion thereof. The second paper-sheet-aligning section limits each of the paper-sheets in the bundle of paper-sheets limited by this first paper-sheet-aligning section and mounted on the paper-sheet-mounting base to align the side end portion thereof. At this moment, the second paper-sheet-aligning section limits the side end portion of the bundle of paper-sheets obliquely along the inclination of the paper-sheet-aligning surface having a predetermined inclination. This enables the spiral coil to pass through the holes of the bundle of paper-sheets stably.

In order to solve the above-mentioned problems, a paper-sheet-handling apparatus according to claim 6 is the one characterized in that the apparatus is provided with an end-processing means for cutting an end of the spiral coil in the bundle of paper-sheets on which the binding processing has been performed, and processing the end thereof, the end-processing means being attached to a predetermined position of the paper-sheet-handling apparatus, wherein the end-processing means includes a pinching section that holds the end of the spiral coil by pinching it, a cutting section that cuts a predetermined position of the spiral coil pinched by the pinching section, and a bending section that bends the end of the spiral coil cut by the cutting section to a predetermined direction, the bending section being provided on an extended portion of the cutting section. According to the paper-sheet-handling apparatus relating to the claim 6, it is possible to perform processing of stopping coming the end of the spiral coil off by cutting and bending the end thereof certainly while the end of the spiral coil is held and fixed.

In order to solve the above-mentioned problems, a paper-sheet-handling apparatus according to claim 11 is the one characterized in that the apparatus is provided with a drum, on which a wire rod from which the spiral coil is formed is wound, that is mountable to the paper-sheet-handling apparatus, a detection part that detects existence or nonexistence of the wire rod wound on the drum, and a coil-forming mechanism that forms the spiral coil from the wire rod drawn out of the drum, wherein the control part controls the coil-forming mechanism and the rotating guide part based on a wire-rod-existence-or-nonexistence signal obtained from the detection part. According to the paper-sheet-handling apparatus relating to the claim 11, it is possible to read whether or not there is a wire rod on the drum with an electrical signal. Thus, it is possible to control a coil-forming system, a binding processing system, a wire-rod-existence-or-nonexistence-displaying system or the like based on the wire-rod-existence-or-nonexistence signal obtained from the detection part.

BRIEF DESCRIPTION OF THE DRAWINGS

FIG. 24B is a front view showing the paper-sheet-aligning guide 41 shown in FIG. 24A as indicated from an X-direction.

FIG. 25A is a top view showing a function example of the paper-sheet-aligning guide 41 when aligning the paper-sheets.

BEST MODE FOR CARRYING OUT THE INVENTION

Figure 1:
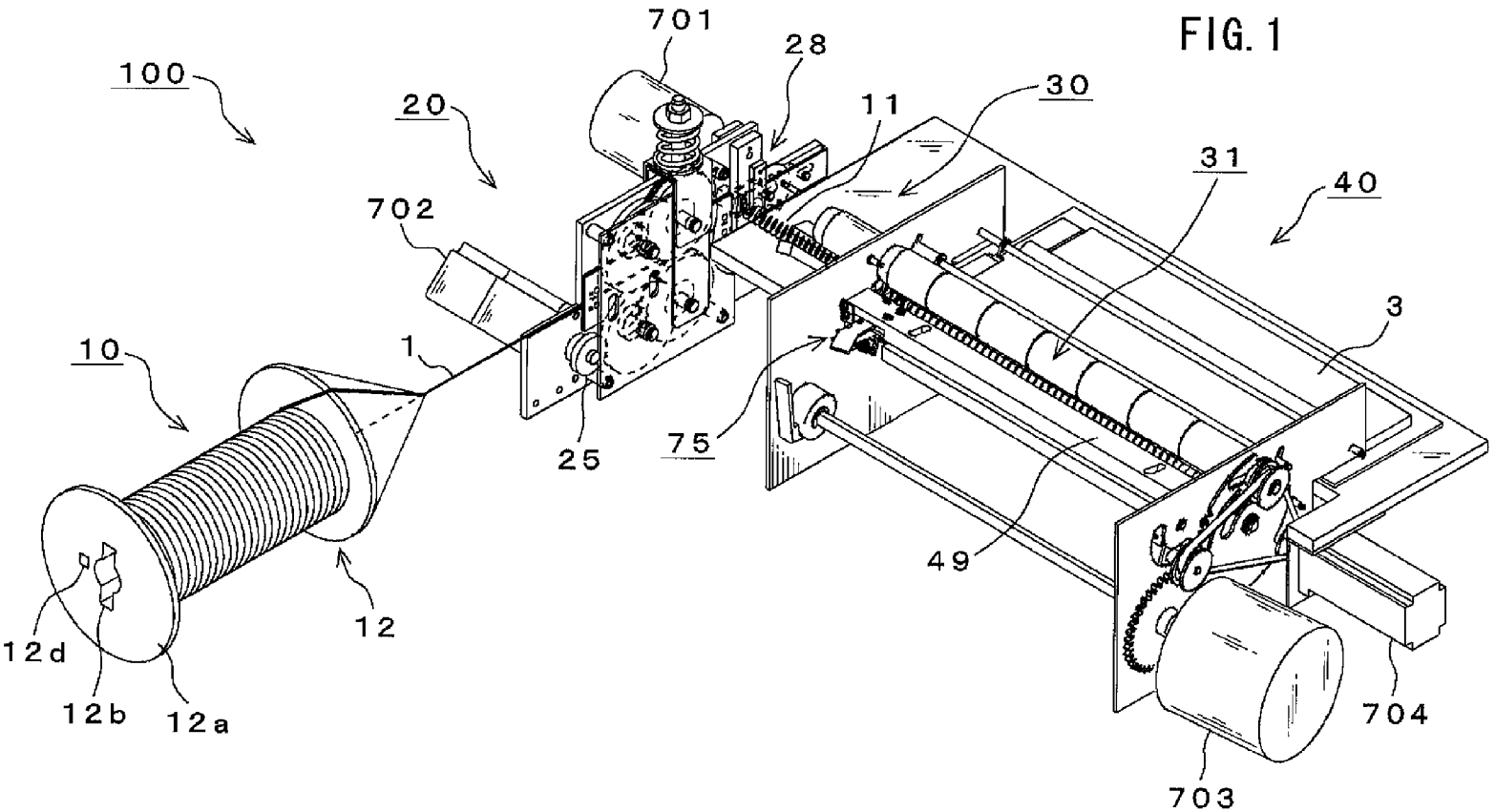
FIG. 1 is a perspective view showing a configuration example of a paper-sheet-handling apparatus 100 as an embodiment to which a coil-forming device according to the invention is applied.

It is an object to provide a paper-sheet-handling apparatus which can pass the spiral coils having different diameters through the holes of the bundle of paper-sheets stably by figuring out a coil guide function in the binding mechanism and can pass the spiral coil through the holes of the bundle of paper-sheets stably by figuring out a method of mounting the bundle of paper-sheets. It is also an object to provide a paper-sheet-handling apparatus which, in the end processing of cutting a rear end of the coil after the coil passes through the bundle of paper-sheets, can perform cutting and bending processing on the cut end thereof certainly and to provide a paper-sheet-handling apparatus which is not depended on the eyes detection of the remained amount of the wire rod for the spiral coil. A description will be given of the paper-sheet-handling apparatus according to the present invention with reference to the drawings.

A description will be given of a configuration example of the paper-sheet-handling apparatus 100 as an embodiment, to which a coil-forming device relating to the present invention is applied, with reference to FIG. 1. The paper-sheet-handling apparatus 100 is configured so as to be provided with a wire rod cartridge 10, a coil-forming mechanism 20, a linking part 30 and a binding mechanism 40. This paper-sheet-handling apparatus 100 binds a bundle of paper-sheets 3 by winding a spiral coil (hereinafter, referred to as "spiral coil 11") on the bundle of paper-sheets 3 to constitute a coil-binding apparatus.

The wire rod cartridge 10 constitutes a function of a wire-rod-supplying part and is wound by the wire rod for forming the spiral coil 11. The wire rod cartridge 10 has a drum 12 on which the wire rod 1 (consumables) is wound. The drum 12 has a bobbin 12*a* that is portable (can be carried) and at the bobbin 12*a*, a winding shaft 12*b* and an opening 12*d* for mounting are provided.

On the drum 12, for example, a vinyl-covered iron-core wire is wound with it being around 500 through 1000 m. A diameter of the wire rod 1 is around 0.8 through 1.2 mm. A waste amount of the wire rod 1 is around 2.1 m in a case of a coil having the large diameter of the coil of 14 mm if a paper-sheet has an A size, on which there are 49 punched holes. Similarly, it is around 1.6 m in a case of a coil having the middle diameter of the coil of 11 mm. It is around 1.2 m in a case of a coil having the small diameter of the coil of 8 mm.

The coil-forming mechanism 20 is provided at a downstream side of the wire rod cartridge 10 and operates to form the spiral coil 11 with a set diameter of the coil for binding the bundle of paper-sheets. To the coil-forming mechanism 20, the coil-forming device according to the invention is applied. The coil-forming mechanism 20 is configured to have a coil-forming part 28, motors 701, 702 and the like, to set the diameter of the coil and to drive a wire-rod-dispatching mechanism. In this example, it is designed that three species of diameters of the coils, a large diameter of the coil of 14 mm, a middle diameter of the coil of 11 mm and a small diameter of the coil of 8 mm, can be formed. The linking part 30 is provided at a downstream side of the coil-forming mechanism 20 and operates to guide and conduct the spiral coil 11 formed corresponding to a previously set diameter of the coil to the binding mechanism 40.

The binding mechanism 40 is provided at a downstream side of the linking part 30. It is configured that the binding mechanism 40 draws thereinto the spiral coil 11 having the predetermined diameter of the coil, which has been formed in the coil-forming mechanism 40, through the linking part 30 and binds the bundle of paper-sheets 3 by winding the spiral coil 11 thereon. The binding mechanism 40 has a feed roller 31, the screw guider 49 of a movable adjustment side, motors 703, 704 and the like. It is configured that this binding mechanism 40 sets positions of the feed roller 31, the screw guider 49 and the like corresponding to the diameter of the coil and drives the feed roller 31.

A cutting-and-bending mechanism 75 is provided at an upstream side of the screw guide 49 and is configured to bend an end of the spiral coil 11 that has passed through the bundle of paper-sheets 3 after the end thereof has been cut. The paper-sheet-handling apparatus 100 having such a configuration can create booklets by performing a binding processing on the bundles of paper-sheets 3 with the spiral coils 11.

Figure 2A:
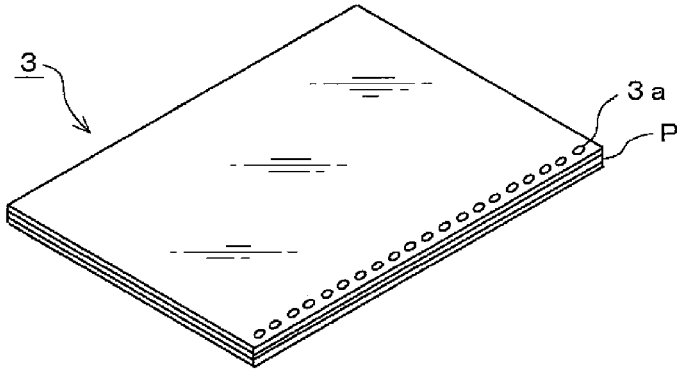
FIG. 2A is a perspective view of a bundle of paper-sheets 3 for showing a function example of the paper-sheet-handling apparatus 100.
Figure 2B:
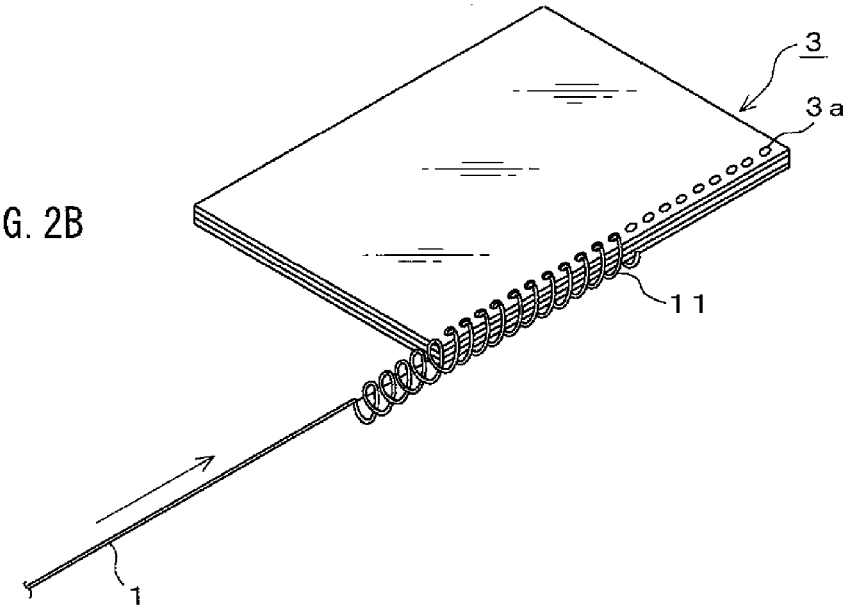
FIG. 2B is a perspective view of a binding step for showing the function example of the paper-sheet-handling apparatus 100.
Figure 2C:
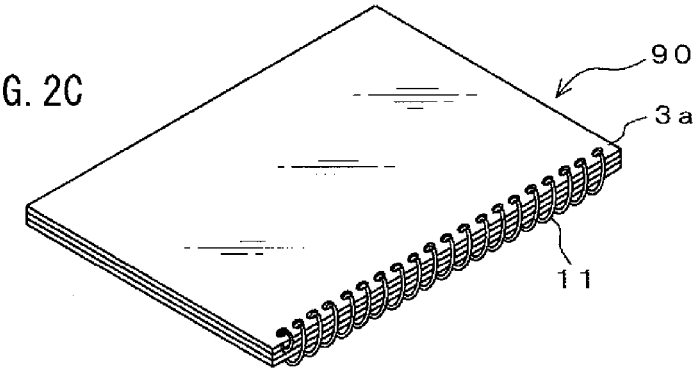
FIG. 2C is a completed view of a booklet 90 for showing the function example of the paper-sheet-handling apparatus 100.

The following describe a function example of the paper-sheet-handling apparatus 100 with reference to FIGS. 2A through 2C. The bundle of paper-sheets 3 shown in FIG. 2A is applied to the paper-sheet-handling apparatus 100 and any punched holes 3*a* have been already perforated at predetermined positions on each paper-sheet. It is configured that the binding processing is performed at a period of coil binding time after opening positions of the punched holes 3*a* in the bundle of paper-sheets 3 have been aligned. The punched holes 3*a* may be perforated with a predetermined pitch by means of an automatic punching processing or may be perforated with a predetermined pitch by means of a manual puncher. The punched holes 3*a* may be perforated at either method if disposition pitch in the punched holes 3*a* is in correspondence with a pitch of formed coil.

Next, according to the binding step shown in FIG. 2B, it is configured that the binding processing is performed on the bundle of paper-sheets 3 with the spiral coil 11 formed by the paper-sheet-handling apparatus 100 on a real-time basis. In this example, it is configured that the spiral coil 11 formed by the coil-forming mechanism 20 shown in FIG. 1 is inserted into the punched holes 3*a* of the bundle of paper-sheets 3 and is wound in cooperation with the linking part 30 and the binding mechanism 40. A rear end of the spiral coil 11 is then cut and a forward end and the rear end thereof are bent. This enables a booklet 90, into which the spiral coil 11 is wound, shown in FIG. 2C to be obtained.

Figure 3:
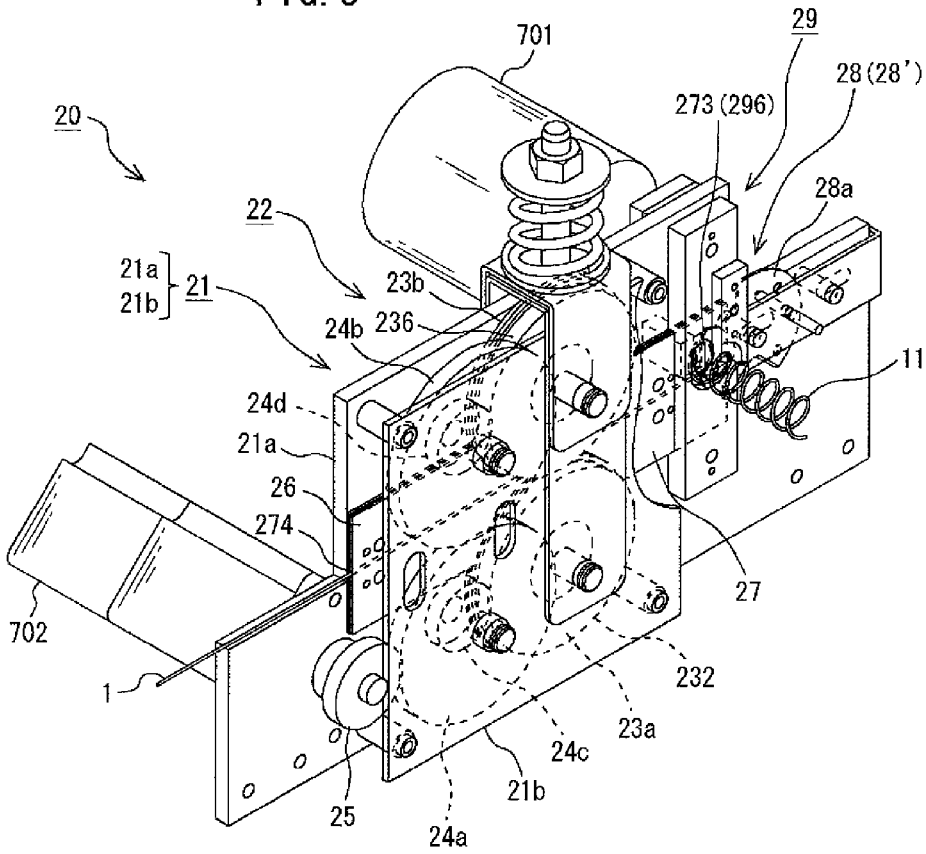
FIG. 3 is a perspective view showing a configuration example of a coil-forming mechanism 20.

The following will describe a configuration example of the coil-forming mechanism 20 with reference to FIG. 3. The coil-forming mechanism 20 shown in FIG. 3 forms the spiral coil 11 for binding the bundle of paper-sheets 3 and is configured to have a main body part 21, a wire-rod-dispatching mechanism 22, the coil-forming part 28 and a pitch-adjusting mechanism 29. This coil-forming mechanism 20 form the spiral coil 11 based on the wire rod 1 dispatched from, for example, the predetermined drum 12 shown in FIG. 1.

The main body part 21 is configured to have a convex board 21*a* and a rectangular board 21*b* (shown in a partially broken state in the figure). The boards 21*a*, 21*b* are constituted of metal boards each having a predetermined thickness and both are used in their stand postures. For the metallic boards, for example, iron boards, aluminum boards or the like are used.

To the main body part 21, the wire-rod-dispatching mechanism 22 constituting a function of the wire-rod-dispatching part is attached. The wire-rod-dispatching mechanism 22 has dispatching rollers 23*a*, 23*b* for forcing the wire rod, a wire-rod-inserting guide part 26 and a wire-rod-pushing-out guide part 27.

The wire-rod-inserting guide part 26 is provided at an upstream side of the dispatching rollers 23*a*, 23*b*. It is configured that a wire rod insertion port 274 is provided in this wire-rod-inserting guide part 26, to which the wire rod 1 is inserted (supplied). The wire rod insertion port 274 is a portion to which the wire rod 1 is supplied and constitutes a port to which one wire rod can advance. For the wire rod 1, a vinyl-covered iron-core wire is used. Of course, it is not limited thereto: an aluminum wire, a plating aluminum-core wire, a plating iron-core wire or the like may be used for the wire rod 1.

The dispatching rollers 23*a*, 23*b* are provided between the wire-rod-inserting guide part 26 and the wire-rod-pushing-out guide part 27. The dispatching rollers 23*a*, 23*b* each has an R-groove (a groove having a curved section of almost an arc of a circle) corresponding to a diameter of the wire rod 1. The dispatching roller 23*a* has a large diameter gear 232 and the dispatching roller 23*b* has a large diameter gear 236, respectively.

The wire-rod-pushing-out guide part 27 is provided at a downstream side of the dispatching rollers 23*a*, 23*b* and is configured that the wire rod 1 inserted from the wire insertion port 274 is guided (supplied) into the coil-forming part 28. The wire-rod-pushing-out guide part 27 has an opening 273 for mounting a pitch-fine-adjusting block. The wire-rod-dispatching mechanism 22 having such a configuration enables the wire rod 1 having the predetermined thickness to be fitted with the R-grooves of the dispatching rollers 23*a*, 23*b*. It is thus possible to force the wire rod 1 from the wire-rod-inserting guide part 26 into the coil-forming part 28 through the wire-rod-pushing-out guide part 27 without receiving any wound to the wire rod 1 and slipping the wire rod 1.

The dispatching rollers 23*a*, 23*b* are configured so as to rotate through up-and-down interlocking large diameter gears 24*a*, 24*b* for deceleration, which constitute a driving part. A motor gear 25 is meshed with the large diameter gear 24*a*. The motor gear 25 is attached to a shaft of a motor 702. The lower large diameter gear 24*a* and the upper large diameter gear 24*b* are meshed with each other at their outer circumferences by their gears. The large diameter gear 24*a* has a small diameter gear 24*c*.

The small diameter gear 24*c* is meshed with a large diameter gear 232 of the dispatching roller 23*a*. The large diameter gear 24*b* has a small diameter gear 24*d*. The small diameter gear 24*d* is meshed with a large diameter gear 236 of the dispatching roller 23*b*. In this example, when the motor 702 rotates, the large diameter gears 24*a*, 24*b* rotate through the motor gear 25 so that the lower dispatching roller 23*a* and the upper dispatching roller 23*b* rotate through the small diameter gears 24*c*, 24*d*.

To the main body part 21 in which the wire-rod-dispatching mechanism 22 is provided, the coil-forming part 28 is attached. In this example, the coil-forming part 28 has a selection mechanism 28'. In the selection mechanism 28', a forming adapter 28*a* is provided. The forming adapter 28*a* is rotatably attached to the main body part 21 and is configured that one section like an arc of a circle can be selected from three sections, #Ø14, #Ø11, #Ø8, each like an arc of a circle.

Here, the section #Ø14 like an arc of a circle forms an internal shape that forms a coil having a large diameter of the coil of 14 mm. Similarly, the section #Ø11 like an arc of a circle forms an internal shape that forms a coil having a middle diameter of the coil of 11 mm. The section #Ø8 like an arc of a circle also forms an internal shape that forms a coil having a small diameter of the coil of 8 mm.

The sections, #Ø14, #Ø11, #Ø8, each like an arc of a circle respectively have a pick-up function when advancing the wire rod. For example, by attaching the wire rod 1 to any of the sections, #Ø14, #Ø11, #Ø8, each like an arc of a circle having different diameters so as to lie along inside them, it is configured that the diameter of the coil is set to be a diameter of 14 mm, 11 mm or 8 mm. Since the configuration such that the wire rod 1 is wound around a core member is not taken in this example, it is made possible to simplify a configuration of the coil-forming device without any necessary for changing parts or the like, as compared with a conventional system.

A motor 701 for setting a diameter of a coil is connected with the forming adapter 28*a* and drives so as to select one section like an arc of a circle from the three sections, #Ø14, #Ø11, #Ø8, each like an arc of a circle. For the motor 701, a stepping motor is used. The above-mentioned wire-rod-dispatching mechanism 22 dispatches the wire rod 1 having a predetermined thickness from the wire rod insertion port 274 to, for example, the section #Ø14 like an arc of a circle, which is selected by the motor 701, with it being attached to the section #Ø14 like an arc of a circle.

The pitch-adjusting mechanism 29 is provided in the main body part 21 so as to put an end of the forming adapter 28*a* therebetween. It is configured that this pitch-adjusting mechanism 29 adjusts a pitch of the spiral coil 11 formed by, for example, the section #Ø14 like an arc of a circle, which is selected by the motor 701, and dispatched from the section #Ø14 like an arc of a circle. The pitch-adjusting mechanism 29 has a coil discharge port 296 that is provided so as to come into continuous contact with the opening 273 of the wire-rod-pushing-out guide part 27.

A description will be given of an assembling example of the coil-forming mechanism 20 with reference to FIGS. 4 and 5. In this example, the description will be given with it classifying the coil-forming mechanism 20 into 2 parts, the wire-rod-dispatching mechanism 22 and the coil-forming part 28, which constitute the coil-forming mechanism 20.

Figure 4:
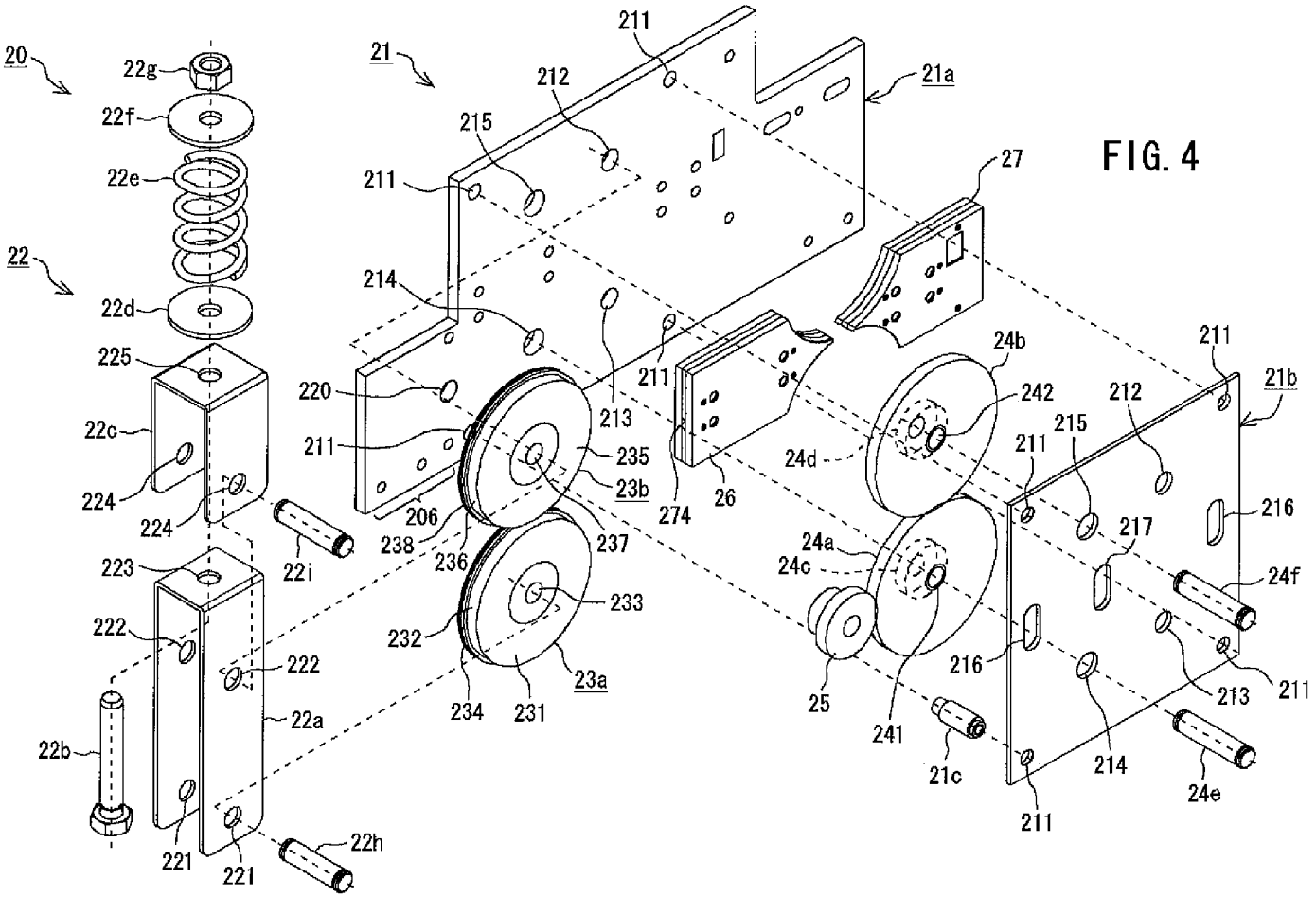
FIG. 4 is a perspective view showing an assembling example (part one) of the coil-forming mechanism 20.

According to the coil-forming mechanism 20 shown in FIG. 4, an anterior half thereof is configured so that the wire-rod-dispatching mechanism 22 is attached to the main body part 21. The main body part 21 is configured to have the convex board 21*a* and the rectangle board 21*b*. The convex board 21*a* has shaft holes 212, 213 and 220 and holes 206 for mounting the motor. The board 21*b* has shaft holes 212, 213 and long holes 216, 217 for checking.

The wire-rod-dispatching mechanism 22 has a long U frame 22*a* having an inverse U-shape. The U frame 22*a* is formed by, for example, performing a bending processing on a rectangular iron plate into a U-shape. The U frame 22*a* respectively has shaft holes 221, 221 at lower portions of its side surfaces, has shaft holes 222, 222 at upper portions of its side surfaces, and has an engaging hole 223 for inserting a bolt thereinto at its upper top surface.

On the long U frame 22*a* having the inverse U-shape, a short U frame 22*c* having an inverse U-shape is mounted. The U frame 22*c* is formed by, for example, performing a bending processing on a rectangular iron plate into a U-shape. The U frame 22*c* respectively has shaft holes 224, 224 at lower portions of its side surfaces, and has an engaging hole 225 for inserting a bolt thereinto at its upper top surface.

The bolt 22*b* is inserted into the engaging hole 225 via the engaging hole 223 of the U frame 22*a*. It is configured that into the bolt 22*b*, a washer 22*d*, a coil spring 22*e* and a washer 22*f* are fitted, and then they are fixed by a nut 22*g*.

The wire-rod-dispatching mechanism 22 has circular dispatching rollers 23*a*, 23*b*. The dispatching roller 23*a* has a main body part 231 and a shaft hole 233 and also has a large diameter gear 232 on a peripheral portion of the main body part 231. The R-groove (a groove having a curved section of almost an arc of a circle) is provided in the large diameter gear 232 so as to be adjacent thereto. Similarly, the dispatching roller 23*b* has a main body part 235 and a shaft hole 237 and also has a large diameter gear 236 on a peripheral portion of the main body part 235. The R-groove 238 is provided in the large diameter gear 236 so as to be adjacent thereto.

The R-groove 234 of the large diameter gear 232 and the R-groove 238 of the large diameter gear 236 are formed corresponding to an outer diameter of the wire rod 1. It is thus made possible to dispatch the wire rod 1 so that the large diameter gears 232, 236 wrap the outer circumference of the wire rod 1, thereby enabling the coil forming to be carried out more stably as compared with a case where the large diameter gears 232, 236 are constituted of V-grooves.

The dispatching roller 23*a* is inserted into a lower portion of an inverse U-shaped portion in the U-frame 22*a* and is rotatably mounted by a lower shaft pin 22*h* through the shaft holes 221 in the U-frame 22*a*. Ring grooves are processed on both ends of the shaft pin 22*h*.

The dispatching roller 23*b* is inserted into an upper portion of the inverse U-shaped portion in the U-frame 22*a* and is rotatably mounted by an upper shaft pin 22*i* through the shaft holes 224 in the U frame 22*c* and the shaft holes 222 in the U-frame 22*a*. Ring grooves are processed on both ends of the shaft pin 22*i*, which is similar to the shaft pin 22*h*. The wire-rod-dispatching mechanism 22, both ends of the shaft pin 22*h* are put into the shaft hole 213 of the board 21*a* and the shaft hole 213 of the board 21*b* and a C-ring spring, not shown, is fixed (locked) onto the ring groove thereof. Both ends of the shaft pin 22*i* thereof are put into the shaft hole 212 of the board 21*a* and the shaft hole 212 of the board 21*b* and a C-ring spring, not shown, is fixed onto the ring groove thereof.

The wire-rod-dispatching mechanism 22 has the up-and-down interlocking large diameter gears 24*a*, 24*b* for deceleration, which constitute a driving part. The lower large diameter gear 24*a* and the upper large diameter gear 24*b* are meshed with each other at their outer circumferences by their gears. The large diameter gear 24*a* has a small diameter gear 24*c* and a shaft hole 241. The large diameter gear 24*a* is inserted between the boards 21*a*, 21*b*, and is rotatably mounted with the shaft pin 24*e* being reached to the shaft hole 241 and the shaft hole 214 of the board 21*a* through the shaft hole 214 of the board 21*b*. Ring grooves are also processed on both ends of the shaft pin 24*e*. The small diameter gear 24*c* is meshed with the large diameter gear 232 in the dispatching roller 23*a*.

The large diameter gear 24*b* has a small diameter gear 24*d* and a shaft hole 242. The large diameter gear 24*b* is inserted between the boards 21*a*, 21*b* so as to be an upper portion of the large diameter gear 24*a* and is rotatably mounted with the shaft pin 24*f* being reached to the shaft hole 242 and the shaft hole 215 of the board 21*a* through the shaft hole 215 of the board 21*b*. Ring grooves are also processed on both ends of the shaft pin 24*f*. The small diameter gear 24*d* is meshed with the large diameter gear 236 in the dispatching roller 23*b*. The motor gear 25 is meshed with the above-mentioned large diameter gear 24*a*. The motor gear 25 is connected with the motor 702 through the shaft hole 220 of the board 21*a* (see FIG. 1). The motor 702 is mounted using the holes 206 for mounting the motor on the board 21*a*.

The wire-rod-inserting guide part 26 is provided at one side of the dispatching rollers 23*a*, 23*b* and the wire-rod-pushing-out guide part 27 is provided at the other side of the dispatching rollers 23*a*, 23*b*. The above-mentioned motor gear 25 is mounted on the shaft of the motor 702 shown in FIG. 1. When the motor 702 rotates, the large diameter gear 24*a* rotates via the motor gear 25 and the large diameter gear 24*b* also rotates. When the large diameter gear 24*a* rotates, its small diameter gear 24*c* rotates the dispatching roller 23*a* via the large diameter gear 232. At the same time, when the large diameter gear 24*b* rotates, its small diameter gear 24*d* rotates the dispatching roller 23*b* via the large diameter gear 236. This enables the wire rod 1 pinched by the R-grooves 234, 238 to be dispatched (see FIG. 1).

The wire rod 1 is drawn into the wire-rod-inserting guide part 26 and is pushed out of the dispatching rollers 23*a*, 23*b*. The wire rod 1 is then inserted into the wire-rod-pushing-out guide part 27 and is attached to one of the sections, #Ø14, #Ø11, #Ø8, each like an arc of a circle, in the forming adapter 28*a* shown in FIG. 5.

Figure 5:
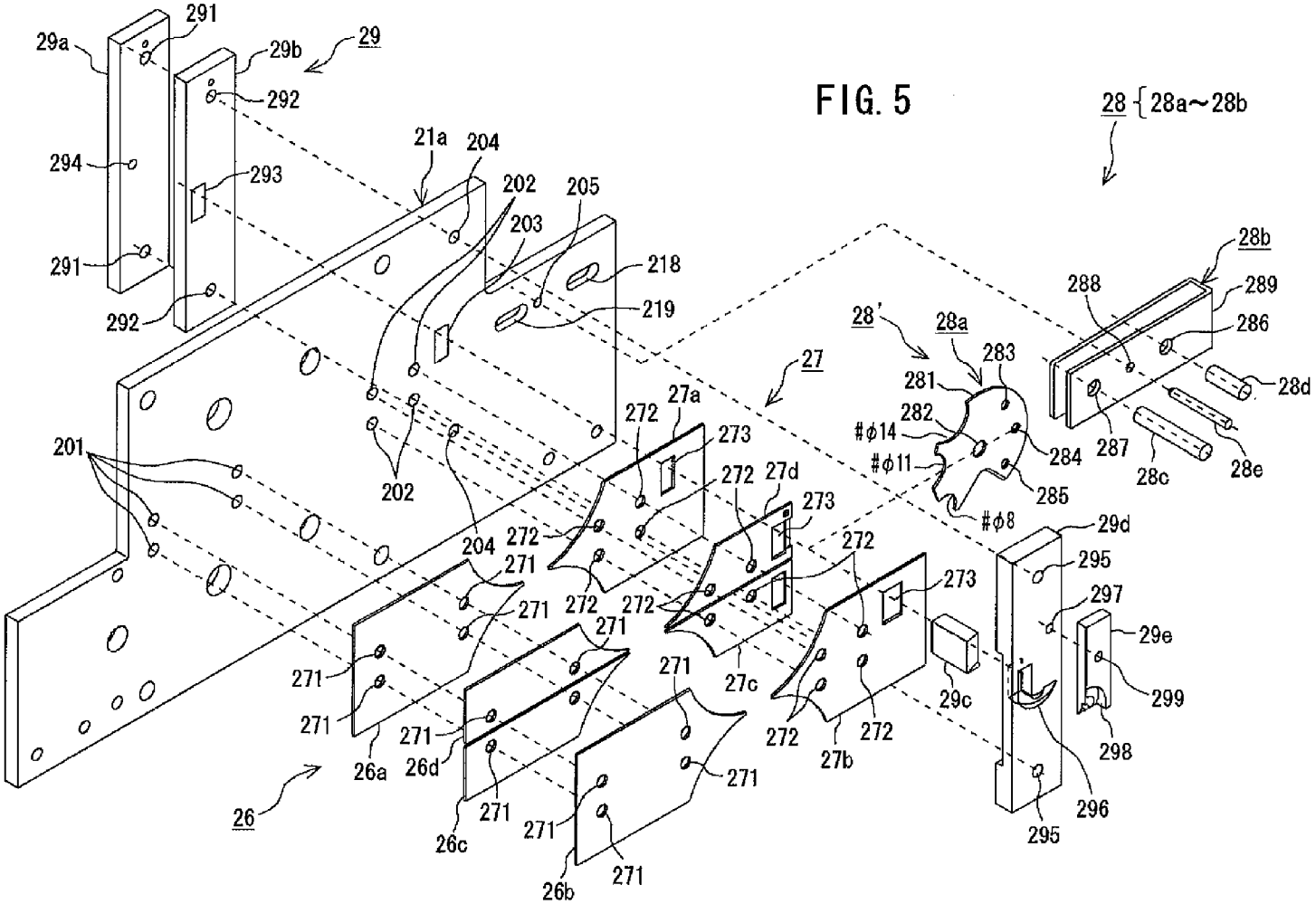
FIG. 5 is a perspective view showing the assembling example (part two) of the coil-forming mechanism 20.

According to the coil-forming mechanism 20 shown in FIG. 5, it is configured that the coil-forming part 28 and the pitch-adjusting mechanism 29 at its posterior half are mounted to the main body part 21 shown in FIG. 4.

The wire-rod-inserting guide part 26 shown in FIG. 5 is configured to have guide boards 26*a*, 26*b*, 26*c* and 26*d*. The guide boards 26*a* and 26*b* are constituted of metal plates each like a point of a sword. A part thereof like a point of a sword is formed so as to be reflective of an arc of a circle on an outer configuration of each of the dispatching rollers 23*a* and 23*b*. The guide boards 26*a* and 26*b* have respectively four mounting holes 271. Each of the guide boards 26*c* and 26*d* has a thickness that is set to one that is slightly thicker than a diameter of the wire rod. The guide boards 26*c* and 26*d* respectively have two mounting holes 271. Each of the guide boards 26*c* and 26*d* is configured to have a size set to one that is slightly smaller than a size shared fifty-fifty with each of the guide board 26*a*, 26*b* or the like in a longitudinal direction thereof.

The wire-rod-inserting guide part 26 is assembled so that the guide boards 26*c* and 26*d* are pinched by the guide board 26*a* and the guide board 26*b*. In this example, the guide boards 26*c* and 26*d* are opposed to each other in the longitudinal direction thereof in order to keep an insertion path of the wire rod 1 so as to set a gap that has a size which is slightly larger than the diameter of the wire rod 1. Under this condition, mounting screws, not shown, are respectively mounted onto four screw holes 201 of the board 21*a* through the four holes 271 of the guide board 26*b*, the two holes 271 for each of the guide boards 26*c* and 26*d* and the four holes 271 of the guide board 26*a*. This enables the wire-rod-inserting guide part 26 to be fixed to the board 21*a*.

The wire-rod-pushing-out guide part 27 is configured to have guide boards 27*a*, 27*b*, 27*c* and 27*d*. The guide boards 27*a* and 27*b* are constituted of metal plates each like a point of a sword, which are shorter than those of the wire-rod-inserting guide part 26. A part thereof like a point of a sword is formed based on the reason similar to that of the wire-rod-inserting guide part 26. The guide boards 27*a* and 27*b* have respectively four mounting holes 272. Further, rectangular openings 273 are provided at predetermined positions of the guide boards 27*a* and 27*b* at positions opposed to the parts each like the point of the sword thereof.

Each of the guide boards 27*c* and 27*d* has a thickness that is set to one that is slightly thicker then a diameter of the wire rod 1. The guide boards 27*c* and 27*d* respectively have two mounting holes 272. Each of the guide boards 27*c* and 27*d* is configured to have a size set to one that is slightly smaller than a size shared fifty-fifty with each of the guide board 27*a* or 27*b* in a longitudinal direction thereof. Rectangular openings 273 are provided at sides of the guide boards 27*c* and 27*d* opposed to the parts each like the point of the sword thereof. In this example, the rectangular opening 273 of the guide board 27*c* may be omitted but the guide board 27*c* and the guide board 27*d* have interchangeability on parts.

The wire-rod-pushing-out guide part 27 is assembled so that the guide boards 27*c* and 27*d* are pinched by the guide board 27*a* and the guide board 27*b*. In this example, the guide boards 27*c* and 27*d* are opposed to each other in the longitudinal direction thereof, which is similar to the guide boards 26*c* and 26*d*, in order to keep a pushing-out path of the wire rod, so as to set a gap that has a size which is slightly larger than the diameter of the wire rod 1. Further, the opening 273 of the guide board 27*a*, the opening 273 of the guide board 27*d* and the opening 273 of the guide board 27*b* are aligned so as to correspond to each other. Under this condition, mounting screws, not shown, are respectively mounted onto four screw holes 202 of the board 21*a* through the four holes 272 of the guide board 27*b*, the two holes 272 for each of the guide boards 27*c* and 27*d* and the four holes 272 of the guide board 27*a*. This enables the wire-rod-pushing-out guide part 27 to be fixed to the board 21*a*.

A pin hole 205, a long aperture 218 and a long aperture 219 are provided in the above-mentioned board 21*a* and the coil-forming part 28 is attached thereto using these apertures and hole. The coil-forming part 28 is configured to have the forming adapter 28*a*, U frame 28*b* and an engaging pin 28*d*. The forming adapter 28*a* is used which has a main body portion 281 on which a shaft-engaging hole 282 and pin-engaging holes 283 through 285 are provided and on which cut-away portions #Ø14, #Ø11, #Ø8 for setting a diameter of the coil are provided. For example, the forming adapter 28*a* forms the three semicircle sections #Ø14, #Ø11, #Ø8, each like an arc of a circle, by cutting its periphery of the circular metallic main body portion 281 into different sized ones.

The U frame 28*b* has a long main body portion 289 having an inverse U shape. Pin holes 286 for fixing the main body portion, shaft holes 287 and pin holes 288 for fixing the forming adapter 28*a* are provided on the main body portion 289. In this example, the U frame 28*b* is attached to the board 21*a* while the forming adapter 28*a* is inserted into the U frame 28*b*. For example, a rotation shaft 28*c* for mounting a motor shaft is inserted into one of the shaft holes 287 of the U frame 28*b* and is then fitted into the shaft-engaging hole 282. The rotation shaft 28*c* is next inserted into the long aperture 219 of the board 21*a* and is then inserted into the other shaft hole 287 of the U frame 28*b*. The engaging pin 28*d* is inserted into the pin hole 286 and the long aperture 218 of the board 21*a* and both end thereof are fixed by C clamp members.

An end of the rotation shaft 28*c* is retained at an outside of the U frame 28*b* and the other end thereof is attached to the shaft of the motor 701 shown in FIG. 1, for example, at an outside of the board 21*a*. The motor 701 selects one section like an arc of a circle from the three sections #Ø14, #Ø11, #Ø8, each like an arc of a circle for setting a diameter of the coil. This enables a selection mechanism 28' including the forming adaptor 28*a* rotatably attached to the main body part 21 to be configured.

Further, a pin 28*e* for fixation is inserted into one of the pin holes 288 of the U frame 28*b* and is further inserted into any one of the pin-engaging holes 283 through 285 of the forming adapter 28*a*. The pin 28*e* is next inserted into the pin hole 205 of the board 21*a* and is then inserted into the other pin hole 288 of the U frame 28*b*. The pin 28*e* for fixation is configured so as to be able to be taken out and put in. For example, the pin 28*e* is provided with a solenoid and the pin 28*e* is made free when selecting any of the sections #Ø14, #Ø11, #Ø8, each like an arc of a circle for setting a diameter of the coil. It is configured that the pin 28*e* is inserted into the pin hole 205 and the pin holes 288 to lock the forming adapter 28*a* when selecting the diameter of the coil. It is to be noted that by taking out the pin 28*e*, the forming adapter 28*a* can move along the long aperture 218 or 219 with it being inseparable from the U frame 28*b*, thereby making any alteration of the diameter of the coil easy.

The pitch-adjusting mechanism 29 other than the coil-forming part 28 is attached to the above-mentioned board 21*a*. The above-mentioned board 21*a* is provided with an opening 203 for attaching the pitch-adjusting mechanism and a screw hole 204. The pitch-adjusting mechanism 29 is configured to have a cover board 29*a*, a guide board 29*b*, a block 29*c* for making fine pitch adjustment (hereinafter, referred to as "fine adjustment part") and an adjustment board 29*d*. The cover board 29*a* is constituted of a rectangular sheet metal having a predetermined thickness and has two screw holes 291, 291 for attachment at predetermined positions. A screw hole 294 for performing fine adjustment of the coil pitch is provided on the cover board 29*a* at a predetermined position.

The guide board 29*b* is constituted of a rectangular sheet metal having a size and a thickness, which are similar to those of the cover board 29*a*, and has two screw holes 292, 292 at predetermined positions. The guide board 29*b* is provided with a rectangular opening 293 at a predetermined position. Into the opening 293, the fine adjustment part 29*c* is fitted. The opening 293 is positioned at a position from which the screw hole 294 of the cover board 29*a* is seen. This is because by a screw (male screw) for fine adjustment, not shown, to be engaged with the screw hole 294, the fine adjustment part 29*c* is moved.

The adjustment board 29*d* is constituted of a rectangular sheet metal having a size which is almost similar to that of the cover board 29*a* or the guide board 29*b*. A thickness of the adjustment board 29*d* is configured of a member that is thicker than the cover board 29*a*, the guide board 29*b* or the like. In this example, the adjustment board 29*d* has a recessed portion that covers the openings 273 of the wire-rod-pushing-out guide part 27.

The adjustment board 29*d* has the coil discharge port 296 and a screw hole 297 for engagement. The coil discharge port 296 is formed like around a fishing hook obtained by combining into a single unit the rectangular opening for inserting the fine adjustment part 29*c* thereinto and a crescent-shaped opening. In this example, it is configured to draw the spiral coil 11 having a diameter of a coil of 8 mm, 11 mm, 14 mm or the like from the coil discharge port 296.

It is configured that the above-mentioned fine adjustment part 29*c* constitutes a function of a pitch adjustment correction part and adjusts a discharge position of the spiral coil 11. The fine adjustment part 29*c* has, for example, a rectangular shape having a predetermined thickness. This fine adjustment part 29*c* is assembled so that it can move among the opening 293 of the guide board 29*b*, the opening 203 of the board 21*a*, the openings 273 of the wire-rod-pushing-out guide part 27 and the coil discharge port 296 of the adjustment board 29*d*.

The openings or port 293, 203, 273 and 296 form a hollow portion (a tunnel) in which the fine adjustment part 29*c* can be moved. This hollow portion is provided for enabling the coil pitch to be finely adjusted by allowing the fine adjustment part 29*c* to be moved back and forth on the carriage direction of the spiral coil 11. This enables a pitch of the spiral coil 11 adjusted by the pitch-adjusting mechanism 29 to be corrected by the fine adjustment part 29*c* corresponding to any tensile strength of the wire rod 1 having a predetermined thickness.

A stepped pitch-adjusting part 29*e* is mounted onto the adjustment board 29*d* above this coil discharge port 296 with around the fishing hook shape. The pitch-adjusting part 29*e* has a dispatch guide portion 298 at a corner of a rectangular metal sheet having a predetermined thickness. The dispatch guide portion 298 is formed to have stepped shapes each like a quarter of an arc of a circle, along which plural species of the spiral coils having diameters of a coil of 8 mm, 11 mm, 14 mm and the like are moved. The pitch-adjusting part 29*e* also has a screw hole 299. The pitch-adjusting part 29*e* is attached to the screw hole 297 of the adjustment board 29*d* by a male screw, not shown, via the screw hole 299.

The adjustment board 29*d* has two screw holes 295 for engagement at predetermined positions. The adjustment board 29*d* is fixed to the board 21*a* by inserting a bolt, not shown, through the screw hole 295, the screw hole 204 of the board 21*a*, the screw hole 292 of the guide board 29*b* and the screw hole 291 of the cover board 29*a* and fastening it with a nut or the like at an outside of the cover board 29*a*. In connection with the other screw hole 295, it is fixed thereto in a similar manner. This enables the pitch-adjusting mechanism 29 to be incorporated into the board 21*a*.

It is to be noted that a case where four screw holes 201 and four screw holes 202 in the board 21*a* are formed as female screws by tapping the board 21*a* is shown. Of course, it is not limited thereto: if the board 21*a* can not maintain an enough thickness, the wire-rod-inserting guide part 26 and the wire-rod-pushing-out guide part 27 may be fixed by steel screws or a bolt-and-nut.

Further, the boards 21*a* and 21*b* shown in FIG. 4 are attached to each other via four space members 21*c* (only one member shown in the figure). For example, the space member 21*c* shown in the figure is sandwiched between each of the four screw holes 211 provided in the board 21*a* at predetermined positions and each of the four screw holes 211 provided in the board 21*b* at predetermined positions and they are fixed by a screw, not shown. It is configured that when a female screw is provided for the space member 21*c*, the female screw is fixed with a male screw, not shown. It is configured that when using a pipe shaped member as the space member 21*c*, a long bolt is used to be passed through from the board 21*a* to the board 21*b* via a pipe shaped space member to fix the boards 21*a* and 21*b*. These enable the coil-forming mechanism 20 to be assembled.

The following will describe a coil-forming example according to the invention with reference to FIGS. 6A through 10C.

In this example, the sections, #Ø14, #Ø11, #Ø8, each like an arc of a circle respectively have a pick-up function when the wire rod advances. A case where the section #Ø8 like an arc of a circle in the forming adapter 28*a* is selected in the coil-forming part 28 is illustrated.

Figure 6A:
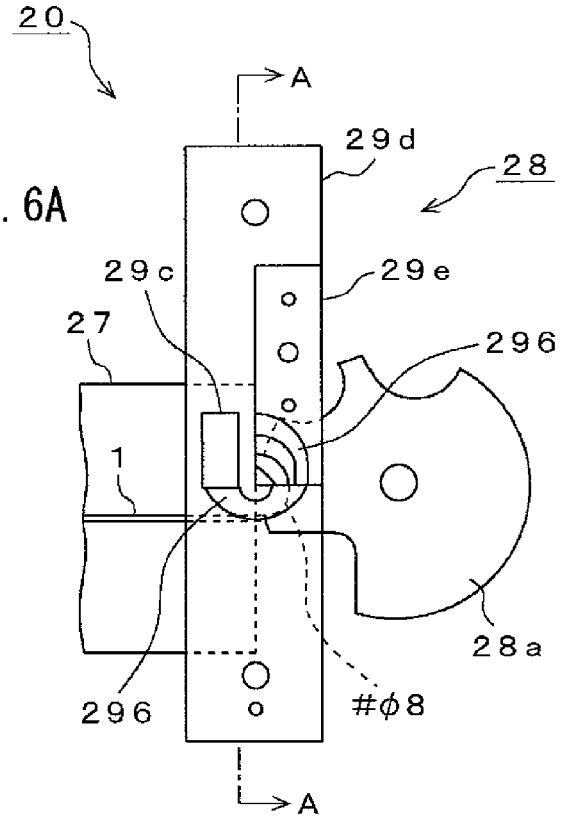
FIG. 6A is a front view showing a pushing-out example (part one) of a wire rod when a coil is formed.
Figure 6B:
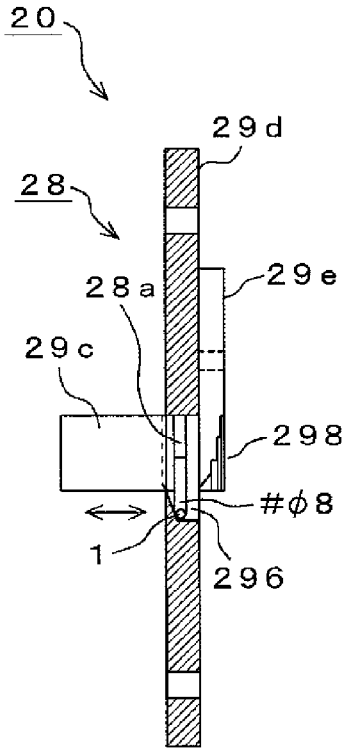
FIG. 6B is a cross-sectional view taken along lines A-A of FIG. 6A.

The wire rod 1 pushed out of the wire-rod-pushing-out guide part 27 shown in FIG. 6A comes into contact with the section #Ø8 like an arc of a circle in the forming adapter 28*a* shown in the same figure. At this moment, the wire rod 1 comes into contact with a lower end of the section #Ø8 like an arc of a circle shown in FIG. 6B. This lower end is designed to act a start end when it is encircled along a circle having a diameter of 8 mm.

Figure 7A:
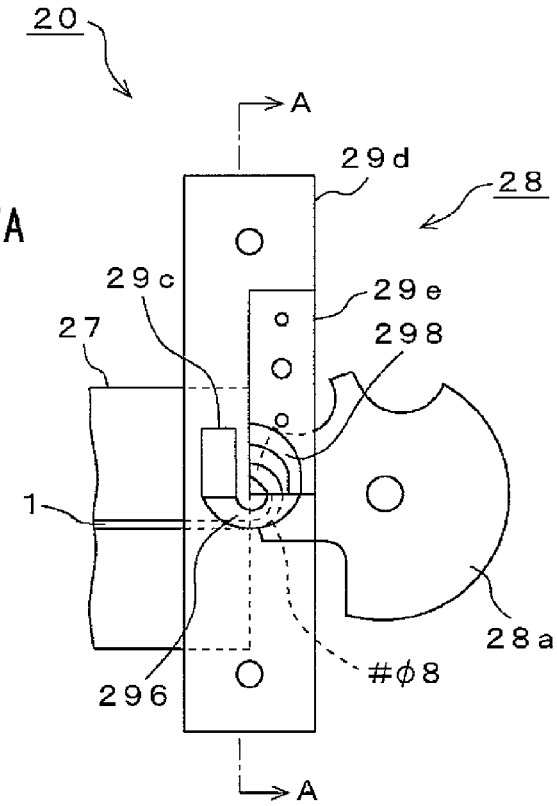
FIG. 7A is a front view showing the pushing-out example (part two) of the wire rod when the coil is formed.
Figure 7B:
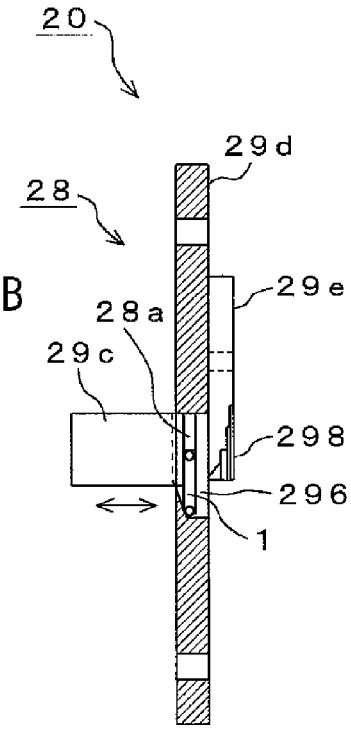
FIG. 7B is a cross-sectional view taken along lines A-A of FIG. 7A.

Further, when the wire rod 1 is pushed out of the wire-rod-pushing-out guide part 27 via the wire-rod-dispatching mechanism 22, the wire rod 1 shown in FIG. 7A advances so as to rotate along an inside of the section #Ø8 like an arc of a circle in the forming adapter 28*a*. At this moment, the wire rod 1 alters its posture to a spiral state by moving along the arc of the circle of the section #Ø8 like the arc of the circle shown in FIG. 7B. An advanced direction of the wire rod 1 at this moment is an almost reverse direction of its insertion direction.

Figure 8A:
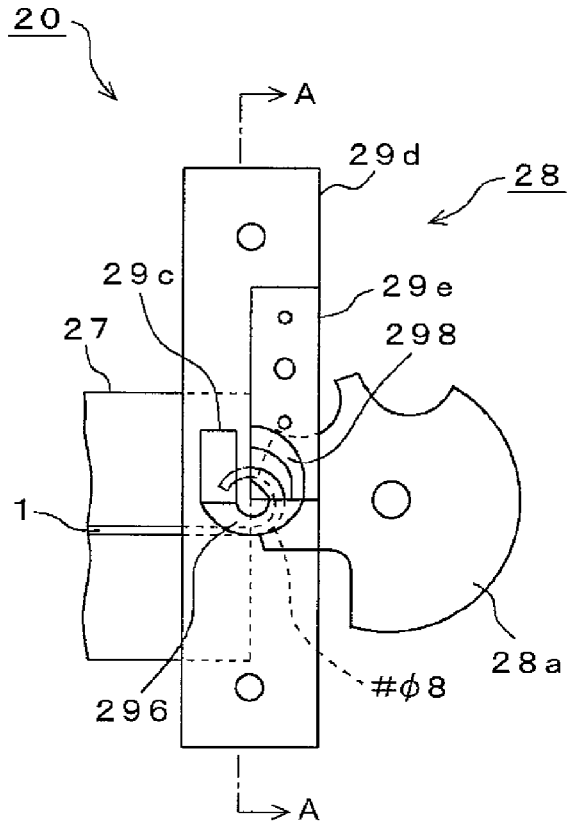
FIG. 8A is a front view showing the pushing-out example (part three) of the wire rod when the coil is formed.
Figure 8B:
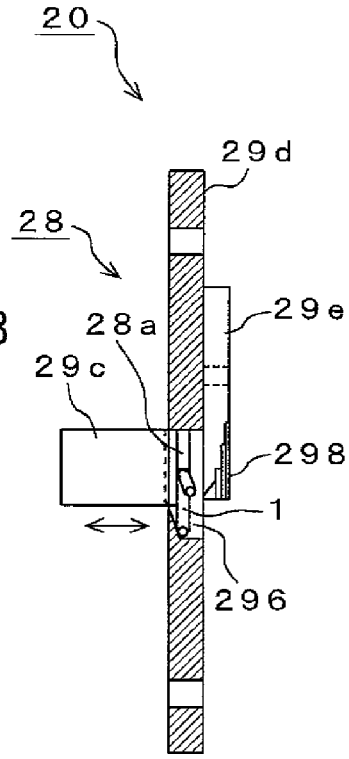
FIG. 8B is a cross-sectional view taken along lines A-A of FIG. 8A.

When the wire rod 1 is further pushed out of the wire-rod-pushing-out guide part 27 via the wire-rod-dispatching mechanism 22, the wire rod 1 shown in FIG. 8A rotates along the inside of the section #Ø8 like an arc of a circle in the forming adapter 28*a*. A forward end portion of the wire rod 1 altered to the spiral state by the section #Ø8 like an arc of a circle is then limited by a forward end of the fine adjustment part 29*c* shown in FIG. 8B to change its advanced direction.

At this moment, the fine adjustment part 29*c* is designed to adjust a discharged position of the spiral coil 11. In this example, a male screw, not shown, for pitch-fine-adjustment-correction, which is screwed to the screw hole 294 of the cover board 29*a*, is adjusted so that a forward end of this male screw pushes out the fine adjustment part 29*c*. The fine adjustment part 29*c* moves inside the hollow portion consisting of the openings and port 293, 203, 273 and 296 shown in FIG. 5. In this example, when the wire rod 1 having a predetermined thickness has a strong tensile strength, the fine adjustment part 29*c* is adjusted so that the pitch of the spiral coil 11 can be corrected so as to be expanded. On the contrary, when the wire rod 1 having a predetermined thickness has a weak tensile strength, the pitch of the spiral coil 11 is corrected so as to be restricted.

This enables the coil pitch to be finely adjusted. Accordingly, it is possible for fine adjustment part 29*c* to correct the pitch of the spiral coil 11*a* or the like adjusted by the pitch-adjusting mechanism 29 in correspondence with the tensile strength of the wire rod 1 having a predetermined thickness.

As the result thereof, it is possible to make fine adjustments of the pitch of the spiral coil 11 (pitch adjustment correction part).

Figure 9A:
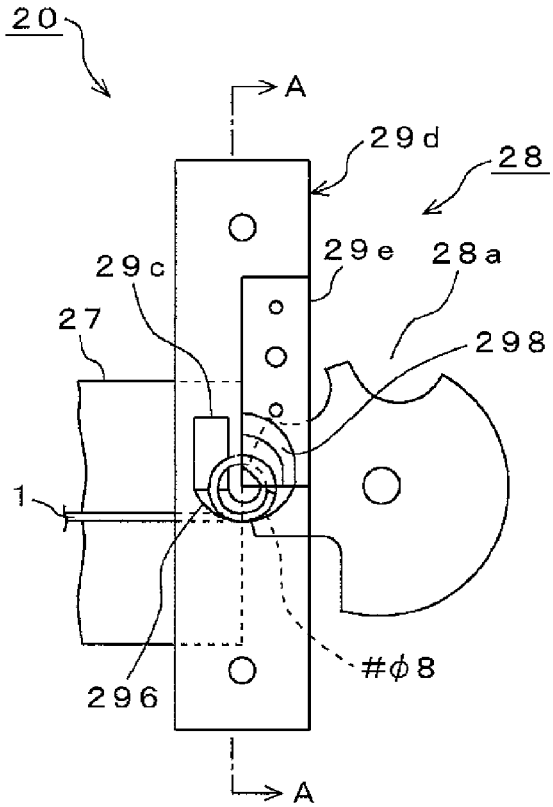
FIG. 9A is a front view showing the pushing-out example (part four) of the wire rod when the coil is formed.
Figure 9B:
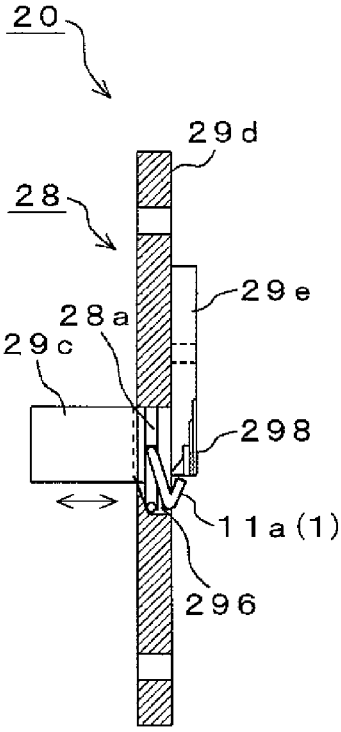
FIG. 9B is a cross-sectional view taken along lines A-A of FIG. 9A.

In the coil-forming mechanism 20, the spiral coil 11*a* is discharged to a direction (hereinafter, referred to as "coil-discharged direction") perpendicular to the advanced direction (the insertion direction) of the wire rod 1. When the wire rod 1 is further pushed out of the wire-rod-pushing-out guide part 27 via the wire-rod-dispatching mechanism 22, the wire rod 1 shown in FIG. 9A is made discharged from the coil-discharging port 296 of the adjustment board 29*d* to the coil-discharged direction while it rotates (along a circle). At this moment, the wire rod 1 altered to the spiral state becomes the spiral coil 11*a*. The forward end thereof moves to the dispatch guide portion 298 of the pitch-adjusting part 29*e* shown in FIG. 9B. At this moment, the spiral coil 11*a* moves along the stepped shape like a quarter of an arc of a circle of the dispatch guide portion 298 for the diameter of the coil of 8 mm.

Figure 10A:
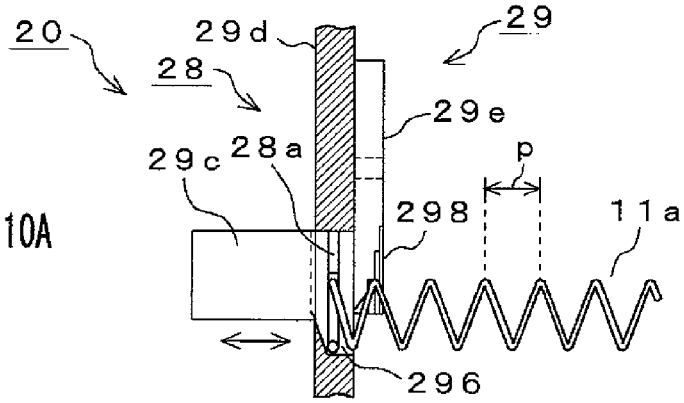
FIG. 10A is a cross-sectional view taken along lines A-A of FIG. 9A for showing the pushing-out example (part five) of the wire rod when forming the coil having a diameter of a coil of 8 mm.
Figure 10B:
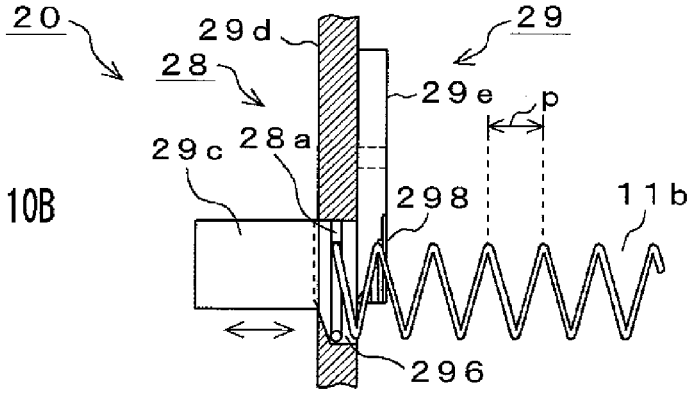
FIG. 10B is a cross-sectional view taken along lines A-A of FIG. 9A for showing the pushing-out example of the wire rod when forming the coil having a diameter of a coil of 11 mm.
Figure 10C:
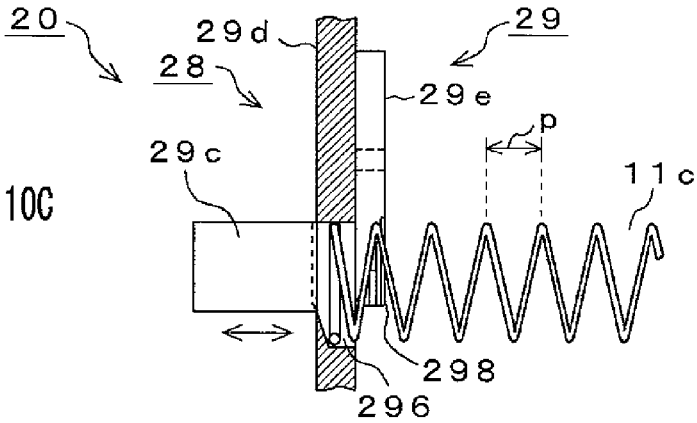
FIG. 10C is a cross-sectional view taken along lines A-A of FIG. 9A for showing the pushing-out example of the wire rod when forming the coil having a diameter of a coil of 14 mm.

This enables the spiral coil 11*a* with the diameter of the coil of 8 mm to be discharged from the coil-discharging port 296 shown in FIG. 10A. It is to be noted that when selecting the section #Ø11 like an arc of a circle in the forming adapter 28*a*, the spiral coil 11*b* moves along the stepped shape like a quarter of an arc of a circle of the dispatch guide portion 298 for the diameter of the coil of 11 mm so that the spiral coil 11*b* having a diameter of the coil of 11 mm can be discharged from the coil-discharging port 296 shown in FIG. 10B. Similarly, when selecting the section #Ø14 like an arc of a circle in the forming adapter 28*a*, the spiral coil 11*c* moves along the stepped shape like a quarter of an arc of a circle of the dispatch guide portion 298 for the diameter of the coil of 14 mm so that the spiral coil 11*c* having a diameter of the coil of 14 mm can be discharged from the coil-discharging port 296 shown in FIG. 10C. This enables the coil pitch to be almost fixed.

Thus, no configuration to wind the wire rod 1 around a core member is taken in the coil-forming mechanism 20 so that it is possible to make a coil-forming configuration simplified as compared with a conventional system. In the pitch-adjusting mechanism 29, the pitch-adjusting part 29*e* is also provided with the dispatch guide portion 298 so that it is possible to dispatch the spiral coil 11 along the dispatch guide portion 298 from the coil-discharging port 296 of the adjustment board 29*d*. It is also possible to form the spiral coil 11*a*, 11*b*, 11*c* or the like, a pitch of which is not changed even if the diameter of the coil is changed, with a good reproducibility. Accordingly, it is possible to provide the paper-sheet-handling apparatus 100 that performs the binding processing with the pitch of the spiral coil 11 corresponding to a pitch (a pitch for bookbinding machinery) of the punched holes in the bundle of paper-sheets 3.

Figure 11:
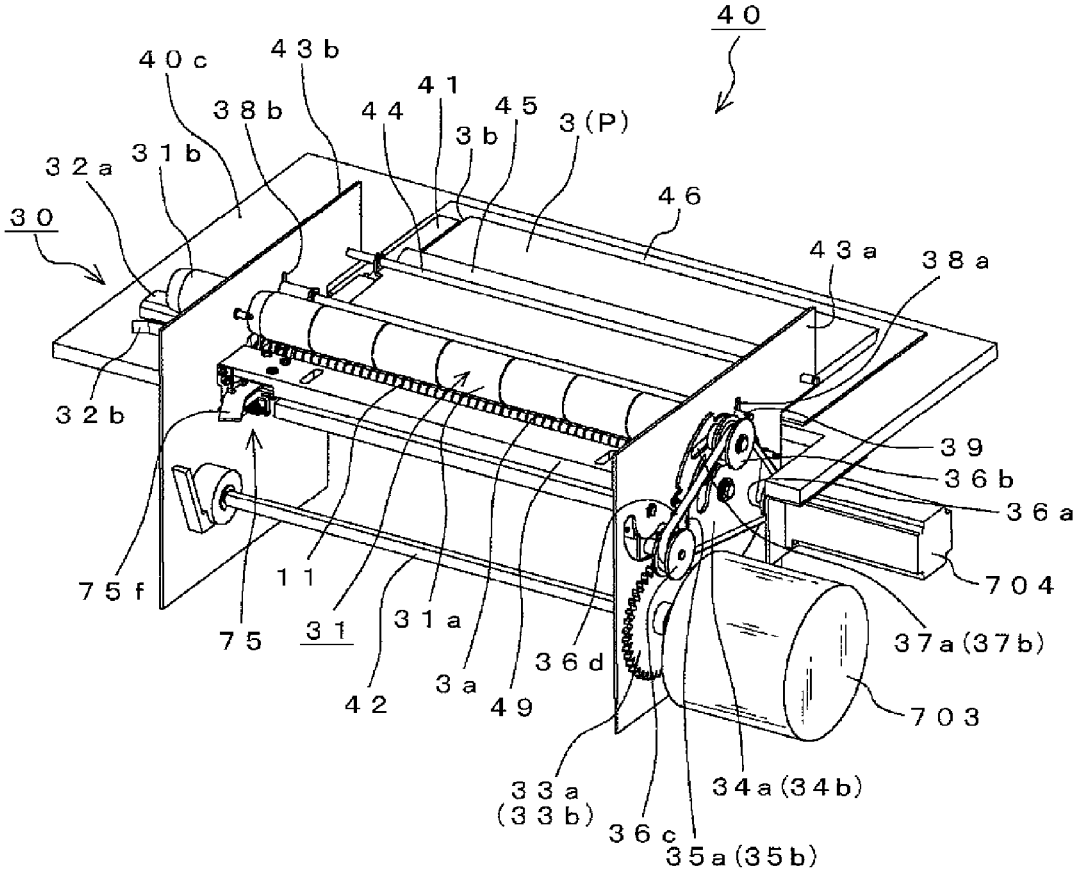
FIG. 11 is a perspective view showing a configuration example of a binding mechanism 40.

The following will describe a configuration example of the binding mechanism 40 with reference to FIG. 11. The binding mechanism 40 shown in FIG. 11 constitutes an example of the binding mechanism and has a function to receive the spiral coil 11 formed by the coil-forming mechanism 20, to guide the spiral coil 11 to the punched holes 3*a* of the bundle of paper-sheets 3 set on the binding mechanism 40 and to pass it therethrough. In order to realize this function, the binding mechanism 40 is provided with a feed roller 31, a main body chassis portion 40*c*, a paper-sheet-aligning guide 41, side surface plates 43*a*, 43*b*, a paper-sheet clamp 45, the paper-sheet-mounting base 46, a paper-sheet-attaching pin 46*d* (see FIG. 16B and FIGS. 19A through 19C), a guide 49 (hereinafter, referred to as "screw guide") for screw adjustment, which is an example of the first screw guide part, the cutting-and-bending mechanism 75 and the motors 703, 704.

An outline of the binding mechanism 40 is such that the main body chassis portion 40*c* is disposed almost horizontally and the side surface plate 43*a* and the side surface plate 43*b* are vertically mounted on this main body chassis portion 40*c* at predetermined positions, for example, a right side for side surface plate 43*a* and a left side for the side surface plate 43*b* with a predetermined space while being opposed to each other. The side surface plate 43*a* and the side surface plate 43*b* have an almost same shape. Between the side surface plate 43*a* and the side surface plate 43*b*, the paper-sheet-aligning guide 41, the paper-sheet clamp 45, the paper-sheet-mounting base 46 and the paper-sheet-attaching pin 46*d* (see FIG. 16B and FIGS. 19A through 19C) are disposed.

It is designed that these paper-sheet-mounting base 46, paper-sheet-aligning guide 41 and paper-sheet-attaching pin 46*d* align a plurality of paper-sheets P each having the punched holes 3*a* respectively to a predetermined position and the paper-sheet clamp 45 clamps the bundle of paper-sheets 3. In this example, the paper-sheet-mounting base 46 has a predetermined thickness and is disposed on the main body chassis portion 40*c* with it being sandwiched between the side surface plates 43*a* and 43*b*.

The paper-sheet-attaching pin 46*d* constitutes an example of a first paper-sheet-aligning part and is mounted on a forward end portion of the screw guide 46*a* of the paper-sheet-mounting base 46 at the fixed side thereof to limit the bundle of paper-sheets 3 mounted on the paper-sheet-mounting base 46 so as to align an end at the punched hole side of each of the paper-sheets P.

The paper-sheet-aligning guide 41 constitutes an example of a second paper-sheet-aligning part and is mounted on one side of the paper-sheet-mounting base 46. In this example, it is assumed that a portion of the paper-sheet P in which the punched holes 3*a* are perforated is a forward end thereof and a portion of the paper-sheet P which is perpendicular to this forward end is a side edge 3*b* thereof. At this moment, the paper-sheet-aligning guide 41 limits the bundle of paper-sheets 3 on the paper-sheet-mounting base 46, which has been limited by the paper-sheet-attaching pin 46*d*, so as to align the side edge 3*b* of each of the paper-sheets P.

The paper-sheet clamp 45 is supported by a supporting rod 44 at a paper-sheet-receiving side thereof and the supporting rod 44 is attached to the side surface plates 43*a*, 43*b*. The paper-sheet clamp 45 is also attached to the side surface plates 43*a*, 43*b* with a linking rod 39 at its paper-sheet-pressing side that is opposed to the paper-sheet-receiving side so that it can move up and down. For example, when the paper-sheet P advances to the paper-sheet-mounting base 46, the paper-sheet clamp 45 moves the linking rod 39 to an upper direction (an anti-vertical direction) with the supporting rod 44 being a rotation axis thereof. The paper-sheet clamp 45 moves the linking rod 39 to a lower direction (a vertical direction) after the paper-sheet advances thereto, thereby clamping the paper-sheet P.

It is to be noted that a multi-puddle rotation member, not shown, may be used for aligning, for example, the forward end and the side end of the paper-sheet P to a reference position when the paper-sheet P advances to the paper-sheet-mounting base 46. Applying such a rotation member enables the paper-sheet P to be forced to move to a rotation direction thereof. Thus, the side edge 3*b* of the paper-sheet P having the punched holes 3*a* is collided with the paper-sheet-aligning guide 41 and the side at the punched holes 3*a* of the paper-sheet P is collided with the paper-sheet-attaching pin 46*d* so that the paper-sheet P can be aligned to the reference position thereof.

In this example, the motor 703 functioning as an example of the driving part is mounted on a predetermined left lower position of the side surface plate 43*a*. To a driving shaft of the motor 703, a gear 33*a* is connected and with the gear 33*a*, a guide-switching cam 34*a* is engaged. With the guide-switching cam 34*a*, an end of the feed roller 31 functioning as an example of a rotation guide part and an end of the screw guide 49 configuring an example of the contact guide part are engaged.

Figure 13:
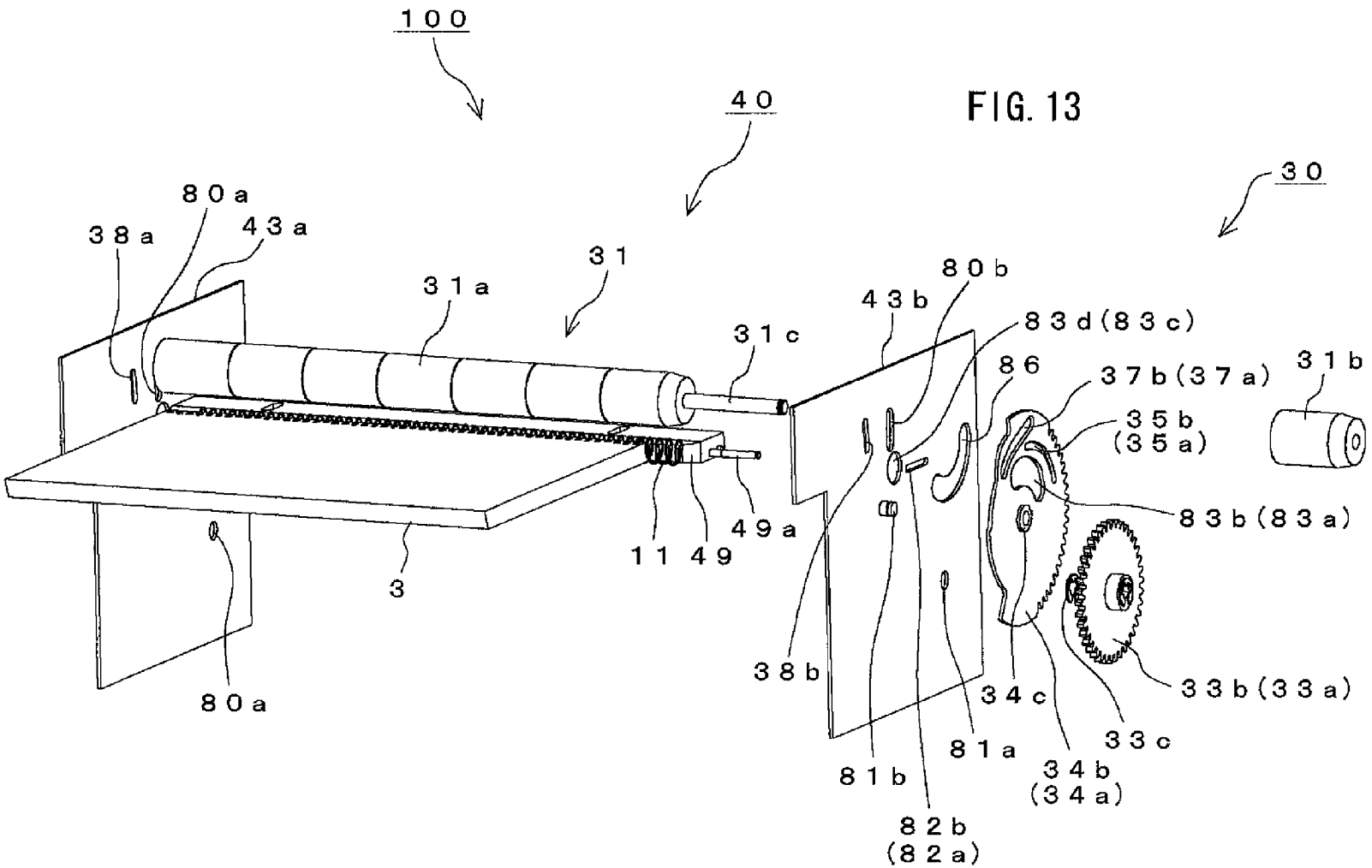
FIG. 13 is an exploded perspective view showing an assembled example of main parts of the binding mechanism 40 at a side of the linking part.

The screw guide 49 has a movement that is limited by curved long cam openings 35*a*, 35*b* provided in the guide-switching cams 34*a*, 34*b* and horizontal long openings 82*a*, 82*b* provided in the side surface plates 43*a*, 43*b* (see FIG. 13). By rotating the guide-switching cams 34*a*, 34*b*, the screw guide 49 has a movement direction that is limited on the horizontal direction thereof by the horizontal long openings 82*a*, 82*b* and moves back and forth along cam surfaces of the curved long cam openings 35*a*, 35*b*.

The feed roller 31 is constituted of a pressing roller 31*a* and a pick-up roller 31*b*. The pressing roller 31*a* is rotatably supported between the side surface plate 43*a* of the right side and the side surface plate 43*b* of the left side. The pressing roller 31*a* is provided along the advanced direction of the spiral coil 11 and is mounted so as to bridge the side surface plates 43*a*, 43*b* of the right and left sides.

The feed roller 31 has a movement that is limited by long cam openings 37*a*, 37*b* provided in the guide-switching cams 34*a*, 34*b* and second vertical long openings 80*a*, 80*b* provided in the side surface plates 43*a*, 43*b* (see FIG. 13). Any force is always applied to the feed roller 31 toward the vertical direction by a belt 36*d* passing around a driven pulley 36*b* attached to a forward end of the feed roller 31. By rotating the guide-switching cams 34*a*, 34*b*, the feed roller 31 moves up and down along cam surfaces of the long cam openings 37*a*, 37*b* while the movement direction thereof is limited by the vertical long openings 80*a*, 80*b* on the vertical direction.

Further, to a shaft core of the gear 33*a*, an end of a rectangular link rod 42 is connected. To the other end of the rectangular link rod 42, a shaft core of the gear 33*b* is connected; and with this gear 33*b*, the guide-switching cam 34*b* is engaged. With the guide-switching cam 34*b*, the other end of the feed roller 31 and the other end of the screw guide 49 are engaged.

In this example, when rotating the motor 703, the guide-switching cams 34*a*, 34*b* rotate through the gears 33*a*, 33*b*. By rotating the guide-switching cams 34*a*, 34*b*, positions of the feed roller 31 and the screw guide 49, both ends of which are engaged with the guide-switching cams 34*a*, 34*b*, are adjusted.

The motor 704 functioning as an example of driving part is mounted onto the side surface plate 43*a* at a predetermined right lower position thereof. To a driving shaft of the motor 704, a pulley 36*a* is connected and the belt 36*d* passes around the pulley 36*a*. This belt 36*d* passes around the driven pulleys 36*b*, 36*c*. To the driven pulley 36*b*, the feed roller 31 is connected. By rotating the motor 704, the pulley 36*a* connected to the driving shaft of the motor 704 rotates so that the belt 36*d* passing around the pulley 36*a* rotates and the driven pulley 36*b* rotates. Thus, the feed roller 31 connected to the driven pulley 36*b* rotates.

The feed roller 31 dispatches the spiral coil 11 to the punched holes 3*a* of the bundle of paper-sheets 3 mounted on the paper-sheet-mounting base 46 with it rotating and guides the spiral coil 11 to the punched holes 3*a* of the bundle of paper-sheets 3. For example, the feed roller 31 is constituted of the cylinder-shaped pressing roller 31*a* and a rotation shaft rod 31*c* and is configured so as to contact the spiral coil 11 to rotate the spiral coil 11 to a fixed direction.

The pressing roller 31*a* constitutes an example of rotation member and is attached to the rotation shaft rod 31*c*. Assuming that a side of the paper-sheet P relating to a portion of the paper-sheet P in which the punched holes 3*a* are provided is a length of the paper-sheet, the pressing roller 31*a* has a length longer than the length of the paper-sheet. It is to be noted that it may have one that is slightly shorter than the length of paper-sheet if it has almost same length as the length of the paper-sheet. The pressing roller 31*a* is disposed with them being sandwiched between the side surface plates 43*a*, 43*b* to guide the spiral coil 11 received from the pick-up roller 31*b* of the linking part 30 to the punched holes 3*a* of the paper-sheet P.

For example, the pressing roller 31*a* comes into contact with a part of an outer circumference of the spiral coil 11 to rotate and guide the spiral coil 11 with it being pressed onto the paper-sheet-mounting base 46. It is to be noted that for the pressing roller 31*a* and the pick-up roller 31*b*, any material having large frictional force with respect to the spiral coil 11 such as silicon rubber and natural rubber is used. These structures and parts enable the binding mechanism 40 to be configured. It is to be noted that the pressing roller 31*a* may be one long rod-like roller or one in which short rollers each partitioned to have a fixed length are arranged in series.

Further, according to the binding mechanism 40 shown in FIG. 11, there is a state where the bundle of paper-sheets 3 is mounted on the paper-sheet-mounting base 46 and the spiral coil 11 is passed through the bundle of paper-sheets 3. In order to reach this state, the paper-sheet clamp 45 first clamps paper-sheets of predetermined numbers. For example, the paper-sheets are received to be mounted on the paper-sheet-mounting base 46 while the linking rod 39 of the paper-sheet clamp 45 that is inserted into the first vertical long openings 38*a*, 38*b* provided in the side surface plates 43*a*, 43*b* is lifted by the cam surfaces of the guide-switching cams 34*a*, 34*b* to the anti-vertical direction, namely, a paper-sheet-pressing side of the paper-sheet clamp 45 is lifted up.

Next, by driving the motor 703 after the paper-sheets of predetermined numbers are mounted thereon, the guide-switching cams 34*a*, 34*b* rotate via the gears 33*a*, 33*b*. The linking rod 39 of the paper-sheet clamp 45 lifted by the cam surfaces of the cams falls down by limiting its movement direction by the vertical long openings 38*a*, 38*b*. Accordingly, the paper-sheet-pressing side of the paper-sheet clamp 45 moves to a vertical direction and the paper-sheet clamp 45 comes into contact with the bundle of paper-sheets 3 at a predetermined position to clamp the bundle of paper-sheets 3 by pressing it on the paper-sheet-mounting base 46 with weight of the paper-sheet clamp 45. It is to be noted that any force of a spring or the like may be acted to the paper-sheet clamp 45 and the bundle of paper-sheets 3 may be pressed by the force applied by the spring in addition to the weight of the paper-sheet clamp 45.

Thus, according to the feed roller 31 and the screw guide 49 shown in FIG. 11, they are configured so as to be adjusted to positions corresponding to the diameter of the spiral coil 11 passing through the bundle of paper-sheets 3. At the adjusted positions, it is configured that the spiral coil 11 is limited on its movement direction and supported by three points of the pressing roller 31*a* of the feed roller 31, the screw guide 49 and the main body chassis portion 40*c*.

It is configured that the binding mechanism 40 is provided with the cutting-and-bending mechanism 75, which has a function of the coil-cutting part, and this cutting-and-bending mechanism 75 cuts the spiral coil 11 of the bundle of paper-sheets 3 on which the binding mechanism 40 performs the binding processing, at a predetermined position thereof.

In this example, the cutting-and-bending mechanism 75 constitutes an example of end-processing means and is mounted on a predetermined position of the binding mechanism 40, for example, near the side surface plate 43*b* and under an end of the screw guide 49. This cutting-and-bending mechanism 75 has a cutting-and-bending function to bend an end of the spiral coil 11 cut at this position.

The cutting-and-bending mechanism 75 has a lever 75*f* and cuts a rear end of the spiral coil 11 by moving this lever 75*f* to a predetermined direction. Under the existing circumstance, a mechanism such that the lever 75*f* is acted by hand is introduced. Of course, the lever 75*f* may be acted by a cam, not shown, or the like. Providing the binding mechanism 40 with such a cutting-and-bending mechanism 75 does not only make a foreign matter difficult to be caught by the end of the spiral coil 11 but also make the cut portion thereof be well attractive.

Figure 12:
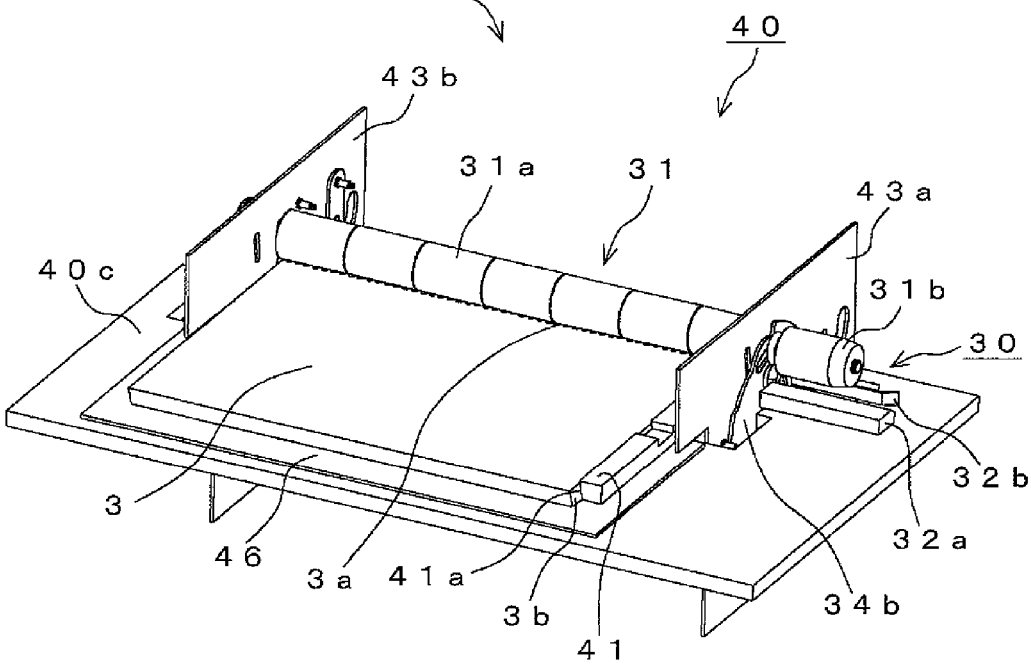
FIG. 12 is a perspective view showing a configuration example of a linking part 30 and its peripheral mechanism.

A description will be given of a configuration example of the linking part 30 and its peripheral mechanism in the paper-sheet-handling apparatus 100 with reference to FIGS. 12 through 15B. The linking part 30 shown in FIG. 12 is a part linking the coil-forming mechanism 20 with the binding mechanism 40 shown in FIG. 1. The linking part 30 is configured to have the pick-up roller 31*b*, an introduction guide section 32*a* and a coil-introducing wall 32*b*. The linking part 30 has a coil-introducing port (opening) 83*d* shown in FIG. 13. The coil-introducing port 83*d* is provided on a side surface of the binding mechanism 40. In this example, the coil-forming mechanism 20 and the binding mechanism 40 are assembled so that a coil-advancing direction of the coil-forming mechanism 20 corresponds to an opening center of the coil-introducing port 83*d* provided on the binding mechanism 40.

The above-mentioned pick-up roller 31*b* is attached to an end of the pressing roller 31*a* of the feed roller 31 in the binding mechanism 40. The pick-up roller 31*b* is configured to rotate to a direction that is identical with that of the pressing roller 31*a* and to move up and down to a direction that is identical with that of the pressing roller 31*a*. For the pick-up roller 31*b*, a roller member having the same quality of material as that of the pressing roller 31*a* of the binding mechanism 40 is used. The pick-up roller 31*b* is also processed so that its end surface is shaped to a truncated cone, which is similar to the pressing roller 31*a* of the binding mechanism 40. In this example, the pick-up roller 31*b*, an external form of which is one size smaller than the pressing roller 31*a* of the binding mechanism 40, is used. This is because the pick-up of the spiral coil 11*a* or the like is facilitated.

The introduction guide section 32*a* and the coil-introducing wall 32*b* are disposed with them being opposed to each other on the main body chassis portion 40*c* under the pick-up roller 31*b*. For the introduction guide section 32*a*, for example, a plastic molding in which an edge thereof that is opposite to the coil-introducing wall 32*b* is planed off is used. For the coil-introducing wall 32*b*, a sheet metal processed item in which an edge thereof that is opposite to the coil-forming mechanism 20 is processed so as to be bent into the shape of an unfolded fan is used. This is because the pick-up of the spiral coil 11*a* or the like is facilitated, which is similar to the pick-up roller 31*b*.

The paper-sheet-aligning guide 41 shown in FIG. 12 is mounted on the paper-sheet-mounting base 46 at a predetermined position by screws or the like. The paper-sheet-aligning guide 41 has a paper-sheet-aligning surface 41*a* with a designated inclination with respect to a surface of the paper-sheet-mounting base 46, on which the paper-sheets P are mounted, and is configured to limit a side end of the bundle of paper-sheets 3 obliquely along the inclination of the paper-sheet-aligning surface 41*a*. Making the paper-sheet-aligning surface 41*a* inclined is because a forward end of the spiral coil 11 faces obliquely and advances in the punched holes 3*a* on a structure of the spiral coil 11 when the spiral coil 11 passes through the punched holes 3*a* of the bundle of paper-sheets 3 with it rotating so that the punched holes 3*a* of the bundle of paper-sheets 3 are aligned in accordance with the inclination when the forward end of the spiral coil 11 advances (see FIG. 24B).

A description will be given of an assembled example of main parts of a side of the linking part 30 of the binding mechanism 40 with reference to FIG. 13. The binding mechanism 40 shown in FIG. 13 shows only the main parts in order to make understanding of parts configuration thereof easy. These main parts are the feed roller 31, the screw guide 49, the side surface plates 43*a*, 43*b*, the guide-switching cam 34*b* and the gear 33*b*. In addition to these main parts, the spiral coil 11 and the bundle of paper-sheets 3 are disposed.

When assembling these main parts, for the side surface plate 43*a*, an end of the rotation shaft rod 31*c* inserted into the pressing roller 31*a* of the feed roller 31 is first inserted into the vertical long opening 80*a* of the side surface plate 43*a* and an end of a shaft rod 49*a* provided on the screw guide 49 is inserted into the horizontal opening 82*a* of the side surface plate 43*a*. Similarly, for the side surface plate 43*b*, the other end of the rotation shaft rod 31*c* of the pressing roller 31*a* is inserted into the vertical long opening 80*b* of the side surface plate 43*b* and the other end of the shaft rod 49*a* provided on the screw guide 49 is inserted into the horizontal opening 82*b* of the side surface plate 43*b*.

Next, for the side surface plate 43*b*, an engaging portion 33*c* of the gear 33*b* is engaged with an hole 81*a* of the side surface plate 43*b* and an engaging portion 34*c* of the guide-switching cam 34*b* is engaged with a projection portion 81*b* of the side surface plate 43*b*. At this moment, the rotation shaft rod 31*c* inserted into the vertical long opening 80*b* is engaged with the cam opening 37*b* of the guide-switching cam 34*b* and the shaft rod 49*a* inserted into the horizontal opening 82*b* is engaged with the curved long cam opening 35*b*. Similarly, for the side surface plate 43*a*, the guide-switching cam 34*a* and the gear 33*a* are engaged. The pressing roller 31*a* of the linking part 30 is then press-fitted and fixed to the rotation shaft rod 31*c* of the feed roller 31.

By rotating the guide-switching cams 34*a*, 34*b* with the gears 33*a*, 33*b* under such an assembly, the feed roller 31 vertically moves corresponding to shapes of the vertical long openings 80*a*, 80*b* and the screw guide 49 horizontally moves corresponding to shapes of the horizontal long openings 82*a*, 82*b*. It is to be noted that with the vertical long openings 38*a*, 38*b*, the linking rod 39 of the paper-sheet clamp 45 shown in FIG. 11 is engaged. With an opening portion 86 of the side surface plate 43*b*, the driven pulley 36*c* shown in FIG. 11 is engaged.

Figure 14A:
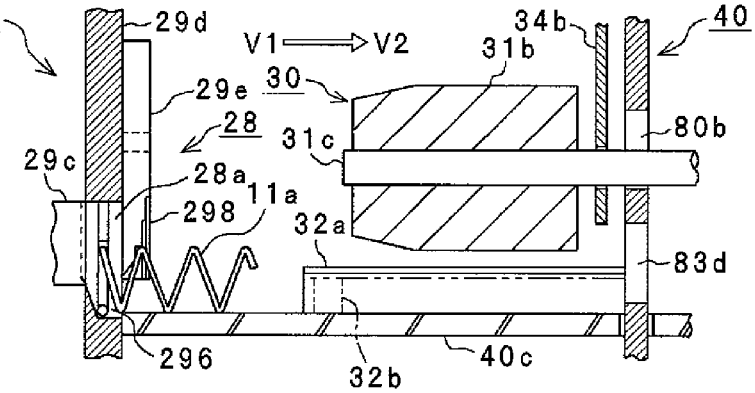
FIG. 14A is a sectional view showing a functional example of the linking part 30 when the coil is advanced.
Figure 14B:
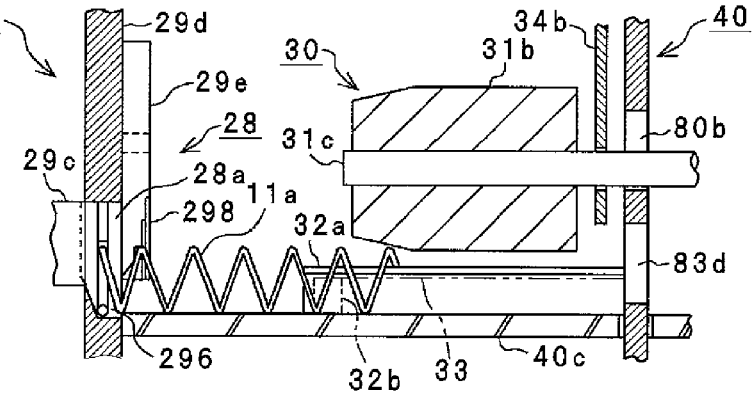
FIG. 14B is a sectional view showing a functional example of the linking part 30 when the coil is limited.
Figure 14C:
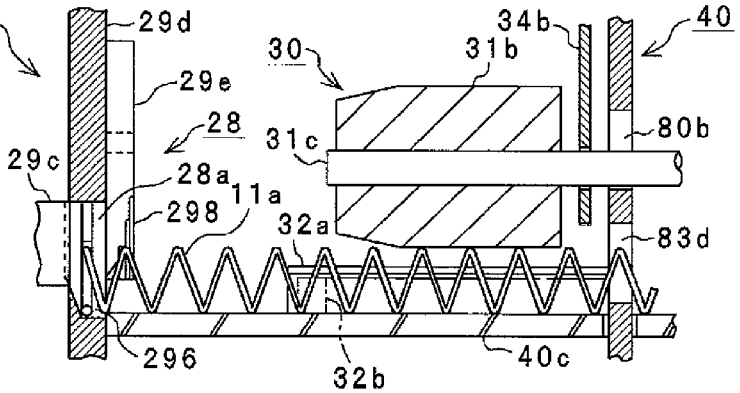
FIG. 14C is a sectional view showing a functional example of the linking part 30 when the coil is derived.

The following will describe a function example of the linking part of the paper-sheet-handling apparatus 100 with reference to FIGS. 14A through 14C. In this example, a case where the spiral coil 11*a* having the diameter of the coil of 8 mm is formed in the coil-forming mechanism 20 is taken. In this case, the binding mechanism 40 sets (makes) the pressing roller 31*a* (fall) to a corresponding position of the diameter of the coil of 8 mm.

The spiral coil 11*a* formed in the coil-forming mechanism 20 shown in FIG. 14A moves to the coil-advancing direction with it rotating clockwise. At this moment, the pick-up roller

31*b* rotates counter-clockwise, which is similar to that of the pressing roller 31*a* of the binding mechanism 40. Assuming that a rotation speed of the spiral coil 11 dispatched from the coil-forming part 28 is V1 and a rotation speed of the spiral coil 11 in the binding mechanism 40 is V2, it is set to V1≤V2. This speed setting is performed so that the spiral coil 11 passes through the punched holes 3*a* of the bundle of paper-sheets 3 smoothly.

When the spiral coil 11*a* formed in the coil-forming mechanism 20 shown in FIG. 14B is further pushed out, the spiral coil 11*a* keeps on moving to the coil-advancing direction with it rotating clockwise. In this example, it is configured that early in the coil introduction, the main body chassis portion 40*c* limits a vibration onto a lower portion of the spiral coil 11*a* and the introduction guide section 32*a* and the coil-introducing wall 32*b* limit a vibration onto right and left of the spiral coil 11*a*. It is configured that a part of the pick-up roller 31*b*, which has a truncated cone shape, limits a vibration onto an upper portion of the spiral coil 11*a* gradually.

When the spiral coil 11*a* formed in the coil-forming mechanism 20 shown in FIG. 14C is further pushed out, the spiral coil 11*a* keeps on moving to the coil-advancing direction with it rotating clockwise. In this example, it is configured that late in the coil introduction, an outer peripheral part of the pick-up roller 31*b*, the introduction guide section 32*a* and the coil-introducing wall 32*b* respectively limit a vibration onto the upper portion of the spiral coil 11*a* and a vibration onto right and left thereof. Under this limited condition, the forward end of the spiral coil 11*a* is inserted into an opening on a side surface of the binding mechanism 40.

A description will be given of a function example of the linking part 30 of the paper-sheet-handling apparatus 100 for other diameters of the coils with reference to FIGS. 15A and 15B.

Figure 15A:
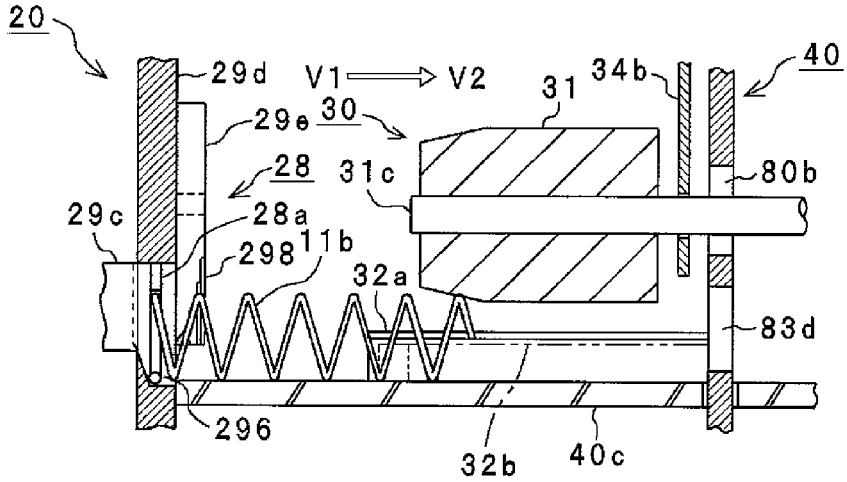
FIG. 15A is a sectional view showing a functional example of the linking part 30 in relation to a case where the diameter of the coil is 11 mm.

According to the linking part 30 shown in FIG. 15A, a case where the spiral coil 11*b* having a diameter of the coil of 11 mm is formed in the coil-forming mechanism 20 is illustrated. In this case, the binding mechanism 40 sets the pressing roller 31*a* to a corresponding position of the diameter of the coil of 11 mm. In this example, it is also configured that early in the coil introduction, the main body chassis portion 40*c* limits a vibration onto a lower portion of the spiral coil 11*b* and the introduction guide section 32*a* and the coil-introducing wall 32*b* limit a vibration onto right and left of the spiral coil 11*b*. It is configured that late in the coil introduction, an outer peripheral part of the pick-up roller 31*b*, the introduction guide section 32*a* and the coil-introducing wall 32*b* respectively limit upward and downward or right and left vibrations on the spiral coil 11*b*.

Figure 15B:
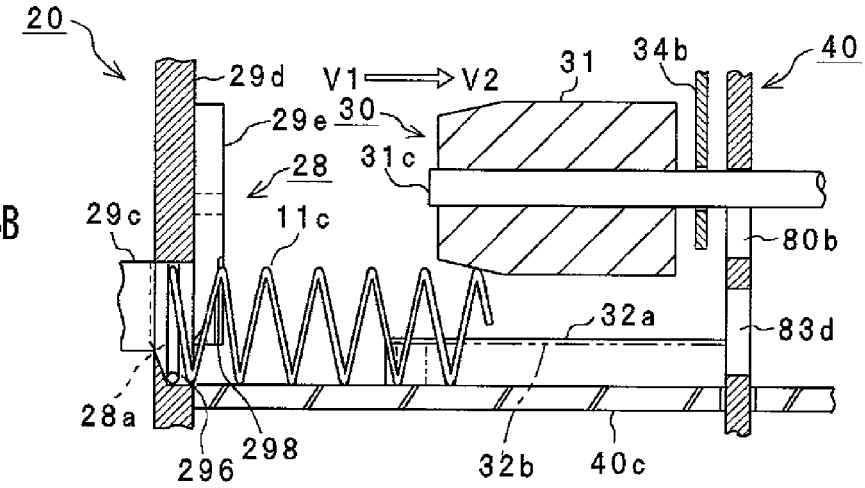
FIG. 15B is a sectional view showing a functional example of the linking part 30 in relation to a case where the diameter of the coil is 14 mm.

According to the linking part 30 shown in FIG. 15B, a case where the spiral coil 11*c* having a diameter of the coil of 14 mm is formed in the coil-forming mechanism 20 is illustrated. In this case, the binding mechanism 40 sets the pressing roller 31*a* to a corresponding position of the diameter of the coil of 14 mm. In this example, it is also configured that early in the coil introduction, the main body chassis portion 40*c* limits a vibration onto a lower portion of the spiral coil 11*c* and the introduction guide section 32*a* and the coil-introducing wall 32*b* limit a vibration onto right and left of the spiral coil 11*c*. It is configured that late in the coil introduction, an outer peripheral part of the pick-up roller 31*b*, the introduction guide section 32*a* and the coil-introducing wall 32*b* respectively limit upward and downward or right and left vibrations on the spiral coil 11*c*.

Thus, it is configured that the linking part 30 is provided between the coil-forming mechanism 20 and the binding mechanism 40 and the spiral coil 11*a* or the like having a predetermined diameter of the coil dispatched from the coil-forming mechanism 20 is guided to the opening of the binding mechanism 40 with its upward and downward and/or right and left movements being gradually limited corresponding to its configuration.

In this example, it is designed that the forward end of the spiral coil 11*a* or the like is picked up by the pick-up roller 31*b*, the introduction guide section 32*a* and the coil-introducing wall 32*b*. Accordingly, even if there is the spiral coil 11*c* (having a large diameter), the spiral coil 11*b* (having a middle diameter) or the spiral coil 11*a* (having a small diameter), having different diameters of the coils, each of which is selected based on the thickness of the bundle of paper-sheets 3 and formed, it is possible to introduce the spiral coil 11*a*, 11*b* or 11*c* having a desired diameter of the coil, which is dispatched from the coil-forming mechanism 20, to the binding mechanism 40 with a good reproducibility.

Figure 16A:
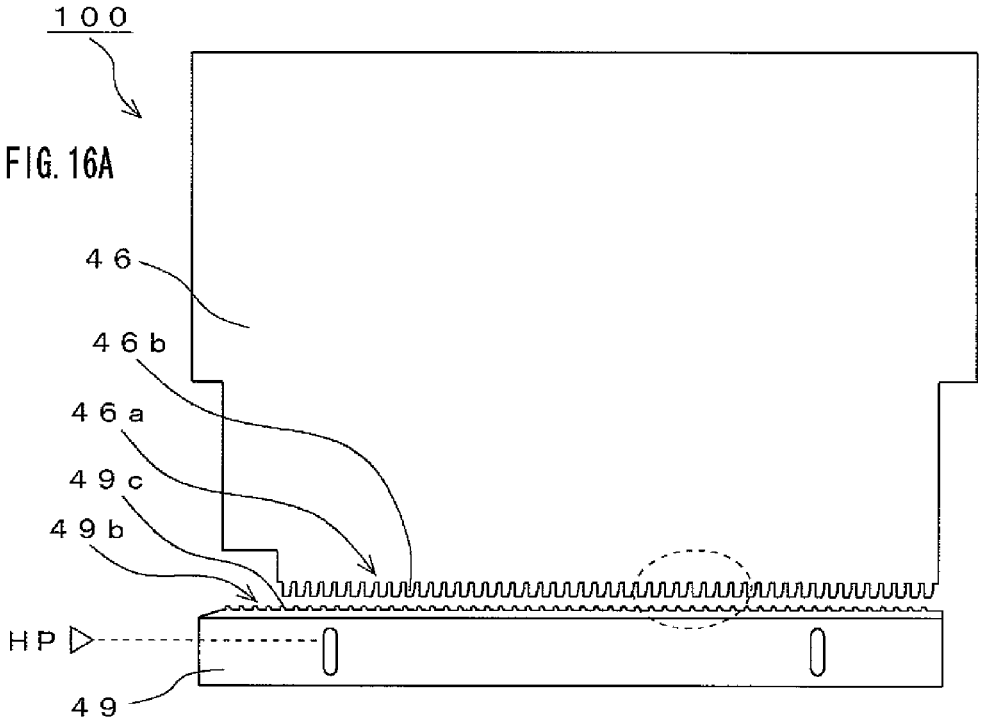
FIG. 16A is a diagram showing a configuration example of convex teeth 46*b* of a screw guide 46*a*.
Figure 16B:
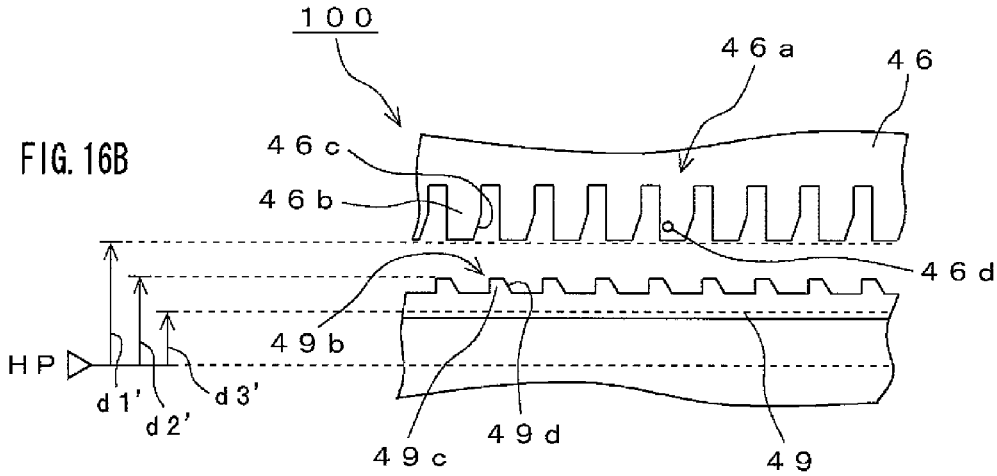
FIG. 16B is a top view showing a configuration example of a guide projection portion 49*b* of a screw guide 49.

The following will describe a configuration example of convex teeth 46*b* of a screw guide 46*a* (fixed side) and a guide projection portion 49*b*, which is an example of a guide projection section, of the screw guide 49 with reference to FIGS. 16A and 16B. It is configured that the screw guide 46*a* shown in FIG. 16A constitutes a function of a second screw guide part and is provided on a side of the paper-sheet-mounting base 46 on the main body chassis portion 40*c* (see FIG. 12), so that this side is processed to become like comb-teeth. This screw guide 46*a* has plural convex teeth 46*b* and forms the comb-teeth shape along a width-direction of the bundle of paper-sheets 3. Each of the convex teeth 46*b* is disposed so as to fit an opening pitch of the 49 punched holes 3*a* in the bundle of paper-sheets 3. The screw guide 46*a* limits a left side of each of the plural kinds of the spiral coils 11 along their advanced directions. It is to be noted that the convex teeth 46*b* forming like the comb-teeth are processed so as to be inclined for adjustment of the advanced direction thereof in order to guide the forward end of the spiral coil 11 smoothly. This enables the spiral coil 11 to be smoothly guided.

In this example, a coil (spiral) pitch of the spiral coil 11 is formed so as to fit the opening pitch of the punched holes 3*a*. The spiral coil 11 advances by one pitch for every turn. The one pitch of the spiral coil 11 is around 6 mm regardless of the diameter of the coil. This is because the opening pitch of the punched holes 3*a* is fixed regardless of the diameter of the coil. Therefore, it is configured that the bundle of paper-sheets 3 is aligned obliquely and the inclination thereof is made fixed without being influenced by the thickness of the paper. In other words, it is configured so as to align the punched holes 3*a* obliquely.

The screw guide 49 is movably attached to a position that faces the screw guide 46*a* of the paper-sheet-mounting base 46 and adjusts the advanced direction of the spiral coil 11 in accordance with the plural diameters of the coils. In this example, it is configured that the screw guide 49 limits a right side of the spiral coil 11 along the advanced direction thereof with its wall. The screw guide 49 has the guide projection portion 49*b* that forms short comb-teeth along a width direction of the bundle of paper-sheets 3, which is similar to the screw guide 46*a*.

The guide projection portion 49*b* is provided at portions of the screw guide 49 with which the spiral coil 11 comes in to contact. The guide projection portion 49*b* has plural projections 49*c* corresponding to the coil pitch of the spiral coil 11 and guides the spiral coil 11 with it contacting between the projection 49*c* and the projection 49*c*. In this example, an inclination process for adjustment of the advanced direction is performed in order to guide the forward end of the spiral coil 11 smoothly. For the screw guide 49, a piece of metal that has predetermined length and thickness and is processed to become the short comb-teeth is used.

In this example, the screw guide 49 is designed to have a thickness thicker than that of the screw guide 46*a* in order to make a wall surface at a right side along the advanced direction of the spiral coil 11. For example, the thickness of the screw guide 49 is set so as to be two through seven times as thick as the thickness of the screw guide 46*a*. The screw guide 49 moves right or left corresponding to the coil diameter of the spiral coil 11. Home position HP is prescribed in the screw guide 49 which is configured to change its position from the home position HP corresponding to the diameter of the coil. In this example, it changes its position to three stages (three postures) corresponding to the diameters of the coils of 8 mm, 11 mm and 14 mm.

This enables the spiral coil 11 to be supported by three points of the pressing roller 31*a*, the screw guide 46*a* and the screw guide 49. The pressing roller 31*a* operates to rotate the spiral coil 11, to allow the coil to be moved through the punched holes of the bundle of paper-sheets 3 so that it sews the bundle of paper-sheets 3 and to dispatch it from one end of the bundle of paper-sheets to the other end thereof (on the width direction thereof). As a result of this operation, it is made possible to perform the binding processing on the bundle of paper-sheets 3 by the spiral coils 11 having plural diameters of the coils with stability.

FIG. 16B is an enlarged view showing a configuration example of the screw guide 46*a* (fixed side) and the guide projection portion 49*b*, which stay in a circle shown by dashed line shown in FIG. 16A. The convex-teeth 46*b* shown in FIG. 16B are formed as a board shape having cut-away portions 46*c*. These cut-away portions 46*c* are provided along the advanced direction of the spiral coil 11. This is because the spiral coil 11 is prevented from being contacted with the convex-teeth 46*b* when the spiral coil 11 enters into the screw guide 46*a*.

The projections 49*c* of the guide projection portion 49*b* are formed so that each of them has a sectional trapezoidal shape including an inclined section 49*d*. This inclined section 49*d* is provided along the advanced direction of the spiral coil 11. This is because the spiral coil 11 is prevented from being contacted with the projections 49*c* when the spiral coil 11 enters into the guide projection portion 49*b*.

Although for the screw guide 46*a* (fixed side), the all-in-one parts in which an end of the paper-sheet-mounting base 46 having predetermined size and thickness is processed so as to become the comb-teeth has been described in this example, it is not limited thereto. For example, a single part processed so as to become the comb-teeth separately from the main body chassis 40*c* and combined therewith may be used. As one example, a part in which a plurality of partitioned boards each having a set length, a side of which is processed so as to become short comb-teeth, is arranged in series may be used.

For example, when setting a position of the spiral coil 11*a* having a small diameter, the screw guide 49 moves from the home position HP to a direction in which it comes close to the punched holes 3*a* of the bundle of paper-sheets 3 by a first distance d1'. When setting a position of the spiral coil 11*b* having a middle diameter, the screw guide 49 similarly moves to a direction of the punched holes 3*a* of the bundle of paper-sheets 3 by a second distance d2'. When setting a position of the spiral coil 11*c* having a large diameter, the screw guide 49 similarly moves to a direction of the punched holes 3*a* of the bundle of paper-sheets 3 by a first distance d3' (d1'>d2'>d3'). This enables the binding mechanism 40 to adjust the position of the screw guide 49 after the clamping.

The following will describe a supporting example of the spiral coil 11*b* with reference to FIGS. 17A through 19C. It is configured that the spiral coil 11*b* having middle diameter shown in FIG. 17A passes through the punched holes 3*a* of the bundle of paper-sheets 3 and is supported by three points of the pressing roller 31*a*, the screw guide 49 and the main body chassis portion 40*c*.

Figure 17A:
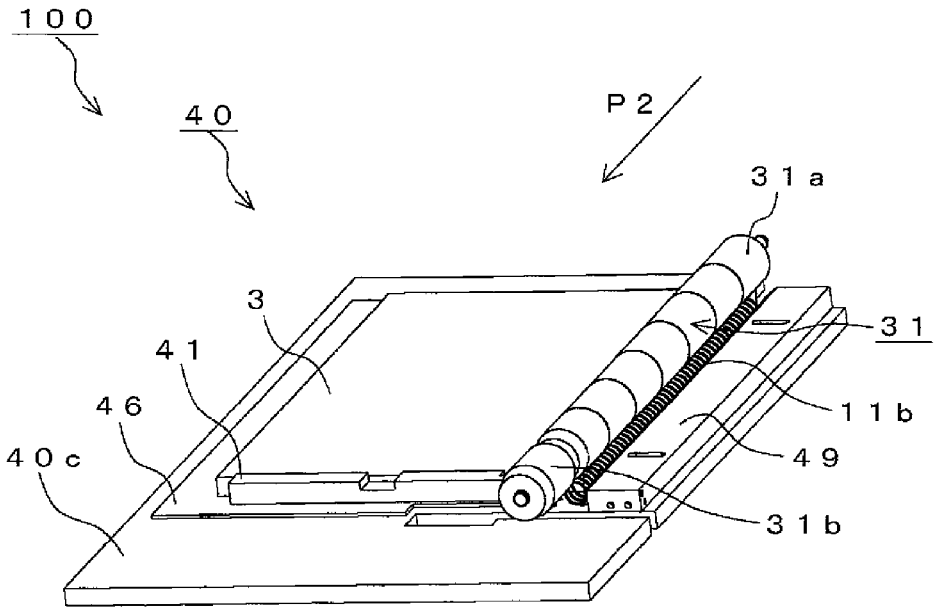
FIG. 17A is a perspective view showing a supporting example of a spiral coil 11*b* having a middle diameter.
Figure 17B:
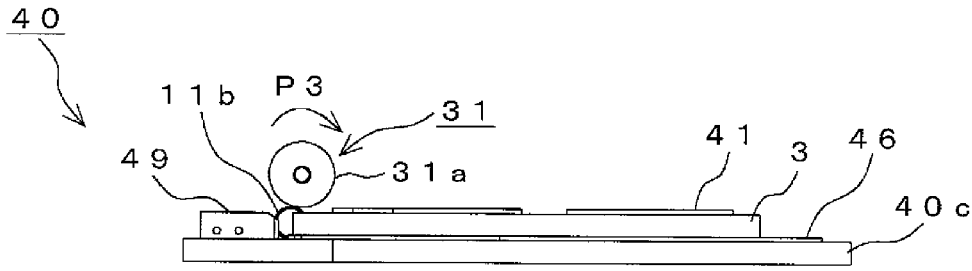
FIG. 17B is a front view showing a configuration example of the spiral coil 11*b* shown in FIG. 17A as indicated from a direction of an arrow P2.

FIG. 17B is a configuration view showing a supporting example of the spiral coil 11*b* shown in FIG. 17A as seen from a direction of an arrow P2. The spiral coil 11*b* shown in FIG. 17B comes into contact with the pressing roller 31*a* of the feed roller 31 on its upper end portion, the lower end portion of the spiral coil 11*b* is supported by the main body chassis 40*c* and the forward end of the spiral coil 11*b* is supported by the screw guide 49.

By rotating the feed roller 31 to a direction of an arrow P3, the spiral coil 11*b* with which the pressing roller 31 of the feed roller 31 comes into contact rotates to a direction opposite to the direction of the arrow P3 with it being supported by the screw guide 49 and the main body chassis 40*c* and advances toward the posterior punched holes 3*a*. The spiral coil 11*b* passes through all of the punched holes 3*a* of the bundle of paper-sheets 3 mounted on the paper-sheet-mounting base 46 of the main body chassis portion 40*c*. Although the supporting example of the spiral coil 11*b* having the middle diameter has been described in this example, the spiral coils 11*a*, 11*c* having small and large diameters are also supported similarly.

A description will be given of clearance examples between the spiral coil 11*c* having the large diameter and each of the punched holes 3*a* of the bundle of paper-sheets 3 with reference to FIG. 18.

Figure 18:
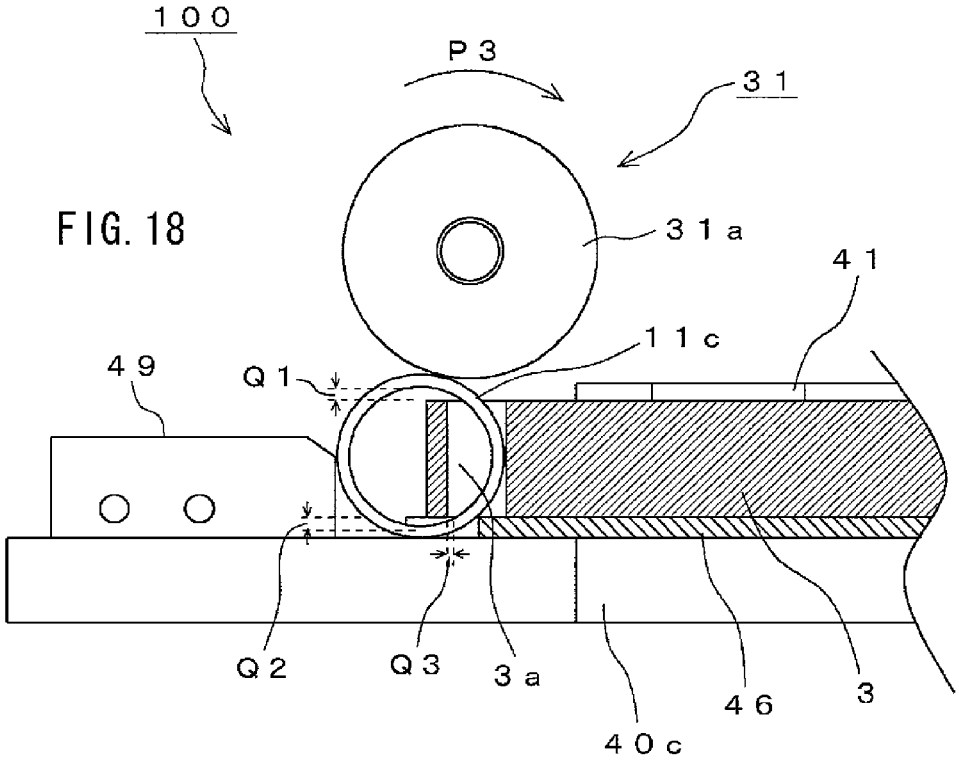
FIG. 18 is an explanation view showing an example of a clearance between a spiral coil 11*c* having a large diameter and a punched hole 3*a* of a bundle of paper-sheets 3.

According to the supporting example of the spiral coil 11*c* having the large diameter shown in FIG. 18, there shows a state in which it passes through the punched holes 3*a* of the bundle of paper-sheets 3 of around 71 through 100 sheets. In this state, it is assumed that a space between an upper end portion of the bundle of paper-sheets 3 and an upper end portion of an inside diameter of the spiral coil 11*c* is a clearance Q1 and a space between a lower end portion of the bundle of paper-sheets 3 and a lower end portion of the inside diameter of the spiral coil 11*c* is a clearance Q2. Further, a space between an outer circumference of an opening of each of the punched holes 3*a* of the bundle of paper-sheets 3 and the spiral coil 11*c* is assumed at a clearance Q3.

In this example, it is most difficult to keep the clearances Q1 through Q3 when the spiral coil 11*c* having the large diameter passes through the punched holes 3*a* of the bundle of paper-sheets 3 of around 71 through 100 sheets. It is configured that the clearances Q1 through Q3 can be kept at this moment, such that the spiral coil 11*c* can pass through the punched holes 3*a* of the bundle of paper-sheets 3 even if any variations of paper alignment, a common difference in a part plan, forming variations when forming the coil and the like are added.

The spiral coil 11*c* having the large diameter, in which it is most difficult to keep the clearances Q1 through Q3, can pass through the punched holes 3*a* so that the spiral coils 11*a*, 11*b* having middle and small diameters also can pass through the punched holes 3*a*. It is to be noted that a thickness of the paper-sheet-mounting base 46 is designed so as to keep the clearances Q1, Q2 having same extent. In this example, the thickness of the paper-sheet-mounting base 46 is about 2 mm.

A description will be given of supporting examples of the spiral coils 11*a* through 11*c* with reference to FIGS. 19A through 19C. It indicates functions of the paper-sheet-mounting base 46 and the coil-supporting part (the screw guide 46*a* and projections 49*c*) in the screw guide 49 shown in the figures. The bundle of paper-sheets 3 constituted of paper-sheets of 40 sheets or less is mounted on the paper-sheet-mounting base 46 shown in FIG. 19A. The spiral coil 11*a* having the small diameter passes through the punched holes 3*a* of this bundle of paper-sheets 3.

Thus, in order to pass the spiral coil 11*a* through each of the punched holes 3*a*, the screw guide 49 and the feed roller 31 shown in FIG. 18 are first disposed at predetermined positions thereof. For example, the screw guide 49 is disposed on the position (the distance d1' shown in FIG. 16B) in which it comes into contact with the spiral coil 11*a*. It is to be noted that the position of the paper-sheet-mounting base 46 is fixed.

The feed roller 31 next dispatches the spiral coil 11*a* with it rotating into the punched holes 3*a* of the bundle of paper-sheets 3 mounted on the paper-sheet-mounting base 46. The dispatched spiral coil 11*a* passes through between the projections 49*c* of the guide projection portion 49*b* of the screw guide 49. At this moment, the spiral coil 11*a* is guided by each projection 49*c* of the guide projection portion 49*b* so that it passes through between the convex teeth 46*b* of the screw guide 46*a* (fixed side) of the paper-sheet-mounting base 46, thereby limiting its advanced direction.

It is configured that the spiral coil 11*a* then passes through between the convex teeth 46*b* of the screw guide 46*a* and is inserted into the punched holes 3*a*. It is configured that after the insertion into the punched holes 3*a*, the spiral coil 11*a* is again guided by the guide projection portion 49*b* so that it passes through between the convex teeth 46*b* of the screw guide 46*a*, thereby limiting its advanced direction, and passes through between the convex teeth 46*b* so as to insert into the punched holes 3*a*. This enables the spiral coil 11*a* to pass through each punched hole 3*a* of the bundle of paper-sheets 3 certainly.

Figure 19A:
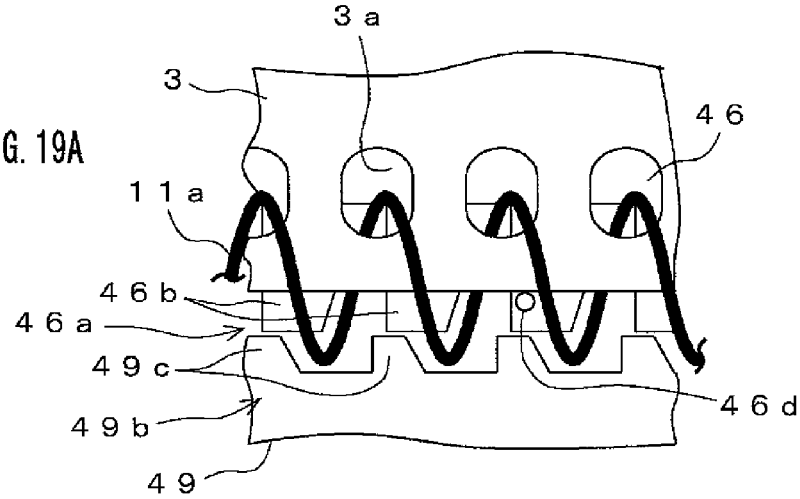
FIG. 19A is a top view showing a supporting example of a spiral coil 11*a* having a small diameter.
Figure 19B:
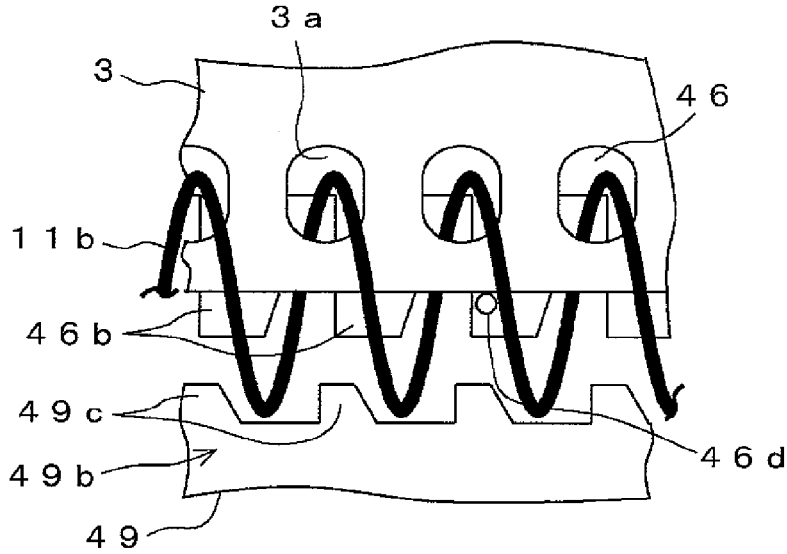
FIG. 19B is a top view showing a supporting example of the spiral coil 11*b* having the middle diameter.

The bundle of paper-sheets 3 constituted of paper-sheets of 41 through 70 sheets is mounted on the paper-sheet-mounting base 46 shown in FIG. 19B and the spiral coil 11*b* having the middle diameter passes through each of the punched holes 3*a* of this bundle of paper-sheets 3.

Thus, in order to pass the spiral coil 11*b* through each of the punched holes 3*a*, the screw guide 49 and the feed roller 31 shown in FIG. 18 are first disposed at predetermined positions thereof. For example, the position of the screw guide 49 is disposed on the position (the distance d2' shown in FIG. 16B) in which it comes into contact with the spiral coil 11*b*. In this case, a space between the projection 49*c* of the screw guide 49 and the convex teeth 46*b* of the paper-sheet-mounting base 46 is made broader than the space shown in FIG. 19A.

The feed roller 31 next dispatches the spiral coil 11*b* with it rotating into the punched holes 3*a* of the bundle of paper-sheets 3 mounted on the paper-sheet-mounting base 46. The dispatched spiral coil 11*b* passes through between the projections 49*c* of the guide projection portion 49*b* of the screw guide 49. At this moment, the spiral coil 11*b* is limited by the guide projection portion 49*b* on its advanced direction so that it passes through between the convex teeth 46*b* of the screw guide 46*a* (fixed side) of the paper-sheet-mounting base 46.

It is configured that the spiral coil 11*b* then passes through between the convex teeth 46*b* of the screw guide 46*a* and passes through the punched holes 3*a*. It is configured that after the passage through the punched holes 3*a*, the spiral coil 11*b* is again limited by the guide projection portion 49*b* on its advanced direction so that it passes through between the convex teeth 46*b* of the screw guide 46*a* and passes through between the convex teeth 46*b* so as to pass through the punched holes 3*a*. This enables the spiral coil 11*b* having the middle diameter to pass through each punched hole 3*a* of the bundle of paper-sheets 3 securely.

Figure 19C:
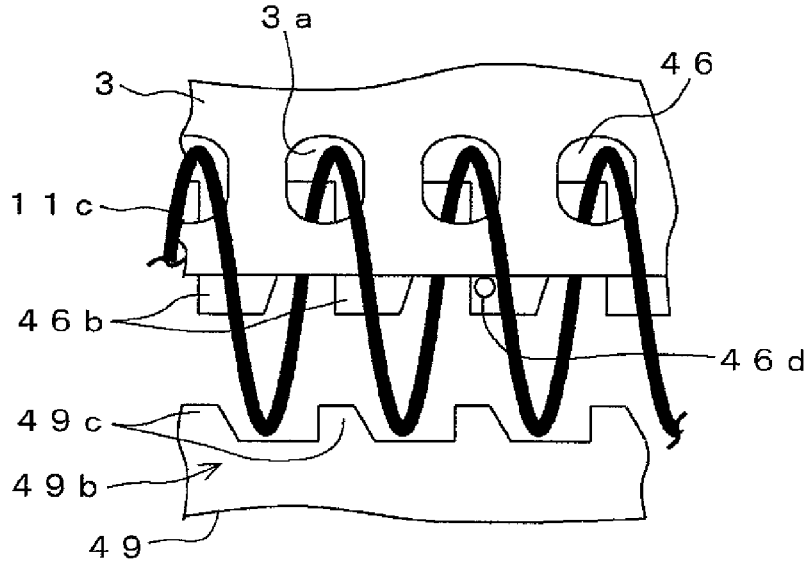
FIG. 19C is a top view showing a supporting example of the spiral coil 11*c* having the large diameter.

The bundle of paper-sheets 3 constituted of paper-sheets of 71 through 100 sheets is mounted on the paper-sheet-mounting base 46 shown in FIG. 19C and the spiral coil 11*c* having the large diameter passes through each of the punched holes 3*a* of this bundle of paper-sheets 3.

Thus, in order to pass the spiral coil 11*c* through each of the punched holes 3*a*, the screw guide 49 and the feed roller 31 are first disposed at predetermined positions thereof. For example, the position of the screw guide 49 is disposed on the position (the distance d3' shown in FIG. 16B) in which it comes into contact with the spiral coil 11*c*. In this case, a space between the projection 49*c* of the screw guide 49 and the convex teeth 46*b* of the paper-sheet-mounting base 46 is made broader than the spaces shown in FIGS. 19A and 19B.

The feed roller 31 next dispatches the spiral coil 11*b* with it rotating into the punched holes 3*a* of the bundle of paper-sheets 3 mounted on the paper-sheet-mounting base 46. The dispatched spiral coil 11*b* passes through between the projections 49*c* of the guide projection portion 49*b* of the screw guide 49. At this moment, the spiral coil 11*c* is limited by the guide projection portion 49*b* on its advanced direction so that it passes through between the convex teeth 46*b* of the screw guide 46*a* of the paper-sheet-mounting base 46.

It is configured that the spiral coil 11*c* then passes through between the convex teeth 46*b* of the screw guide 46*a* and passes through the punched holes 3*a*. It is configured that after the passage through the punched holes 3*a*, the spiral coil 11*c* is again limited by the guide projection portion 49*b* on its advanced direction so that it passes through between the convex teeth 46*b* of the screw guide 46*a* and passes through between the convex teeth 46*b* so as to pass through the punched holes 3*a*. This enables the spiral coil 11*c* having the large diameter to pass through each punched hole 3*a* of the bundle of paper-sheets 3 securely.

The following will describe operation examples of the binding mechanism 40 when setting the position corresponding to the diameter of the coil with reference to FIGS. 20 through 23. The binding mechanism 40 shown in FIGS. 20 through 23 is the binding mechanism 40 shown in FIG. 12 seen from a side thereof.

In this example, the description will be performed dividing it into four examples such as a feed-roller-stand-by example, a small-diameter-coil-position-setting example, a middle-diameter-coil-position-setting example and a large-diameter-coil-position-setting example.

In this example, the feed roller 31 obliquely moves up and down corresponding to the diameter of the coil. It is configured that the feed roller 31 stands by at the home position HP thereof and changes its position from the home position HP corresponding to the diameters of the coils. The feed roller 31 changes its position to three stages corresponding to the diameters of the coils of 8 mm, 11 mm and 14 mm. The feed roller 31 is driven so that it presses the spiral coil 11 from an oblique direction to the screw guide 49.

A description will be given of an operation example of the binding mechanism 40 in case of stand-by time with reference to FIG. 20. In this example, a description will be given of operation example of only the guide-switching cam 34*b*, the gear 33*b* and their related parts on the side surface plate 43*b*. It is to be noted that a description of operation example of the guide-switching cam 34*a*, the gear 33*a* and their related parts on the side surface plate 43*a* will be omitted because they perform functions similar to those of parts on the side surface plate 43*b*.

Figure 20:
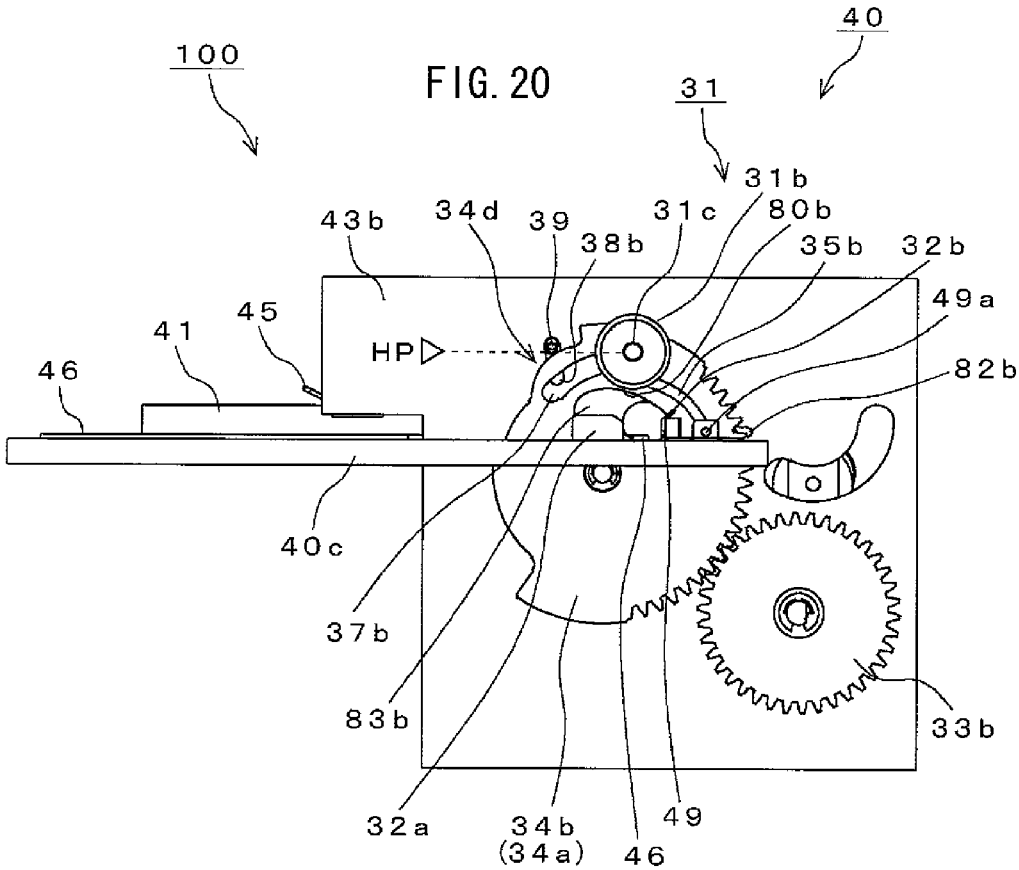
FIG. 20 is a side view showing an operation example of the binding mechanism 40 at a period of stand-by time.

According to the binding mechanism 40 shown in FIG. 20, a state is such that the feed roller 31, the screw guide 49 and the paper-sheet clamp 45 stand by and the feed roller 31 and the paper-sheet clamp 45 stay at their uppermost position. Hereinafter, this state is referred to as a stand-by state of the binding mechanism 40. It is because maximum number of paper-sheets to be bound can be received to provide such a stand-by state thereof. In order to move to this stand-by state, the motor 703 shown in FIG. 1 rotates the gear 33*b* by a predetermined extent clockwise with respect to a surface of figure. By this rotation of the gear 33*b*, the guide-switching cam 34*b* meshed with the gear 33*b* rotates counter-clockwise. By the rotation of this guide-switching cam 34*b* and the respective openings or holes perforated in the side surface plate 43*b*, the positions of the feed roller 31, the screw guide 49 and the paper-sheet clamp 45 are fixed at the same time.

For example, the feed roller 31 moves up and down along the cam surface of the long cam opening 37*b* with its movement direction being limited vertically by the vertical long opening 80*b*. In order to set this feed roller 31 to the stand-by state thereof, it is set so that the feed roller 31 is positioned at an end of the long cam opening 37*b*. Thus, the feed roller 31 is lifted up by the cam surface of the long cam opening 37*b* so that it is positioned at the uppermost of the vertical long opening 80*b*.

The screw guide 49 moves right and left along the cam surface of the curved long cam opening 35*b* with a movement direction of the shaft rod 49*a* of the screw guide 49 being limited horizontally by the horizontal long opening 80*b*. In this example, the screw guide 49 is positioned at an end side of the curved long cam opening 35*b* and is positioned at a right side of the horizontal long opening 82*b* with respect to the surface of the figure.

The linking rod 39 of the paper-sheet clamp 45 moves up and down along an outer circumferential cam surface 34*d* of the guide-switching cam 34*b* with a movement direction of the paper-sheet clamp 45 being limited on an almost vertical direction by the vertical long opening 38*b*. In order to set this paper-sheet clamp 45 to the stand-by state thereof, it is set so that the linking rod 39 of the paper-sheet clamp 45 is lifted up by the outer circumferential cam surface 34*d* and the paper-sheet clamp 45 is positioned at the uppermost of the vertical long opening 38*b*. This enables the positions of the feed roller 31, the screw guide 49 and the paper-sheet clamp 45 to be set in their stand-by state.

A description will be given of an operation example of the binding mechanism 40 when setting a position of the spiral coil 11*a* having the small diameter with reference to FIG. 21. In this example, the feed roller 31 is moved by a first distance d1 on the vertical direction when setting the position of the spiral coil 11*a* having the small diameter.

Figure 21:
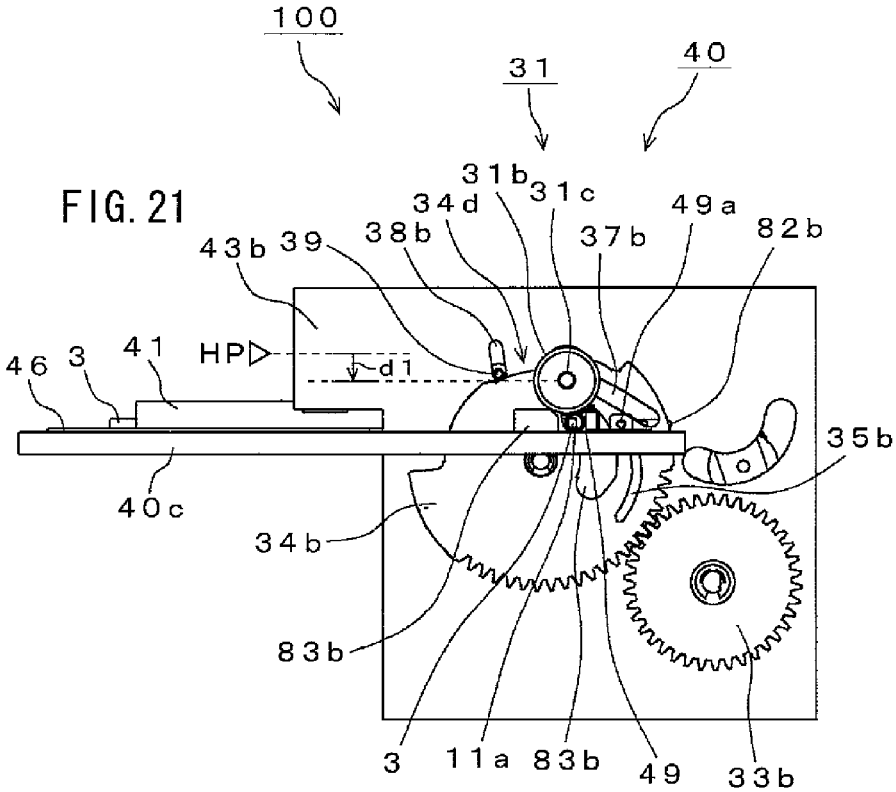
FIG. 21 is a side view showing an operation example of the binding mechanism 40 when setting a position of the spiral coil 11*a* having the small diameter.

According to the binding mechanism 40 shown in FIG. 21, a state is such that the feed roller 31, the screw guide 49 and the paper-sheet clamp 45 stay when setting the position of the spiral coil 11*a* having the small diameter. This state is a case where the number of the paper-sheets is 40 sheets or less and the spiral coil 11*a* having the small diameter passes therethrough. When the spiral coil 11*a* passes therethrough, the gear 33*b* rotates clockwise by a predetermined extent with respect to a surface of figure from the stand-by state shown in FIG. 20. By this rotation of the gear 33*b*, the guide-switching cam 34*b* meshed with the gear 33*b* rotates counter-clockwise.

By the rotation of this guide-switching cam 34*b*, the feed roller 31 positioned at the uppermost of the vertical long opening 80*b* (see FIG. 13) of the side surface plate 43*b* moves from the above-mentioned end of the long cam opening 37*b* of the guide-switching cam 34*b* to the other end thereof to fall down so that it moves on a vertical direction from the uppermost of the vertical long opening 80*b* to the lowermost thereof. This enables the feed roller 31 to be set to a position where it comes into contact with the top surface of the spiral coil 11*a*.

By the rotation of this guide-switching cam 34*b*, the screw guide 49 positioned at a right side of the horizontal long opening 82*b* with respect to the surface of the figure in the above-mentioned stand-by state moves from the above-mentioned end of the curved long cam opening 35*b* of the guide-switching cam 34*b* to the other end thereof to fall back (come close to the spiral coil 11*a*) so that it moves on a horizontal direction from the right side of the horizontal long opening 82*b* to the left side thereof. This enables the screw guide 49 to be set to a position where it comes into contact with the front surface of the spiral coil 11*a* having the small diameter.

By the rotation of this guide-switching cam 34*b*, the paper-sheet clamp 45 positioned at the uppermost of the vertical long opening 38*b* at the above-mentioned stand-by state moves from the uppermost of the vertical long opening 38*b* to the lowermost thereof on an almost vertical direction because the linking rod 39 of the paper-sheet clamp 45 is fallen down by the outer circumferential cam surface 34*d*. This enables the paper-sheet clamp 45 to be set to a position where it clamps the bundle of paper-sheets 3 constituted of paper-sheets of 40 sheets or less.

A description will be given of an operation example of the binding mechanism 40 when setting a position of the spiral coil 11*b* having the middle diameter with reference to FIG. 22. In this example, the feed roller 31 is moved by a second distance d2 on the vertical direction when setting the position of the spiral coil 11*b* having the middle diameter.

Figure 22:
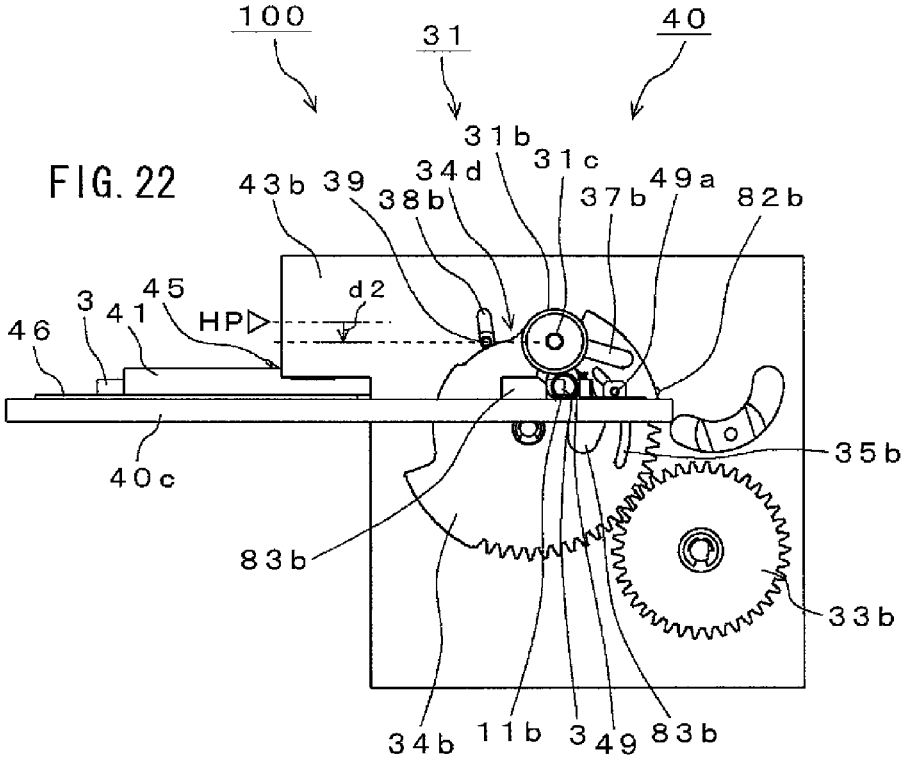
FIG. 22 is a side view showing an operation example of the binding mechanism 40 when setting a position of the spiral coil 11*b* having the middle diameter.

According to the binding mechanism 40 shown in FIG. 22, a state is such that the feed roller 31, the screw guide 49 and the paper-sheet clamp 45 stay when setting the position of the spiral coil 11*b* having the middle diameter. This state is a case where the number of the paper-sheets is 41 through 70 sheets and the spiral coil 11*b* having the middle diameter passes therethrough. When the spiral coil 11*b* passes therethrough, the gear 33*b* rotates clockwise by a predetermined extent from the stand-by state shown in FIG. 20 with respect to a surface of figure. By this rotation of the gear 33*b*, the guide-switching cam 34*b* meshed with the gear 33*b* rotates counter-clockwise.

By the rotation of this guide-switching cam 34*b*, the feed roller 31 positioned at the uppermost of the vertical long opening 80*b* (see FIG. 13) of the side surface plate 43*b* moves from the end of the long cam opening 37*b* of the guide-switching cam 34*b* to a position thereof that is about a quarter of the opening length thereof to fall down slightly so that it moves on a vertical direction from the uppermost of the vertical long opening 80*b* to the middle portion thereof. This enables the feed roller 31 to be set to a position where it comes into contact with the top surface of the spiral coil 11*b* having the middle diameter.

By the rotation of this guide-switching cam 34*b*, the screw guide 49 positioned at a right side of the horizontal long opening 82*b* with respect to the surface of the figure in the above-mentioned stand-by state moves from the above-mentioned end of the curved long cam opening 35*b* of the guide-switching cam 34*b* to a position thereof that is about two third of the opening length thereof to fall back slightly (come close to the spiral coil 11*b*) so that it moves on a horizontal direction from the right side of the horizontal long opening 82*b* to the left side thereof. This enables the screw guide 49 to be set to a position where it comes into contact with the front surface of the spiral coil 11*b* having the middle diameter.

By the rotation of this guide-switching cam 34*b*, the paper-sheet clamp 45 positioned at the uppermost of the vertical long opening 38*b* in the above-mentioned stand-by state moves from the uppermost of the vertical long opening 38*b* to the middle thereof on an almost vertical direction because the linking rod 39 of the paper-sheet clamp 45 is slightly fallen down by the outer circumferential cam surface 34*d*. This enables the paper-sheet clamp 45 to be set to a position where it clamps the bundle of paper-sheets 3 constituted of paper-sheets of 41 through 70 sheets.

A description will be given of an operation example of the binding mechanism 40 when setting a position of the spiral coil 11*c* having the large diameter with reference to FIG. 23. In this example, the feed roller 31 is moved by a third distance d3 (d1>d2>d3) on the vertical direction when setting the position of the spiral coil 11*c* having the large diameter. This enables the position of the feed roller 31 to be adjusted by the binding mechanism 40 after the clamping.

Figure 23:
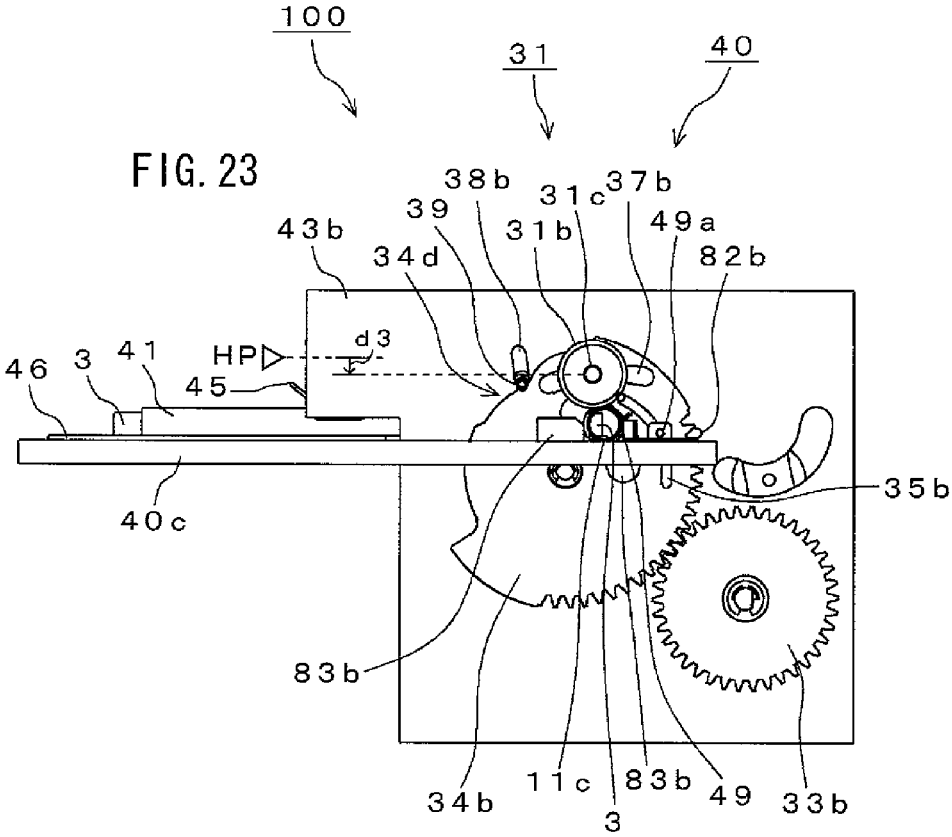
FIG. 23 is a side view showing an operation example of the binding mechanism 40 when setting a position of the spiral coil 11*c* having the large diameter.

According to the binding mechanism 40 shown in FIG. 23, a state is such that the feed roller 31, the screw guide 49 and the paper-sheet clamp stay when setting the position of the spiral coil 11*c* having the large diameter. This state is a case where the number of the paper-sheets is 71 through 100 sheets and the spiral coil 11*c* having the large diameter passes therethrough. When the spiral coil 11*c* passes therethrough, the gear 33*b* rotates clockwise by a predetermined extent with respect to a surface of figure from the stand-by state shown in FIG. 20. By this rotation of the gear 33*b*, the guide-switching cam 34*b* meshed with the gear 33*b* rotates counter-clockwise.

By the rotation of this guide-switching cam 34*b*, the feed roller 31 positioned at the uppermost of the vertical long opening 80*b* of the side surface plate 43*b* moves from the end of the long cam opening 37*b* of the guide-switching cam 34*b* to a position thereof that is about a half of the opening length thereof to fall down slightly so that it moves on a vertical direction from the uppermost of the vertical long opening 80*b* to the upper portion thereof. This enables the feed roller 31 to be set to a position where it comes into contact with the top surface of the spiral coil 11*c* having the large diameter.

By the rotation of this guide-switching cam 34*b*, the screw guide 49 positioned at a right side of the horizontal long opening 82*b* with respect to the surface of the figure in the above-mentioned stand-by state moves from the end of the curved long cam opening 35*b* of the guide-switching cam 34*b* to a position thereof that is about a half of the opening length thereof to fall back slightly (come close to the spiral coil 11*c*) so that it moves on a horizontal direction from the right side of the horizontal long opening 82*b* to the left side thereof. This enables the screw guide 49 to be set to a position where it comes into contact with the front surface of the spiral coil 11*c* having the large diameter.

By the rotation of this guide-switching cam 34*b*, the paper-sheet clamp 45 positioned at the uppermost of the vertical long opening 38*b* in the above-mentioned stand-by state moves from the uppermost of the vertical long opening 38*b* to the middle thereof on an almost vertical direction because the linking rod 39 of the paper-sheet clamp 45 is slightly fallen down by the outer circumferential cam surface 34*d*. This enables the paper-sheet clamp 45 to be set to a position where it clamps the bundle of paper-sheets 3 constituted of paper-sheets of 71 through 100 sheets.

Thus, according to the operation examples of the binding mechanism 40 when setting the positions corresponding to the diameters of coils, it is configured that four patterns of the feed roller 31, the screw guide 49 and the paper-sheet clamp 45 such as a pattern of the stand-by time thereof, patterns when setting the positions of the spiral coils of the small diameter, the middle diameter and the large diameter are separately set.

Accordingly, it is possible to guide the respective spiral coils 11*a*, 11*b* and 11*c* having different diameters of the coils to the punched holes 3*a* of the bundle of paper-sheets 3 at the positions corresponding to the diameters of coils thereof. This enables the respective spiral coils 11*a*, 11*b* and 11*c* to pass through the punched holes 3*a* of the bundle of paper-sheets 3 stably.

Figure 24A:
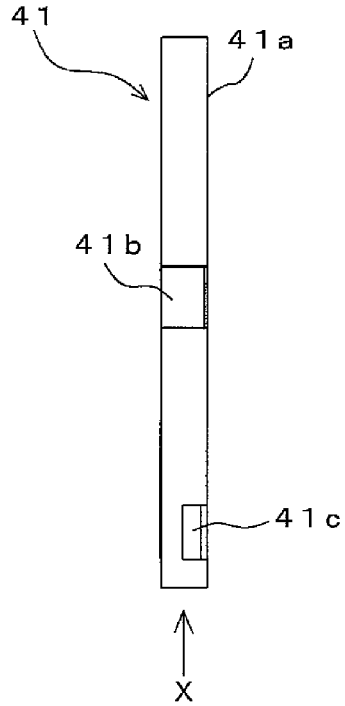
FIG. 24A is a top view showing a configuration example of a paper-sheet-aligning guide 41 shown in FIG. 12.

The following will describe a configuration example and a functional example of a paper-sheet-aligning guide 41 of the binding mechanism 40 with reference to FIGS. 24A through 27B. FIG. 24A is a top view showing a configuration example of the paper-sheet-aligning guide 41 shown in FIG. 12. In this example, a case is shown where the paper-sheet-aligning guide (slide guide wall) 41 having a sectional inverse trapezoid shape is provided on the paper-sheet-mounting base 46 which is at a upstream side of the advance of the spiral coil 11 and at a right angle of the advanced direction of the above-mentioned spiral coil 11 as shown in FIG. 12.

The paper-sheet-aligning guide 41 shown in FIG. 24A has a paper-sheet-aligning surface 41*a*, first and second recess portions 41*b* and 41*c*. In this example, assuming that an angle consisting of the paper-sheet-aligning surface 41*a* of the paper-sheet-aligning guide 41 and a paper-sheet-mounting surface of the paper-sheet-mounting base 46 is an inclined angle θ as shown in FIG. 24B, the inclined angle θ is set so as to become less than 90 degrees. Namely, the paper-sheet-aligning surface 41*a* of the paper-sheet-aligning guide 41 has the inclined angle θ that is almost the same as the coil advance angle. The paper-sheet-aligning guide 41 aligns the side edge 3*b* of the bundle of paper-sheets 3 obliquely corresponding to the inclination of the paper-sheet-aligning surface 41*a*. It is thus configured that the bundle of paper-sheets 3 is obliquely aligned in the paper-sheets thereof.

The paper-sheet-aligning surface 41*a* is formed as to have the inclined angle θ of about 80 degrees with respect to the paper-sheet-mounting surface of the paper-sheet-mounting base 46 shown in FIG. 12. In addition, it is preferable to become θ=75 through 80 degrees in a case where a pitch of the coil is about 6 through 6.5 mm and an inner diameter of the coil is about 8 through 20 mm. With the recess portion 41*b*, the supporting rod 44 of the paper-sheet clamp 45 shown in FIG. 11 is engaged. With the recess portion 41*c*, the linking rod 39 of the paper-sheet clamp 45 shown in FIG. 11 is also engaged.

Thus, by aligning the bundle of paper-sheets 3 obliquely corresponding to the inclination of the paper-sheet-aligning surface 41*a*, the punched holes 3*a* of the bundle of the paper-sheets 3 are also aligned corresponding to the inclination of the paper-sheet-aligning surface 41*a*. Accordingly, when the spiral coil 11 advances into the punched holes 3*a* of the bundle of the paper-sheets 3 having a predetermined inclination with it rotating, the punched holes 3*a* of the bundle of the paper-sheets 3 are obliquely adjusted in their open positions corresponding to the inclination so that the spiral coil 11 can pass trough the punched holes 3*a* stably.

FIG. 24B is a front view showing the paper-sheet-aligning guide 41 shown in FIG. 24A as seen from an X-direction. The paper-sheet-aligning guide 41 shown in FIG. 24B is set such that the paper-sheet-aligning surface 41*a* is about 80 degrees in the inclined angle θ with respect to the paper-sheet-mounting surface. It is configured that by the paper-sheet-aligning surface 41*a* formed so as to have this inclined angle of 80 degrees, the side edge 3*b* of the bundle of paper-sheets 3 is aligned (see FIG. 12).

Figure 25B:
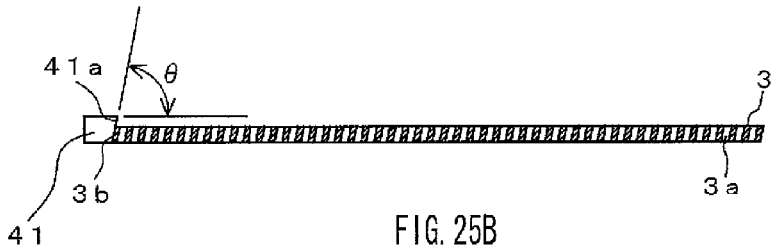
FIG. 25B is a cross-sectional view of the paper-sheet-aligning guide 41 taken along lines X-X shown in FIG. 25A.

A description will be given of a function example (part one) of the paper-sheet-aligning guide 41 with reference to FIGS. 25A and 25B. FIG. 25A is a top view showing a function example of the paper-sheet-aligning guide 41 when aligning the paper-sheets and FIG. 25B is a cross-sectional view of the paper-sheet-aligning guide 41 taken along lines X-X shown in FIG. 25A.

According to the paper-sheet-aligning guide 41 when aligning the paper-sheets as shown in FIG. 25A, a state is such that the paper-sheets are mounted on the paper-sheet-aligning surface 41*a* of the paper-sheet-aligning guide 41 shown in FIG. 24A and the bundle of paper-sheets 3 composed of paper-sheets of almost 41 through 70 sheets is aligned.

Further, in the paper-sheet-aligning guide 41 shown in FIG. 25B, the side edge 3*b* of the bundle of paper-sheets 3 is aligned by the paper-sheet-aligning surface 41*a* that has been set so that the inclined angle θ can be about 80 degrees and is aligned so as to be inclined at about 80 degrees that are similar to the inclined angle θ consisting it and the paper-sheet-mounting surface of the paper-sheet-mounting guide 46 mounting the bundle of paper-sheets 3. Further, the punched holes 3*a* of the bundle of paper-sheets 3 are also respectively aligned (deviated) so that an angle consisting them and the paper-sheet-mounting surface can be about 80 degrees, which is similar to the angle θ.

Figure 26A:
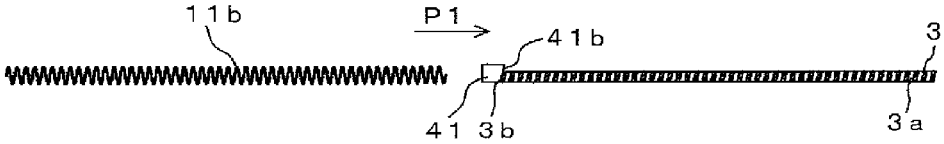
FIG. 26A is a front view showing an example of a state before an insertion of the spiral coil 11*b* having the middle diameter into the paper-sheet-aligning guide 41.

A description will be given of the function example (part two) of the paper-sheet-aligning guide 41 with reference to FIGS. 26A and 26B. FIG. 26A is a view showing a state before an insertion of the spiral coil 11*b* having the middle diameter. The spiral coil 11*b* having the middle diameter shown in FIG. 26A passes through, from an arrow direction P1, the punched holes 3*a* of the bundle of paper-sheets 3 which are aligned having the inclination, with it rotating, the side edge 3*b* of the bundle of paper-sheets 3 being aligned by the paper-sheet-aligning surface 41*a* of the paper-sheet-aligning guide 41.

Figure 26B:
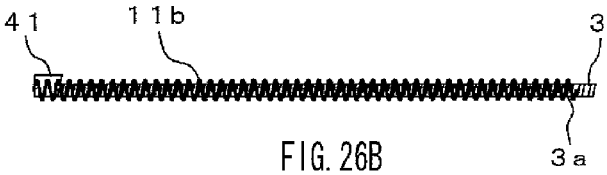
FIG. 26B is a front view showing an example of a state after the insertion of the spiral coil 11*b* having the middle diameter in the paper-sheet-aligning guide 41.

FIG. 26B is a view showing a state after the insertion of the spiral coil 11*b* having the middle diameter. The spiral coil 11*b* shown in FIG. 26B is a state where it passes through part of the way of the bundle of paper-sheets 3 (state before reaching the terminal thereof). It is to be noted that from the bundle of paper-sheets 3 shown in FIG. 26B, hatching of the sectional surface of the bundle of paper-sheets 3 shown in FIG. 26A is omitted in order to be made easy to see the passed-through state of the spiral coil 11*b*.

As shown in FIG. 26B, the angle of each of the punched holes 3*a* of the bundle of paper-sheets 3 having the inclination and the angle of the spiral coil 11 passed through the punched holes 3*a* are almost identical to each other. This enables a clearance between the spiral coil 11*b* and each of the punched holes 3*a* to be sufficiently kept, thereby allowing the spiral coil 11*b* to pass therethrough stably to prevent the spiral coil 11 from striking against a wall surface of the punched holes 3*a* of the bundle of paper-sheets 3.

A description will be given of function examples of the spiral coils 11*a* and 11*c* having the small and large diameters in the paper-sheet-aligning guide 41 when passing therethrough with reference to FIGS. 27A and 27B.

Figure 27A:
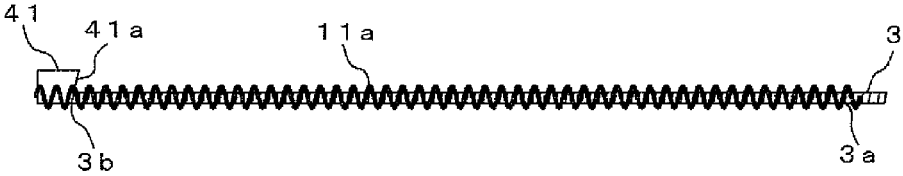
FIG. 27A is a front view showing a function example when inserting the spiral coil 11*a* having the small diameter in the paper-sheet-aligning guide 41.

The bundle of paper-sheets 3 shown in FIG. 27A is constituted of paper-sheets of 40 sheets or less in number of paper-sheets. The side edge 3*b* of the bundle of paper-sheets 3 is aligned by the paper-sheet-aligning surface 41*a* of the paper-sheet-aligning guide 41, which is formed so as to be inclined at about 80 degrees, and is set so that the angle consisting of it and a horizontal surface is about 80 degrees. The punched holes 3*a* of the bundle of paper-sheets 3 are also aligned so that the angle consisting of them and a horizontal surface is about 80 degrees. The spiral coil 11*a* shown in FIG. 27A is a state where the spiral coil 11*a* having the small diameter passes through part of the way of the bundle of paper-sheets 3. As shown in FIG. 27A, the angle of each of the punched holes 3*a* of the bundle of paper-sheets 3 having the inclination and the angle of the spiral coil 11*a* passed through the punched holes 3*a* are almost identical to each other.

Figure 27B:
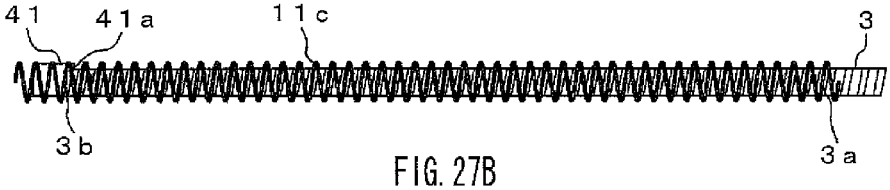
FIG. 27B is a front view showing a function example when inserting the spiral coil 11*c* having the large diameter in the paper-sheet-aligning guide 41.

The bundle of paper-sheets 3 shown in FIG. 27B is constituted of paper-sheets of almost 71 through 100 sheets in number of paper-sheets. The side edge 3*b* of the bundle of paper-sheets 3 is aligned by the paper-sheet-aligning surface 41*a* that is formed so as to be inclined at 80 degrees and is set so that the (inclined) angle consisting of it and a horizontal surface is about 80 degrees. The punched holes 3*a* of the bundle of paper-sheets 3 are also aligned so that the angle consisting of them and a horizontal surface is about 80 degrees. It is a state where the spiral coil 11*c* having the large diameter passes through part of the way of the bundle of paper-sheets 3. As shown in FIG. 27B, the angle of each of the punched holes 3*a* of the bundle of paper-sheets 3 having the inclination and the angle of the spiral coil 11*c* passed through the punched holes 3*a* are almost identical to each other.

Thus, by aligning the bundle of paper-sheets 3 obliquely, it is made possible to pass the forward end of the spiral coil 11 smoothly through the punched holes of the bundle of paper-sheets 3 to prevent the forward end of the spiral coil 11 from being caught by any of the punched holes of the bundle of paper-sheets 3. The clearance between each of the spiral coils 11*a* and 11*c* having the small and large diameters and each of the punched holes 3*a* can be sufficiently kept so that it is possible to pass the spiral coil 11*a* or 11*c* having the small or large diameter therethrough stably to prevent the forward end of the spiral coil from striking against a wall surface of each of the punched holes 3*a* of the bundle of paper-sheets 3. Of course, the inclined angle may alter in response to a thickness of the paper-sheets when aligning the bundle of paper-sheets.

Figure 28A:
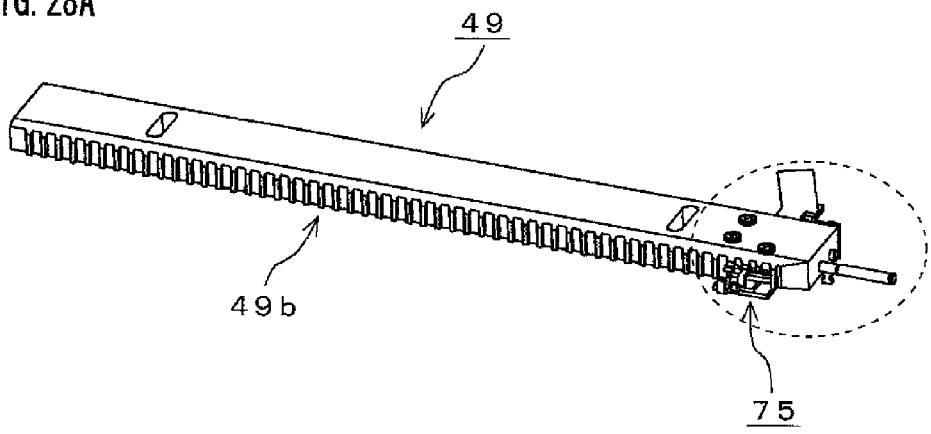
FIG. 28A is a perspective view showing a configuration example of a cutting-and-bending mechanism 75.
Figure 28B:
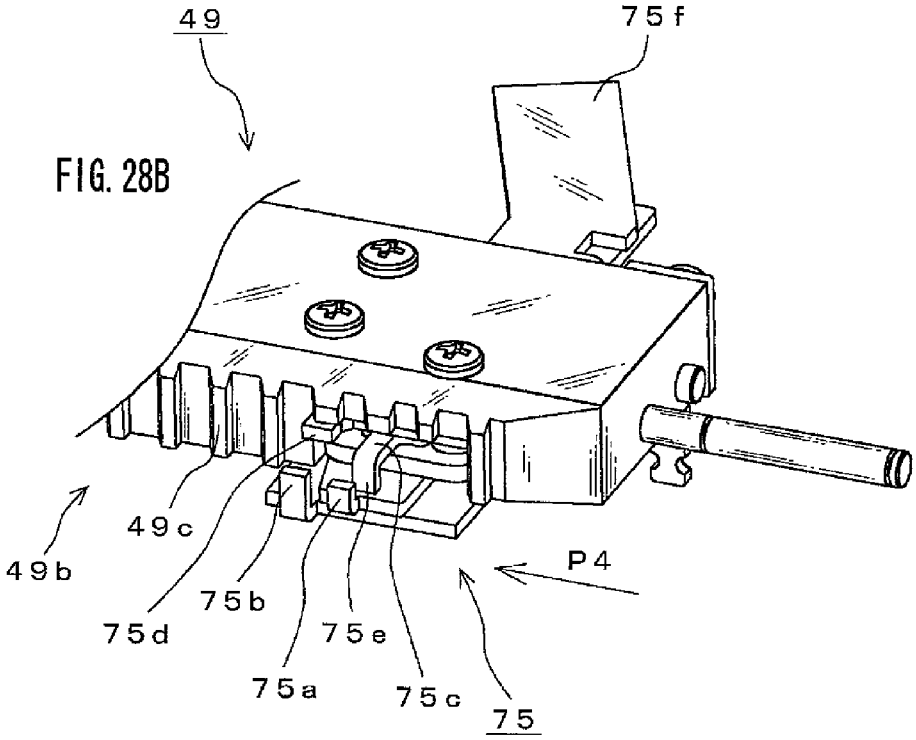
FIG. 28B is a perspective view showing an enlarged configuration example of the cutting-and-bending mechanism 75 indicated in a circle shown by dashed line in FIG. 28A.
Figure 29:
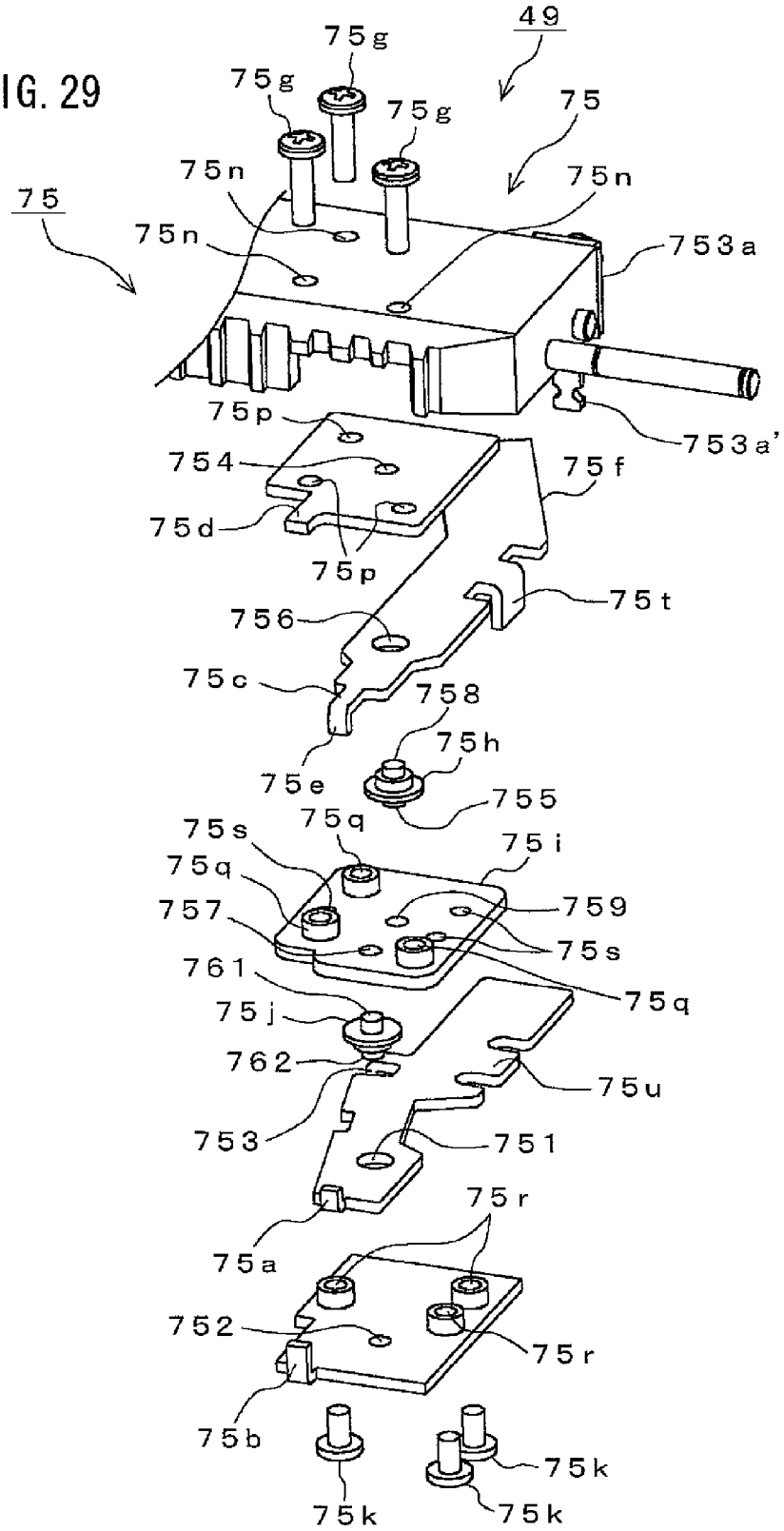
FIG. 29 is a perspective view showing an assembling example of the cutting-and-bending mechanism 75.

The following will describe a configuration example and an assembling example of the cutting-and-bending mechanism 75 with reference to FIGS. 28A through 29.

The cutting-and-bending mechanism 75 shown in FIG. 28A is provided at a one side (a coil-picking-up side) of the screw guide 49 and is designed so as to cut an end of the spiral coil 11 after the spiral coil 11 has passed through the punched holes 3*a* of the bundle of paper-sheets 3 and to bend it.

FIG. 28B is an enlarged view of the cutting-and-bending mechanism 75 indicated in a circle shown by dashed line in FIG. 28A. The cutting-and-bending mechanism 75 shown in FIG. 28B is configured to have a hitting-for-pinching portion 75*a*, a receiving-for-pinching portion 75*b*, a cutter-receiving portion 75*d* and a lever 75*f*. At a forward end of the lever 75*f*, a cutter 75*c* and a bending portion 75*e* are provided.

The receiving-for-pinching portion 75*b* and the cutter-receiving portion 75*d* are fixed on a main body of the screw guide 49 at predetermined positions thereof. In this example, the cutter-receiving portion 75*d* having a plate shape is fixed so as to face to a vertical direction with respect to the projections 49*c* of the screw guide 49. The receiving-for-pinching portion 75*b* having an L-shape is fixed so that a standing-up section of the receiving-for-pinching portion 75*b* is made parallel with the projections 49*c*. The lever 75*f* is movably attached to the main body of the screw guide 49 at a predetermined position thereof. The hitting-for-pinching portion 75*a* is attached so as to cooperate with the lever 75*f*. Shapes of the hitting-for-pinching portion 75*a* and the receiving-for-pinching portion 75*b* are L-shapes.

The hitting-for-pinching portion 75*a* and the receiving-for-pinching portion 75*b* constitute an example of pinching part and hold the end of the spiral coil 11 with it being pinched. For example, the lever 75*f* rotates to a predetermined direction while the spiral coil 11 passes through between the hitting-for-pinching portion 75*a* and the receiving-for-pinching portion 75*b*. By moving the hitting-for-pinching portion 75*a* toward the fixed receiving-for-pinching portion 75*b*, the hitting-for-pinching portion 75*a* and the receiving-for-pinching portion 75*b* hold the end of the spiral coil with it being pinched.

The cutter 75*c* and the cutter-receiving portion 75*d* constitute an example of cutting part and cut a predetermined position of the pinched spiral coil 11. For example, the lever 75*f* further rotates to the predetermined direction while the spiral coil 11 is pinched by the hitting-for-pinching portion 75*a* and the receiving-for-pinching portion 75*b*. By this rotation, the fixed cutter-receiving portion 75*d* and the cutter 75*c* provided at the forward end of the lever 75*f* cut the end of the spiral coil 11 with it being pinched.

The bending portion 75*e* is provided on an extension portion of the cutter 75*c* and bends the cut end of the spiral coil 11 to a predetermined direction. For example, the lever 75*f* additionally rotates to the predetermined direction after the spiral coil 11 has been cut by the cutter 75*c*. By this rotation, the bending portion 75*e* pushes the cut end of the spiral coil 11 to a direction of an arrow P4 while the spiral coil 11 is pinched by the hitting-for-pinching portion 75*a* and the receiving-for-pinching portion 75*b* and bends it.

After it is bent, by rotating the lever 75*f* to the opposite direction thereof, moving the cutter 75*c* away from the cutter-receiving portion 75*d* and moving the hitting-for-pinching portion 75*a* away from the receiving-for-pinching portion 75*b*, the pinched and held spiral coil 11 is made free and becomes the stand-by state thereof. By such a cutting-and-bending mechanism 75, the end of the spiral coil 11 is processed.

A description will be given of the assembling example of the cutting-and-bending mechanism 75 with reference to FIG. 29. According to the cutting-and-bending mechanism 75 shown in FIG. 29, three pieces of first pins 75*g* are first inserted into three holes 75*n* of the main body of the screw guide 49 and the pins 75*g* are also inserted into three holes 75*p* of the main body of the cutter-receiving portion 75*d* so that the main body of the cutter-receiving portion 75*d* is fixed to the main body of the screw guide 49.

To the main body of the fixed cutter-receiving portion 75*d*, the lever 75*f* is rotatably attached. In this example, a projection 758 of a first intermediate member 75*h* is inserted into an opening 754 provided at almost a middle of the main body of the cutter-receiving portion 75*d* and an opening 756 of the main body of the lever 75*f* so that they are rotatably connected. After the connection, the other projection 755 of this intermediate member 75*h* is inserted into an opening 759 of a fixation plate 75*i* and forward ends of the three pins 75*g* are inserted into three fixation sections 75*q* of the fixation plate 75*i*. Thus, the main body of the cutter-receiving portion 75*d* is fixed on the main body of the screw guide 49 and the main body of the lever 75*f* is rotatably fixed on the main body of the screw guide 49.

A projection 761 of a second intermediate member 75*j* is inserted into an opening 757 of the fixation plate 75*i* and the other projection 762 thereof is inserted into an opening 751 of the main body of the hitting-for-pinching portion 75*a* and an opening 752 of the main body of the receiving-for-pinching portion 75*b*. After the insertion thereof, three pieces of second pins 75*k* are inserted into three braced holes 75*r* of the main body of the receiving-for-pinching portion 75*b* and three holes 75*s* of the fixation plate 75*i* so that the main body of the receiving-for-pinching portion 75*b* is fixed on the fixation plate 75*i*. Thus, the main body of the hitting-for-pinching portion 75*a* is rotatably fixed on the fixation plate 75*i* with the intermediate member 75*j* being the rotation shaft thereof so that the cutting-and-bending mechanism 75 is assembled.

It is to be noted that a spring 75*m*, which will be described later, is attached to a spring-hooking portion 753 of the main body of the hitting-for-pinching portion 75*a* and an elastic force by the spring 75*m* allows any force for the rotation to be always applied to a predetermined direction. With a push-receiving portion 75*u* of the main body of the hitting-for-pinching portion 75*a*, a pushing portion 75*t* of the main body of the lever 75*f* is engaged. It is designed that based on such a configuration, by manipulating the lever 75*f*, the main body of the hitting-for-pinching portion 75*a* rotates with cooperation.

The following will describe operation examples of the cutting-and-bending mechanism 75 with respect to FIGS. 30A through 32C.

In this example, a description will be performed dividing it into three states such as a stand-by state of the cutting-and-bending mechanism 75, a cutting state thereof and a bending state thereof. It is to be noted that an end side of the spring 75*m* is attached to the spring-hooking portion 753 of the main body of the hitting-for-pinching portion 75*a* of the cutting-and-bending mechanism 75 and the other end side of the spring 75*m* is attached to a hooking portion 753*a*' of a hooking plate 753*a*. An elastic force by the spring 75*m* allows any clockwise force to be always applied. The operations of the hitting-for-pinching portion 75*a* and the cutter 75*c* are adjusted by the lever 75*f*.

Figure 30A:
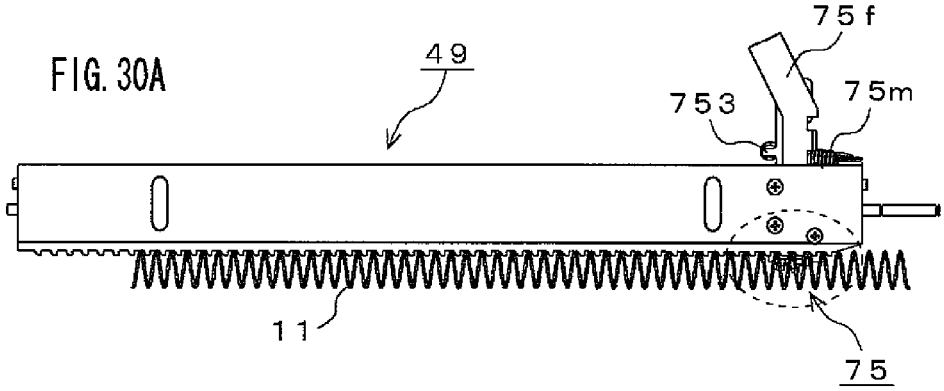
FIG. 30A is a top view showing an operation example of the cutting-and-bending mechanism 75 in the screw guider 49 at a period of stand-by time.

FIG. 30A is a top view showing an operation example of the cutting-and-bending mechanism 75 in the screw guider 49 at a period of stand-by time. The cutting-and-bending mechanism 75 shown in FIG. 30A is provided at an end of the screw guide 49 and stays in its stand-by state. In this example, a position of the lever 75*f* of the cutting-and-bending mechanism 75 is set to its initial position. The screw guide 49 shown in the figure guides the dispatched spiral coil 11.

Figure 30B:
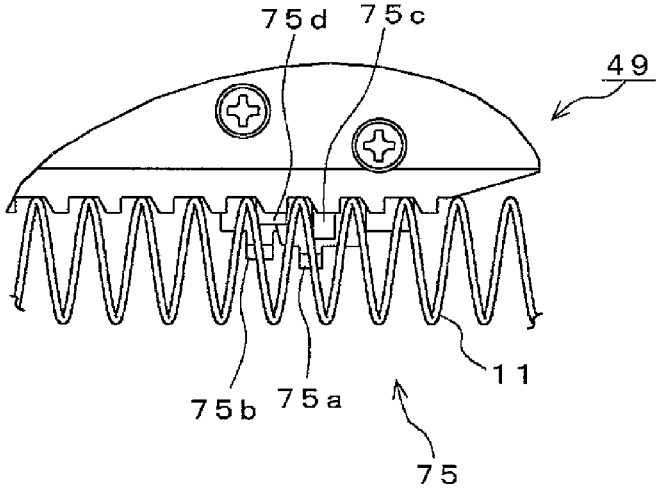
FIG. 30B is an enlarged view showing an operation example of the cutting-and-bending mechanism 75 indicated in a circle shown by dashed line in FIG. 30A.

FIG. 30B is an enlarged view showing an operation example of the cutting-and-bending mechanism 75 indicated in a circle shown by dashed line in FIG. 30A. According to the cutting-and-bending mechanism 75 shown in FIG. 30B, the pushing portion 75*t* of the lever 75*f* is engaged with the push-receiving portion 75*u* of the hitting-for-pinching portion 75*a* by tension of the spring 75*m*. Thus, the hitting-for-pinching portion 75*a* faces to a direction almost similar to that of the receiving-for-pinching portion 75*b*. At this moment, a space between the hitting-for-pinching portion 75*a* and the receiving-for-pinching portion 75*b* is around three times a diameter of a rod of the spiral coil 11. The end of the spiral coil 11 is positioned between the hitting-for-pinching portion 75*a* and the receiving-for-pinching portion 75*b*.

The cutter 75*c* faces to a direction almost similar to that of the cutter-receiving portion 75*d*. In this example, a space between the cutter 75*c* and the cutter-receiving portion 75*d* is also set to be around three times the diameter of the rod of the spiral coil 11. The spiral coil 11 is positioned between the cutter 75*c* and the cutter-receiving portion 75*d*.

Figure 30C:
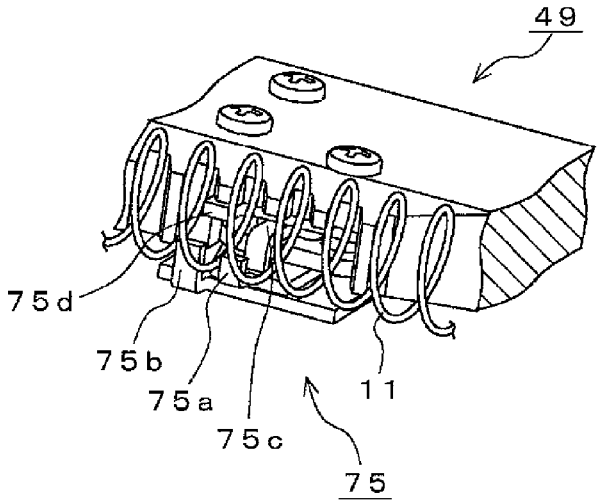
FIG. 30C is a perspective view showing an operation example of the cutting-and-bending mechanism 75 shown in FIG. 30B.

FIG. 30C is a perspective view showing an operation example of the cutting-and-bending mechanism 75 shown in FIG. 30B. In the cutting-and-bending mechanism 75 shown in FIG. 30C, the spiral coil 11 passes through around a middle of the standing-up section of the receiving-for-pinching portion 75*b* having the L-shape. Similarly, the spiral coil 11 passes through around a middle of the standing-up section of the hitting-for-pinching portion 75*a* having the L-shape. This enables the spiral coil 11 to be surely pinched and held by the receiving-for-pinching portion 75*b* and the hitting-for-pinching portion 75*a*. The spiral coil 11 also passes through near a base of the cutter-receiving portion 75*d* having a plate shape.

Figure 31A:
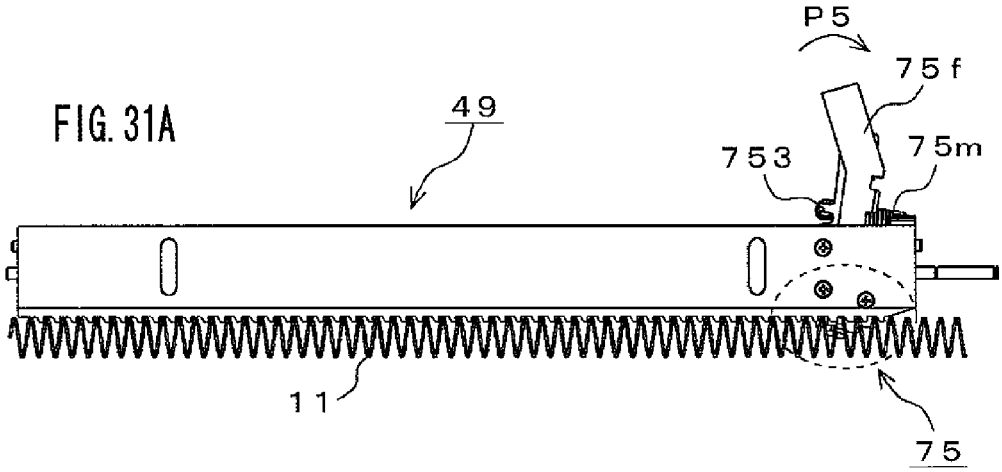
FIG. 31A is a top view showing an operation example of the cutting-and-bending mechanism 75 when cutting the coil.

FIG. 31A is a top view showing an operation example of the cutting-and-bending mechanism 75 when cutting the coil. According to the cutting-and-bending mechanism 75 shown in FIG. 31A, by rotating the lever 75*f* from the initial position thereof shown in FIG. 30A to a direction of an arrow P5, it moves to its cutting position.

Figure 31B:
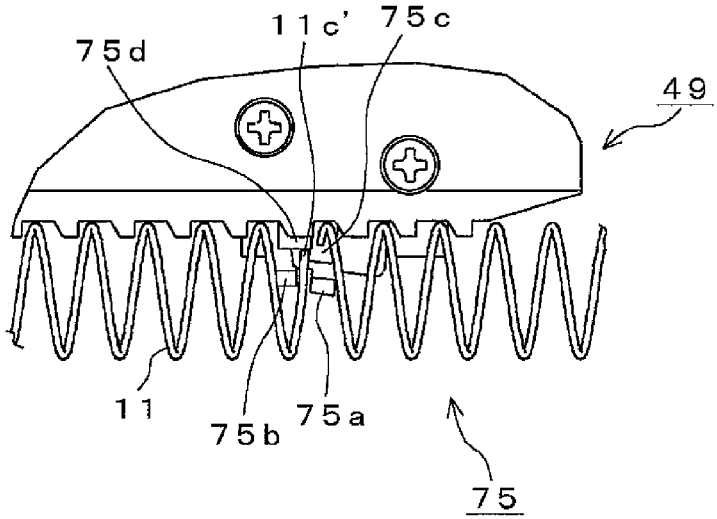
FIG. 31B is an enlarged view showing an operation example of the cutting-and-bending mechanism 75 indicated in a circle shown by dashed line in FIG. 31A.

FIG. 31B is an enlarged view showing an operation example of the cutting-and-bending mechanism 75 indicated in a circle shown by dashed line in FIG. 31A. According to the cutting-and-bending mechanism 75 shown in FIG. 31B, by rotating the lever 75*f* to the direction of the arrow P5 (clockwise), the hitting-for-pinching portion 75*a* rotates clockwise cooperating with the lever 75*f*. In this example, an elastic force by the spring 75*m* hooked by the spring-hooking portion 753 of the main body of the hitting-for-pinching portion 75*a* allows any clockwise force to be always applied to the hitting-for-pinching portion 75*a*.

Accordingly, by rotating the lever 75*f* clockwise, the hitting-for-pinching portion 75*a* rotates clockwise with respect to the projection 762 of the intermediate member 75*j* shown in FIG. 29 as an axis thereof to come close to the receiving-for-pinching portion 75*b*. By approaching the hitting-for-pinching portion 75*a* to the receiving-for-pinching portion 75*b*, the spiral coil 11 shown in FIG. 30B, which is positioned between the hitting-for-pinching portion 75*a* and the receiving-for-pinching portion 75*b*, is pinched by the hitting-for-pinching portion 75*a* and the receiving-for-pinching portion 75*b* as shown in FIG. 31B to be held. At this moment, the spiral coil 11 is pinched between the cutter 75*c* and the cutter-receiving portion 75*d*.

By further rotating the lever 75*f* clockwise with the spiral coil 11 being pinched and held by the hitting-for-pinching portion 75*a* and the receiving-for-pinching portion 75*b*, only the cutter 75*c* rotates clockwise and cuts the spiral coil 11 pinched between the cutter 75*c* and the cutter-receiving portion 75*d*. "11*c*'" in the figure is a cut end of the cut spiral coil 11.

Figure 31C:
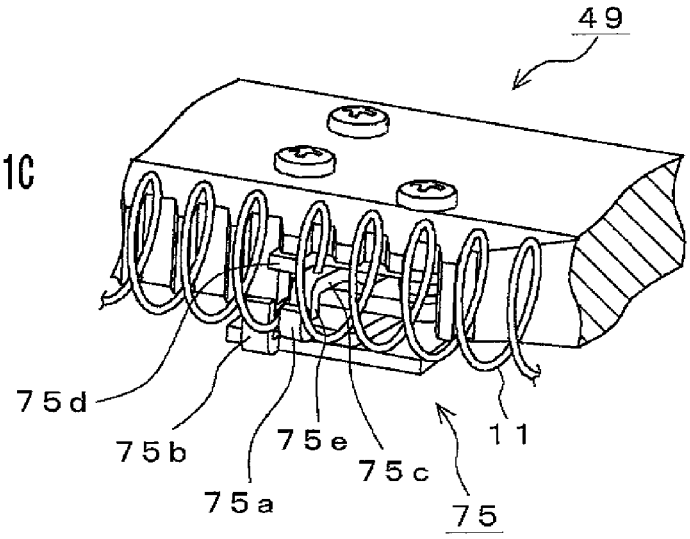
FIG. 31C is a perspective view showing an operation example of the cutting-and-bending mechanism 75 shown in FIG. 31B.

FIG. 31C is a perspective view showing an operation example of the cutting-and-bending mechanism 75 shown in FIG. 31B. According to the cutting-and-bending mechanism 75 shown in FIG. 31C, the spiral coil 11 is pinched by the hitting-for-pinching portion 75*a* and the receiving-for-pinching portion 75*b* and the cutter 75*c* cuts the spiral coil at a position away from the pinched position of the spiral coil 11 by about a quarter of the arc of the circle of the spiral coil 11.

Figure 32A:
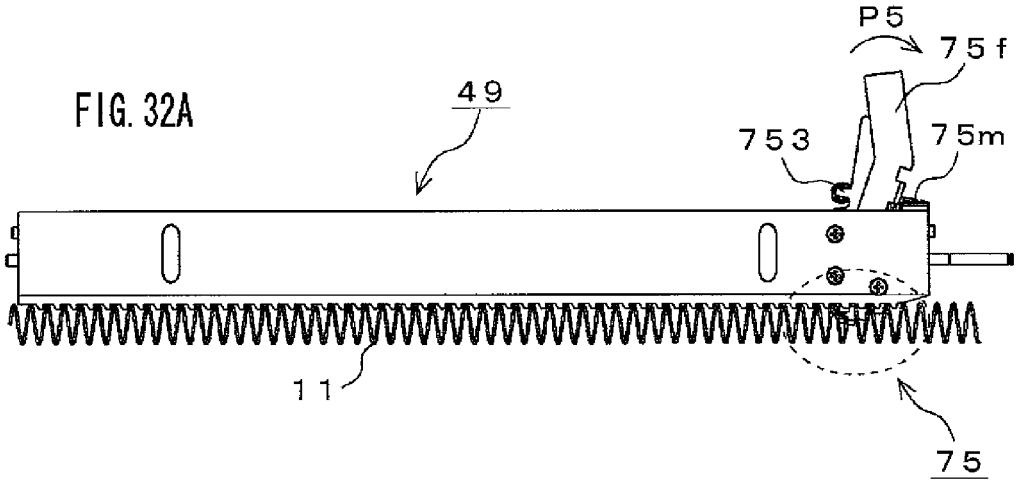
FIG. 32A is a top view showing an operation example of the cutting-and-bending mechanism 75 when bending a forward end of the coil.

FIG. 32A is a top view showing an operation example of the cutting-and-bending mechanism 75 when bending the coil. According to the cutting-and-bending mechanism 75 shown in FIG. 32A, by further rotating the lever 75*f* from the cutting position thereof shown in FIG. 31A to a direction of an arrow P5, it moves to its bending position.

Figure 32B:
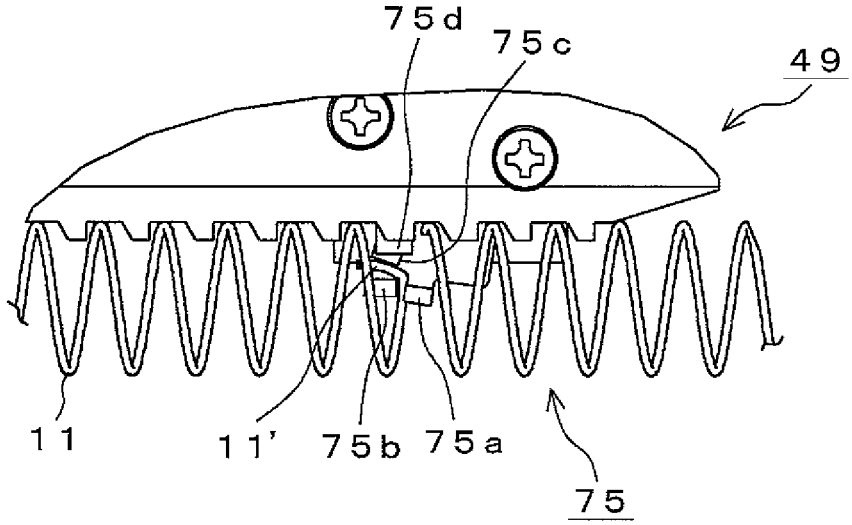
FIG. 32B is an enlarged view showing an operation example of the cutting-and-bending mechanism 75 indicated in a circle shown by dashed line in FIG. 32A.

FIG. 32B is an enlarged view showing an operation example of the cutting-and-bending mechanism 75 indicated in a circle shown by dashed line in FIG. 32A. According to the cutting-and-bending mechanism 75 shown in FIG. 32B, the hitting-for-pinching portion 75*a* and the receiving-for-pinching portion 75*b* keep a state where the spiral coil 11 is pinched and held by the elastic force of the spring 75*m* hooked the spring-hooking portion 753 of the main body of the hitting-for-pinching portion 75*a*.

In this example, it is configured that the bending portion 75*e* rotates clockwise by additionally rotating the lever 75*f* clockwise and bends the cut end 11*c*' of the spiral coil 11 pinched between the bending portion 75*e* and the receiving-for-pinching portion 75*b* from the base thereof inward the spiral coil 11 only by about 90 degrees.

Figure 32C:
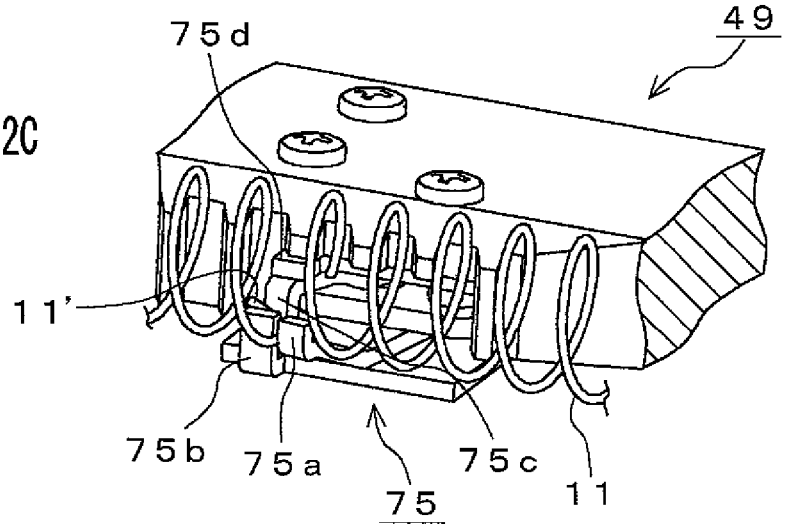
FIG. 32C is a perspective view showing an operation example of the cutting-and-bending mechanism 75 shown in FIG. 32B.

FIG. 32C is a perspective view showing a configuration example of the cutting-and-bending mechanism 75 shown in FIG. 32B. According to the cutting-and-bending mechanism 75 shown in FIG. 32C, it is configured that the cut end 11*c*' of the spiral coil 11 pinched between the hitting-for-pinching portion 75*a* and the receiving-for-pinching portion 75*b* is bent inward the spiral coil 11 by the bending portion 75*e*.

Figure 33:
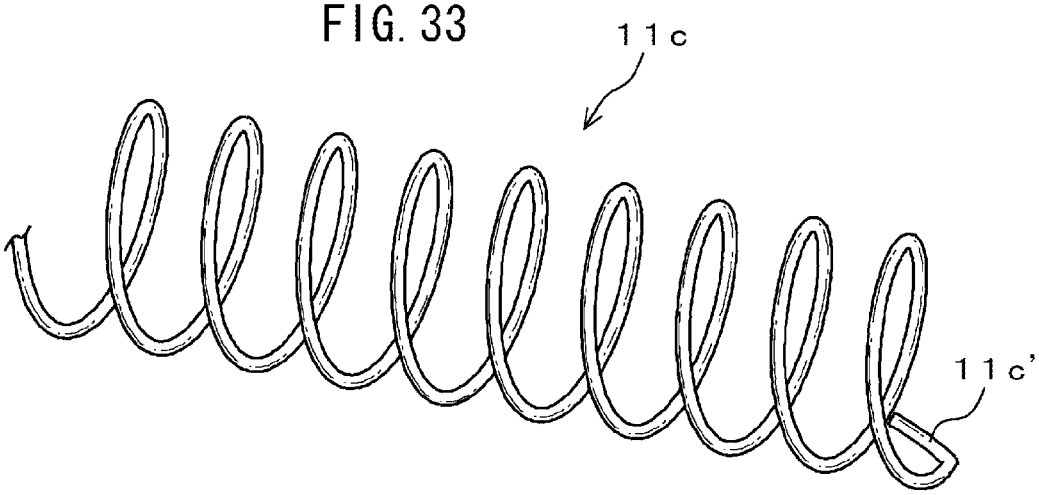
FIG. 33 is a perspective view showing a configuration example of the spiral coil 11*c*, an end of which has been processed.

A description will be given of a configuration example of the spiral coil 11*c*, an end of which has been processed, with reference to FIG. 33. According to the spiral coil 11*c*, an end of which has been processed, shown in FIG. 33, it is configured that its cut end 11*c*' is bent inward the spiral coil 11 by about one fifth of the arc of the circle of the spiral coil 11. This enables the end of the spiral coil 11 to be made well looked. This also enables the end of the spiral coil 11 to be prevented from catching clothes of a user. Of course, this enables the spiral coil 11 to be prevented from being slipped out of the bundle of paper-sheets 3.

The following will describe a configuration example of a wire rod cartridge 10 and its peripheral mechanism in the paper-sheet-handling apparatus 100. The wire rod cartridge 10 shown in FIG. 34 constitutes a function of a wire-rod-supplying part, is able to be mounted on the paper-sheet-handling apparatus 100 and supplies the wire rod 1 to the coil-forming mechanism 20. This example is a case where the wire rod cartridge 10 and the coil-forming mechanism 20 are laid out one item next to another along the advanced direction of the wire rod 1. Of course, a disposed position of the wire rod cartridge 10 with respect to the coil-forming mechanism 20 is not limited thereto.

The wire rod 1 (consumables) is (are) wound on the wire rod cartridge 10. The wire rod 1 is wound so as to be, for example, multi-layered and formed in line with it keeping a predetermined pitch. It is configured that the wire rod cartridge 10 has a drum 12 on which the wire rod 1 is wound and a wire rod detection sensor 65 for detecting whether there is the wire rod or not is disposed in the drum 12. The wire rod detection sensor 65 functions as a detection part and may be attached to every drum 12 but is attached to a side of the paper-sheet-handling apparatus in order to make efforts to realize a cost reduction of the wire rod cartridge 10.

The drum 12 has a figure that is portable (can be carried). In this example, the drum 12 is provided with a bobbin 12*a* and a winding shaft 12*b* having window portions 12*c*. The drum 12 has the bobbin 12*a*, an end of which has a cone-like shape. On the drum 12, for example, a vinyl-covered iron-core wire of around 1000 m is wound. A diameter of the wire rod 1 is around 0.8 mm.

The winding shaft 12*b* has a cubic shape combining rectangular shapes and a tubular shape (see FIG. 1) and is used when the wire rod 1 is wound on the bobbin 12*a* in a factory or the like so that after the drum has been mounted, the bobbin 12*a* is used with it being fixed without any rotation. The window portions 12*c* of the bobbin 12*a* and the winding shaft 12*b* are used when detecting whether there is the wire rod 1 or not.

In this example, an opening 12*d* that receives a lock portion 5 is provided at the other end of the bobbin 12*a*. The lock portion 5 is provided in a lock mechanism 6 installed in a side of the paper-sheet-handling apparatus 100. The lock mechanism 6 is attached to a predetermined board 2 of the paper-sheet-handling apparatus 100. It is configured that the lock portion 5 is engaged with the opening 12*d* for locking of the bobbin 12*a* and the drum 12 is fixed on the paper-sheet-handling apparatus 100. It is because the wire rod 1 is not naturally unwound from the drum 12 to use the bobbin 12*a* with it being fixed like this.

It is configured that a mount-detection sensor 64 is provided in the lock mechanism 6 and detects whether or not the wire rod cartridge 10 is mounted on the paper-sheet-handling apparatus 100 to output a mount-detection signal S64. The mount-detection signal S64 is output to the control section 50 shown in FIG. 39. A switching element or the like that detects which is on or off is used for the mount-detection sensor 64.

A wire rod detection sensor unit 60 that is disposed at a side of the paper-sheet-handling apparatus 100 is set inside the winding shaft 12*b*. The wire rod detection sensor unit 60 has a sensor case portion 4 mounted on the board 2. The sensor case portion 4 has, for example, a cubic shape that is one size smaller than the outside cubic shape of the winding shaft 12*b* reflecting the rectangular shapes and the tubular shape thereof. It is because the wire rod detection sensor unit 60 is inserted into the inside of the winding shaft 12*b* to use such a cubic configuration.

A wire rod detection sensor 65 constituting a function of a detection part is provided at the rectangular part of the wire rod detection sensor unit 60 and detects whether there is the wire rod 1 wound on the drum 12 or not to output a wire rod detection signal S65. The wire rod detection signal S65 is output to the control section 50. An optical sensor of a reflection or transmission type is used for the wire rod detection sensor 65. The wire rod detection sensor 65 is disposed at a position such that its light-emitting element and light-receiving element are seen from the window portions 12*c* of the bobbin 12*a* and the winding shaft 12*b*. It is because the detection whether there is the wire rod 1 wound on the drum 12 or not is performed to dispose the wire rod detection sensor 65 at this position.

It is to be noted that first position control rollers 13, wire-rod-drawing-out rollers 14, a wire rod tension mechanism 15 and second position control rollers 16 are provided at a downstream side of the drum 12.

The position control rollers 13 are configured to have an upper roller 13*a* and a lower roller 13*b* and are set near a peak of the cone-line part of the drum 12. The wire rod 1 is made passed through between the upper roller 13*a* and the lower roller 13*b*. The position control rollers 13 are configured to control a drawn position of the wire rod 1 drawn out of the drum 12.

The wire-rod-drawing-out rollers 14 are configured to have an upper roller 14*a* and a lower roller 14*b* and are set at an upstream side of the wire rod tension mechanism 15. The wire rod 1 is made passed through between the upper roller 14*a* and the lower roller 14*b*. The wire-rod-drawing-out rollers 14 operate to draw the wire rod 1 out of the drum 12.

The wire rod tension mechanism 15 is configured to have a tension roller 15*a*, a driving arm 15*b* and a driving portion 15*c* and is set at a downstream side of the wire-rod-drawing-out rollers 14. The tension roller 15*a* is attached to the driving arm 15*b*. The tension roller 15*a* is driven by the driving portion 15*c* and operates to apply any tension to the wire rod 1 drawn out of the drum 12. The driving portion 15*c* operates to apply an operating force to the tension roller 15*a* based on a tension control signal S15. For the driving portion 15*c*, a solenoid, not shown, is used. It is because the wire rod 1 is prevented from being loose between the drum 12 and the coil-forming mechanism 20 to apply any tension to the wire rod 1.

The position control rollers 16 are set at a downstream side of the tension roller 15*a*. The position control rollers 16 are configured to have an upper roller 16*a* and a lower roller 16*b* and control an insertion position of the wire rod 1 for inserting it into the coil-forming mechanism 20. The peripheral mechanism between the wire rod cartridge 10 and the coil-forming mechanism 20 is configured by them.

Figure 35:
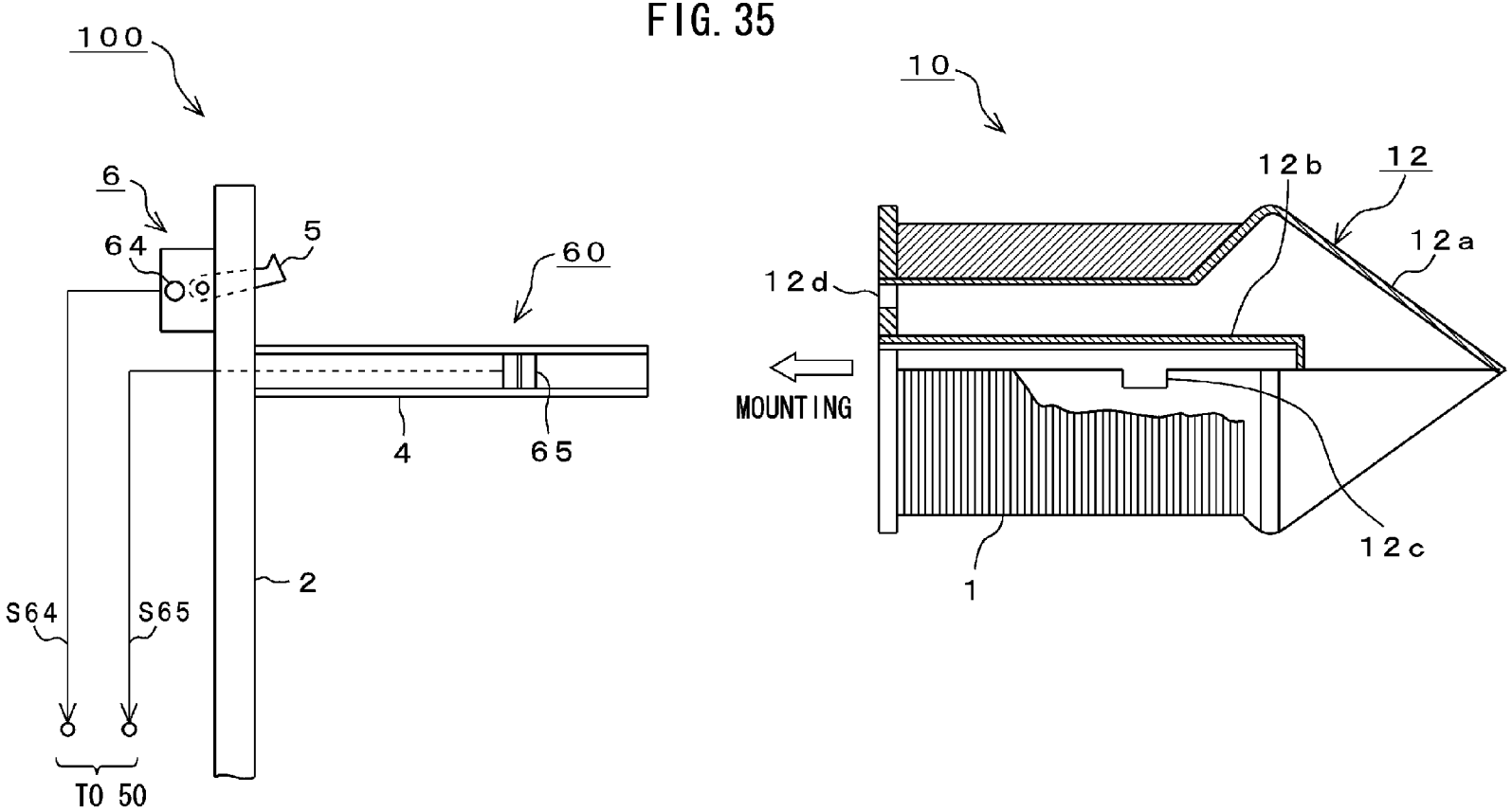
FIG. 35 is a diagram showing a mounting example of the wire rod cartridge 10.

A description will be given of a mounting example of the wire rod cartridge 10 with reference to FIG. 35. To the wire rod cartridge 10 shown in FIG. 35, the one having the drum 12 is applied on which the wire rod is wound so as to be multi-layered and formed in line with it keeping a predetermined pitch. In this example, the mounting is performed so that the winding shaft 12*b* of the wire rod cartridge 10 and the sensor case portion 4 of the wire rod detection sensor unit 60 are aligned and the winding shaft 12*b* covers the wire rod detection sensor unit 60.

At this moment, when the lock portion 5 of the lock mechanism 6 installed in a side of the paper-sheet-handling apparatus 100 is inserted into the opening 12*d* of the bobbin 12*a* and the sensor case portion 4 is inserted into the wire rod cartridge 10. Thus, the lock portion 5 locks the wire rod cartridge 10 and the light-emitting element and the light-receiving element of the wire rod detection sensor 65 are disposed so as to face the window portions 12*c* of the bobbin 12*a* and the winding shaft 12*b*.

This enables the wire rod detection sensor unit 60 in a side of the paper-sheet-handling apparatus 100 to be set inside the winding shaft 12*b* of the wire rod cartridge 10. By using the wire rod detection sensor 65 of the wire rod detection sensor unit 60, it is possible to detect whether there is the wire rod 1 wound on the bobbin 12*a* or not.

Figure 36A:
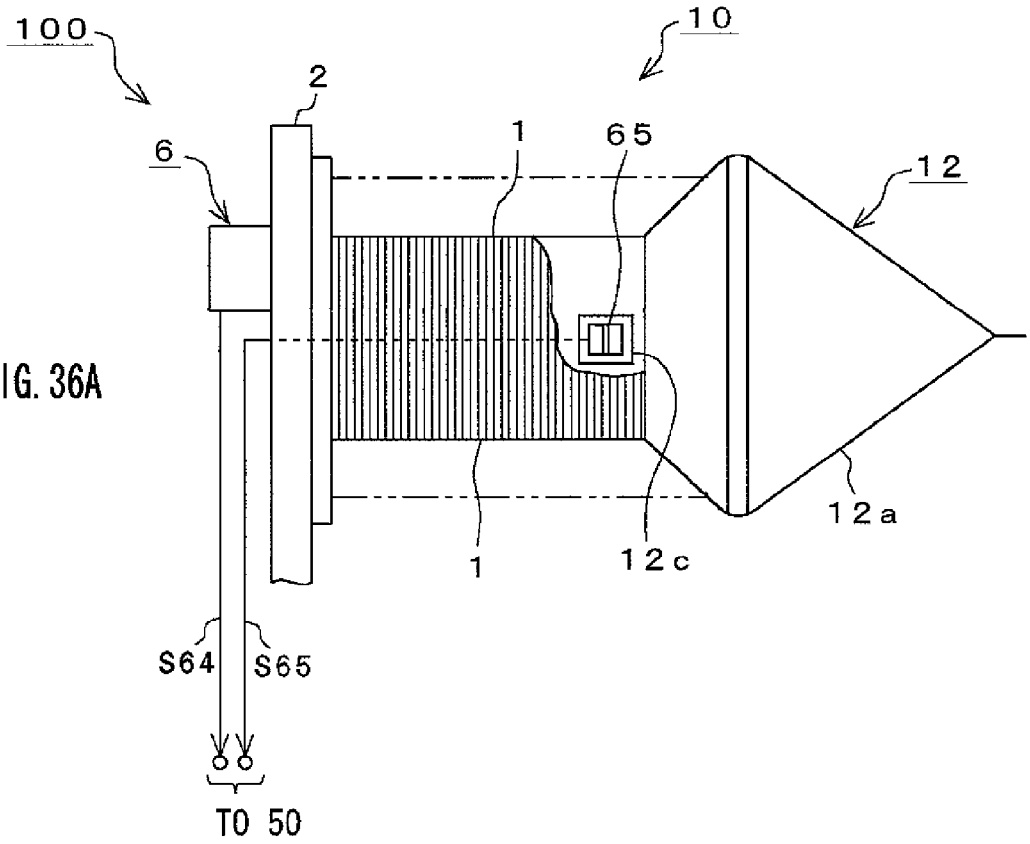
FIG. 36A is a partially broken front view showing a detection example of the wire rod in the wire rod cartridge 10 when the wire rod is present thereon.
Figure 36B:
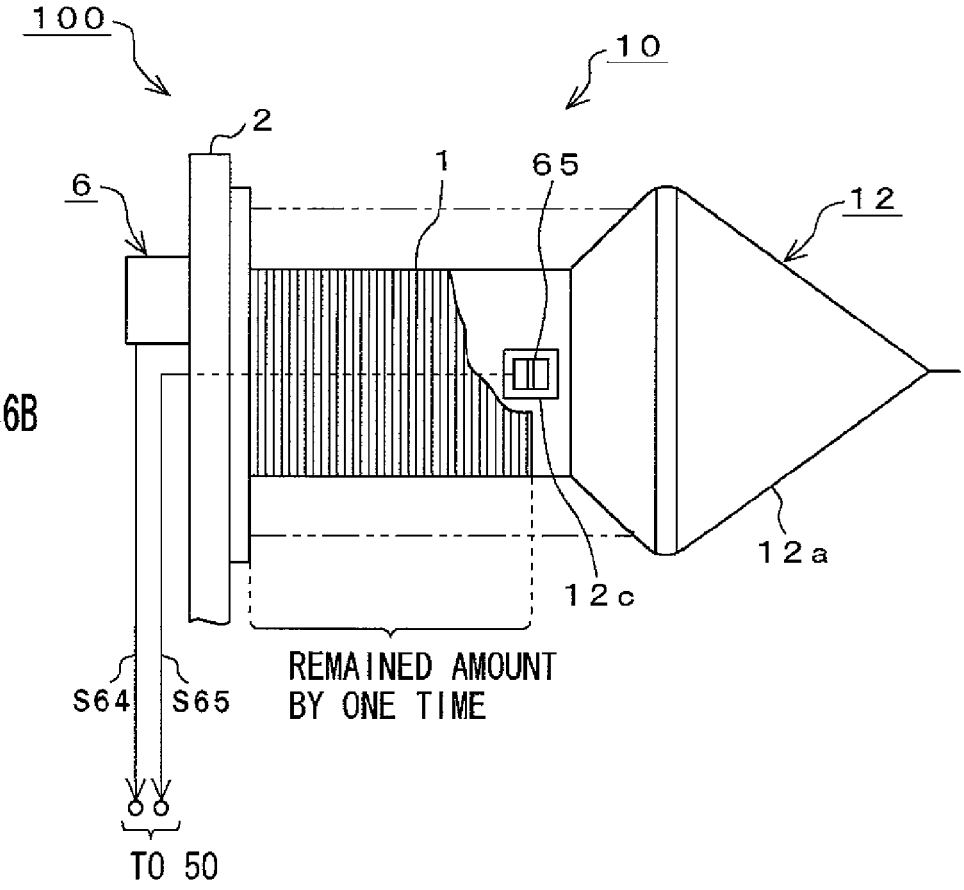
FIG. 36B is a partially broken front view showing a detection example of the wire rod in the wire rod cartridge 10 when the wire rod is not present thereon.

A description will be given of function examples of the wire rod detection sensor 65 in the wire rod cartridge 10 with reference to FIGS. 36A and 36B.

According to the wire rod detection sensor 65 shown in FIG. 36A, it is designed that when there is the wire rod 1 on the drum 12, the wire rod detection signal (on signal) S65 of high level (hereinafter, referred to as "H level") is output. In this case, for example, a state is such that the wire rod 1 is wound on the bobbin 12*a* so as to be layered more than one layer and formed in line with it keeping a predetermined pitch without any space and the window portion 12*c* of the bobbin 12*a* is covered by the wire rod 1. Under this state, light emitted from the light-emitting element of the wire rod detection sensor 65 is reflected by the wire rod 1 over the window portion 12*c* and is made incident onto the light-receiving element. Thus, the wire rod detection sensor 65 is kept on and keeps on outputting the wire rod detection signal S65 of H level.

According to the wire rod detection sensor 65 shown in FIG. 36B, it is designed that when there is no wire rod 1 on the drum 12, the wire rod detection signal S65 of low-level (hereinafter, referred to as "L level") is output. In this case, a state is such that the wire rod 1 has been wound on the bobbin 12*a* so as to be layered by one layer but the wire rod 1 is progressively consumed so that there is no wire rod 1 stayed over the window portion 12*c* to expose the window portion 12*c*. Under this state, light emitted from the light-emitting element of the wire rod detection sensor 65 releases outside from the window portion 12*c* so that the light is not made incident onto the light-receiving element. Thus, it is configured that the wire rod detection sensor 65 is made off and outputs the wire rod detection signal S65 of L level. It is to be noted that logic of the signal showing whether there is the wire rod or not by the wire rod detection signal S65 may be reversal signals, for example, S65 of L level and S65 of H level.

In this example, a position at which the wire rod detection sensor 65 is installed may be preferably set to a part that can detect a state where a wire rod remains by a length such that the spiral coil 11*c* having maximum diameter of the coil that can be formed by the coil-forming mechanism 20 and having the length same as that of a width of paper-sheet can be formed. Although a used amount of the wire rod 1 is different based on the diameters of the coils, when such a position is set thereto, it is possible to prevent the wire rod 1 from being interrupted on the way of forming the coil and the binding processing from being suspended even if the wire rod 1 having a length such that the spiral coil 11*c* by one time can be formed remains on the drum 12.

Such a configuration of the wire rod detection sensor unit 60 enables a wire rod residual quantity display system to display that there is the wire rod 1 on the drum 12 by, for example, the wire rod detection signal S65 of H level outputted from the wire rod detection sensor 65. On the contrary, it enables the wire rod residual quantity display system to display that there is no wire rod 1 on the drum 12 by the wire rod detection signal S65 of L level outputted from the wire rod detection sensor 65.

A description will be given of another disposition example of the wire rod cartridge 10 and another wire rod detection sensor 65'.

In this example, a case is such that the wire rod cartridge 10 is disposed at a position that is perpendicular to the coil-forming mechanism 20 and the wire rod 1 drawn out of the wire rod cartridge 10 is guided so that the advanced direction thereof is bent by 90 degrees. Such a disposition of the wire rod cartridge 10 enables the paper-sheet-handling apparatus 100 to be designed so as to be vertically oriented.

Figure 34:
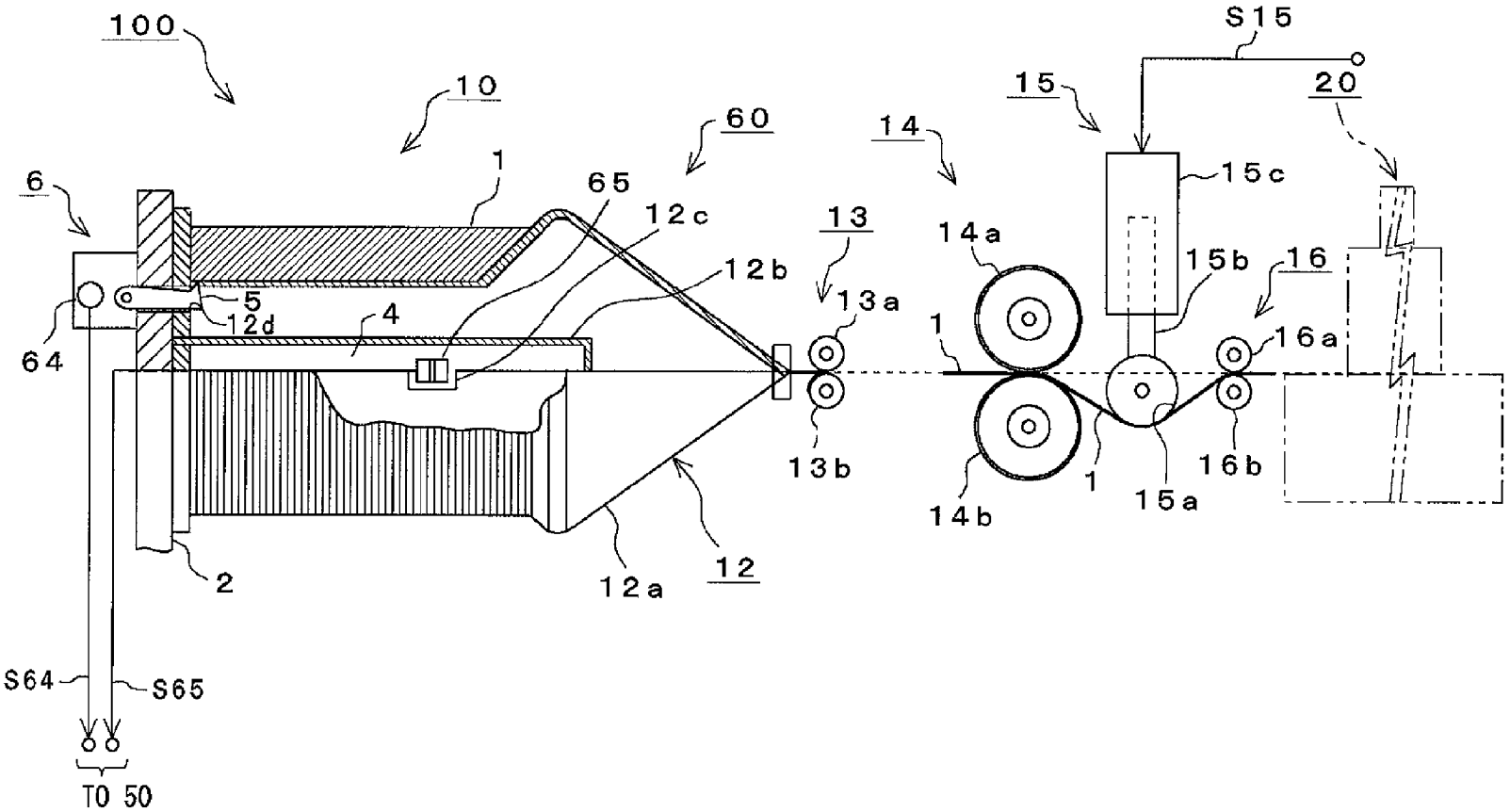
FIG. 34 is a partially broken sectional view showing a configuration example of a wire rod cartridge 10 and its peripheral mechanism.

Further, although a case in which the wire rod detection sensor unit 60 shown in FIG. 34 is provided in the drum 12 has been described, it is not limited thereto: a case in which it is provided outside the drum 12 is preferable. For example, the wire rod detection sensor 65' is disposed on the wire rod tension mechanism 15 provided between the drum 12 and the coil-forming mechanism 20.

Figure 37:
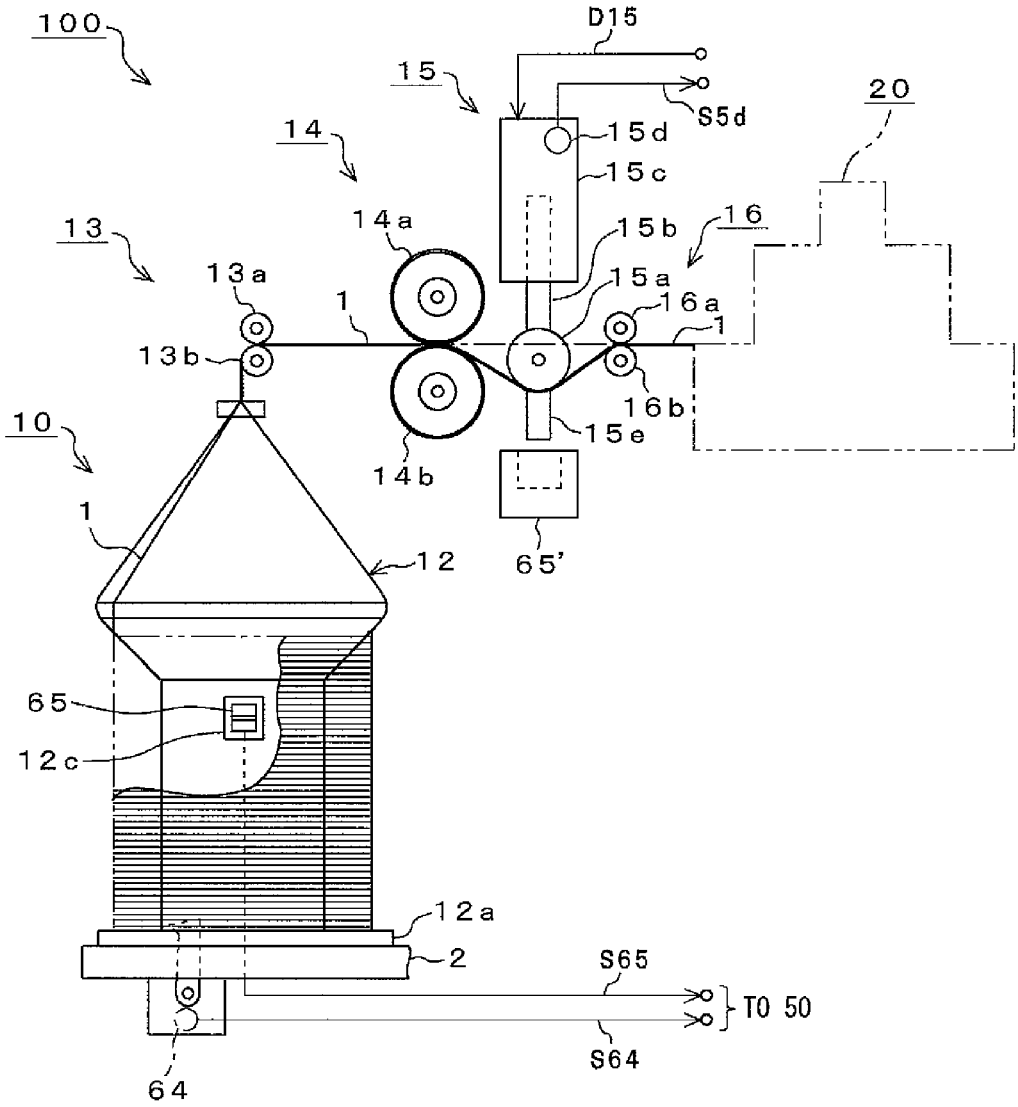
FIG. 37 is a diagram showing another disposition example of the wire rod cartridge 10 and a configuration example of another wire rod detection sensor 65'.

The wire rod detection sensor 65' shown in FIG. 37 functions as the detection part and is added to the wire rod tension mechanism 15. This wire rod detection sensor 65' is constituted of a switching element that detects whether or not any tension is applied to the wire rod 1 drawn out of the drum 12 to output a wire rod detection signal S65'. For the wire rod detection sensor 65', an optical sensor of transmission type is used.

In this example, a lower part of the driving arm 15*b* of the wire rod tension mechanism 15 shown in FIG. 34 is elongated and this elongated part is formed as a light shield portion 15*e* to the wire rod detection sensor 65'. The wire rod detection sensor 65' is disposed at a predetermined position under the wire rod tension mechanism. For example, it is disposed at a lower part of the light shield portion 15*e* of the elongated driving arm 15*b*. Such a configuration of the wire rod detection sensor 65' may detect whether or not there is the wire rod 1 drawn out of the drum 12 based on the tension (reactive force) of the wire rod in a wire-rod-carrying path.

Figure 38A:
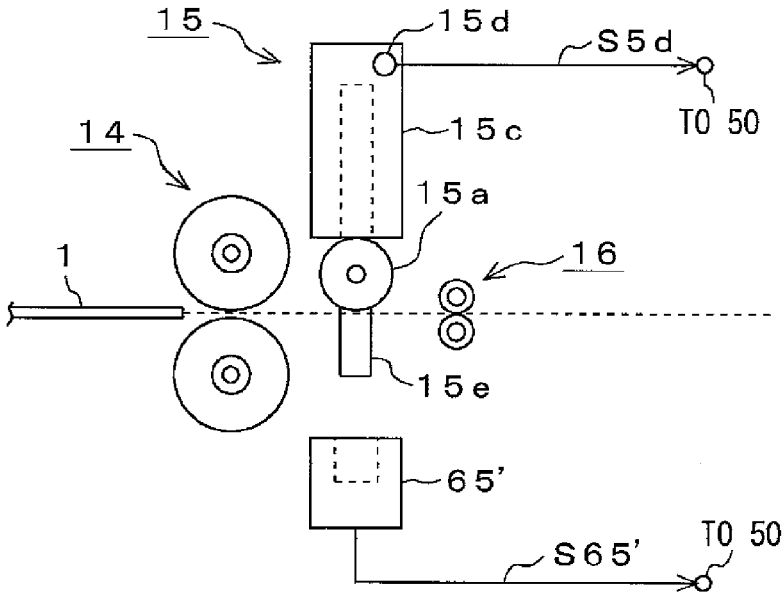
FIG. 38A is a block diagram showing a detection example of the wire rod in a wire rod tension mechanism 15 when a tension roller stays at an uppermost position thereof.

A description will be given of a function example of the wire rod detection sensor 65' with reference to FIGS. 38A to 38C. The wire rod tension mechanism 15 shown in FIG. 38A is a case where the tension roller 15*a* stays at its uppermost position (home position). In this case, a home position sensor (hereinafter, referred to as "HP sensor 15*d*") provided at the wire rod tension mechanism 15 is made off to output, for example, an off signal S5*d* of L level. At this moment, the wire rod detection sensor 65' is made on to output, for example, a wire rod detection signal S65' of H level.

Figure 38B:
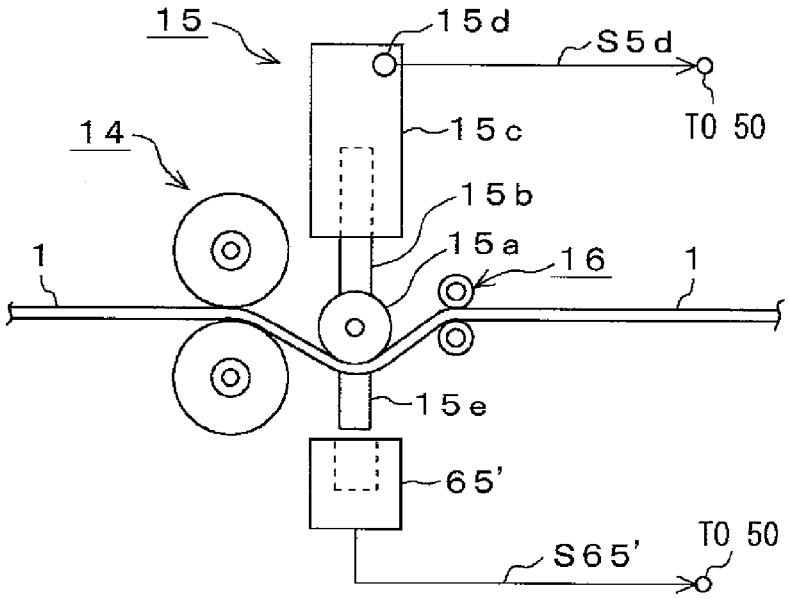
FIG. 38B is a block diagram showing a detection example of the wire rod in the wire rod tension mechanism 15 when the tension roller presses.

The wire rod tension mechanism 15 shown in FIG. 38B is a case where any tension is applied to the wire rod 1 through the driving portion 15*c* and the tension roller 15*a*. In this case, the tension roller 15*a* is balanced by the reactive force from the wire rod 1. In this case, the HP sensor 15*d* is made on to output, for example, an on signal S5*d* of H level. At this moment, the wire rod detection sensor 65' is remained on to keep on outputting the wire rod detection signal S65' of H level.

Figure 38C:
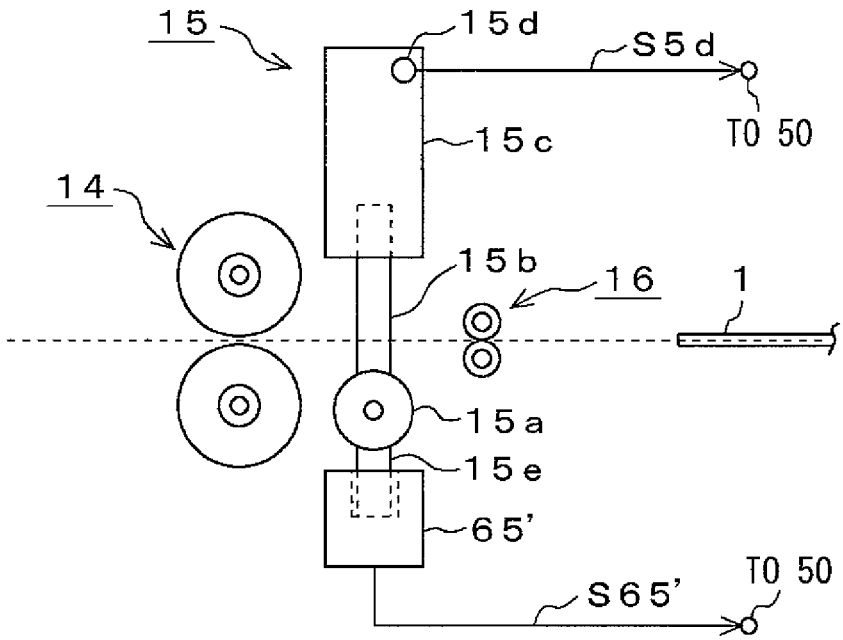
FIG. 38C is a block diagram showing a detection example of the wire rod in the wire rod tension mechanism 15 when the tension roller stays at a lowermost position thereof.

FIG. 38C is a case where there is no wire rod 1 and the driving portion 15*c* makes the tension roller 15*a* fall down to its lowermost position. In this case, it is configured that the HP sensor 15*d* is made on but the light shield portion elongated from the driving arm 15*b* shields the light from the wire rod detection sensor 65' because of no reactive force from the wire rod 1. Thereby, the wire rod detection sensor 65' is made off to output a wire rod detection signal S65' of L level.

Thus, by the wire rod cartridge 10 according to this invention, when the spiral coil 11 is formed from the wire rod 1 having a predetermined thickness and the paper-sheets are bundled and bound by the coil, the wire rod detection sensor 65 provided at the wire rod detection sensor unit 60 and the wire rod detection sensor 65' provided at the wire rod tension mechanism 15 detect whether or not there is the wire rod 1 wound on the drum 12 of the wire rod cartridge 10 that is mounted on the paper-sheet-handling apparatus 100.

Therefore, it is possible to read whether there is the wire rod 1 on the drum 12 using an electric signal. In the above-mentioned example, it is designed that by the wire rod detection signal S65 of L level output from the wire rod detection sensor 65, the on signal S5*d* of H level of the HP sensor 15*d* and the wire rod detection signal S65' of L level, it is made possible to acknowledge (notice) that there is no wire rod 1. This enables the coil-forming system, the binding system, the wire-rod-existence-and-nonexistence-displaying system or the like in the control system in the paper-sheet-handling apparatus 100 on which the wire rod cartridge 10 is mounted to be controlled based on the wire rod detection signal S65 or S65' output from the wire rod detection sensor 65 or 65'.

Figure 39:
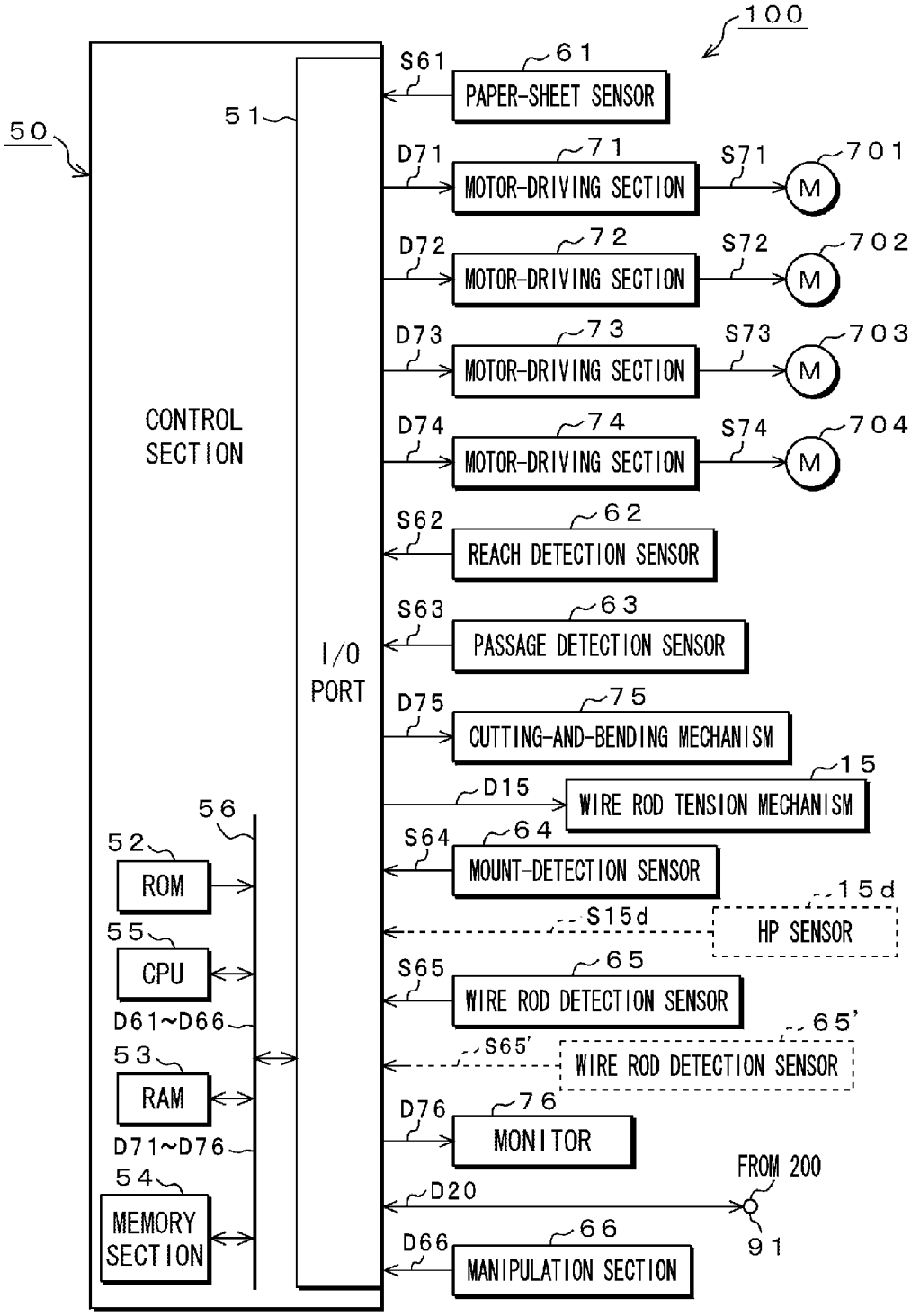
FIG. 39 is a block diagram showing a configuration example of a control system for the paper-sheet-handling apparatus 100.

The following will describe a configuration example of a control system of the paper-sheet-handling apparatus 100 with reference to FIG. 39. The paper-sheet-handling apparatus 100 shown in FIG. 39 is configured to have a control section 50, a paper-sheet sensor 61, a reach detection sensor 62, a passage detection sensor 63, the wire rod detection sensor 65, a manipulation section 66, motor-driving sections 71 through 74, the cutting-and-bending mechanism 75 and a monitor 76.

The control section 50 is configured to have an Input/Output (I/O) port 51, a Read Only Memory (ROM) 52, a Random Access Memory (RAM) 53 for working, a memory section 54, a Central Processing Unit (CPU) 55 and a system bus 56.

The ROM 52 is connected to the CPU 55 via the system bus 56 and stores program data D52 for booting up the system that controls whole of the apparatus. The RAM 53 is connected to the CPU 55 via the system bus 56. It is designed that the RAM 53 temporarily stores program data D52, control commands when performing the binding processing based on various kinds of the diameters of the coils, and the like. It is configured that if a power supply is actuated, the CPU 55 reads the program data D52 out of the ROM 52 and extract it on the RAM 53, thereby booting up the system to control whole of the apparatus.

It is configured that to the system bus 56, in addition to the above-mentioned ROM 52, RAM 53 and CPU 55, the memory section 54 is connected and stores paper-sheet detection data D61, forward end detection data D62, forward-end-passage data D63, mounting-detection data D64, wire rod detection data D65, manipulation data D66, motor control data D71 through D75, D74, display data D76 and the like, in addition to any control data D20. For the memory section 54, Electric Erasable Program Read Only Memory (EEPROM) or Hard Disk Drive (HDD) is used.

The memory section 54 stores any control programs for the binding mechanism 40 or the like. In this example, when the system boots up, the CPU 55 reads the control programs out of the memory section 54 and extract them on the RAM 53. In the above-mentioned control programs, reference values for deciding a size of the spiral coil 11 based on a number of paper-sheets are set.

For example, as the reference values, the numbers of paper-sheets 40, 70, 100 and the like in the bundle of paper-sheets 3 are set. The memory section 54 stores setting data of the section #Ø8 like an arc of a circle for forming the diameter of coil of 8 mm in response to the number of paper-sheets 40 in the bundle of paper-sheets 3. It also stores setting data of the section #Ø11 like an arc of a circle for forming the diameter of coil of 11 mm in response to the number of paper-sheets 70 in the bundle of paper-sheets 3. It further stores setting data of the section #Ø14 like an arc of a circle for forming the diameter of coil of 14 mm in response to the number of paper-sheets 100 in the bundle of paper-sheets 3.

The CPU 55 reads the setting data corresponding to the thickness of the bundle of paper-sheets 3 and controls a selection mechanism 28'. In this example, the CPU 55 decides the diameter of the spiral coil 11 to be used based on these reference values and the information of the number of paper-sheets in the control data D20. The control data D20 is received from any high-ranking image-forming apparatus or the like.

The manipulation section 66 is connected to the CPU 55, via the I/O port 51, and is manipulated when starting up the binding process. In this example, two functions of a case where the paper-sheet-handling apparatus is solely managed and used (hereinafter, referred to as "manual mode") and a case where it comes under the control of the image-forming apparatus 200 such as a copy machine and a printer and integrally managed by any high ranking control system (hereinafter, referred to as "finisher mode") are provided.

When performing the coil-binding processing in the manual mode, the manipulation section 66 is manipulated so as to output the manipulation data D66 on setting of the diameter of the coil, boot-up command and the like to the CPU 55 via the I/O port 51. As the diameter of the coil, any one of the sections #Ø8, #Ø11 and #Ø14 each like an arc of a circle is selected in response to the thickness of the bundle of paper-sheets 3 (second embodiment).

When the paper-sheet-handling apparatus 100 performs the coil-binding processing in the finisher mode, the control data D20 such as information on the numbers of paper-sheets and information on a transfer report of paper-sheets is received from the high ranking control system. The paper-sheet-handling apparatus 100 has an input/output terminal 91. The input/output terminal 91 is connected to the I/O port 51. The above-mentioned image-forming apparatus 200 is connected to the input/output terminal 91. It is configured that the paper-sheet-handling apparatus 100 detects, for example, the number of paper-sheets from the control data D20 and automatically selects any of the diameters of the coils of 8 mm, 11 mm and 14 mm, which corresponds to the number of paper-sheets to set any one of the sections #Ø8, #Ø11 and #Ø14 each like an arc of a circle, so that the spiral coil 11 can be formed on the basis of the section #Ø8 like an arc of a circle or the like.

The paper-sheet sensor 61 is connected to the I/O port 51. The paper-sheet sensor 61 outputs to the I/O port 51*a* paper-sheet-existence-or-nonexistence signal S61 obtained by detecting whether or not the bundle of paper-sheets 3 is mounted on the binding mechanism 40. The I/O port 51 is provided with an analog to digital converter, not shown, which converts the paper-sheet-existence-or-nonexistence signal S61 to the paper-sheet detection data D61. The paper-sheet detection data D61 is output from the I/O port 51 to the CPU 55 of the control section 50. The CPU 55 controls the coil-forming part 28 and the binding mechanism 40 after it has checked that there is the wire rod 1 on the wire rod cartridge 10.

In this example, a paper-sheet thickness detection sensor having a function to detect a thickness of the bundle of paper-sheets 3 may be applied to the paper-sheet sensor 61. For example, the paper-sheet thickness detection sensor is configured such that light-shielding slits are provided at predetermined position of the arm of the paper-sheet clamp 45 and plural optical sensors of transmission type for detecting cases where the bundle of paper-sheets 3 includes 40 sheets or less, 70 sheets or less and 100 sheets or less are disposed thereon.

The mount-detection sensor 64 is connected to the I/O port 51 and detects whether or not the wire rod cartridge 10 is mounted on the paper-sheet-handling apparatus 100 to output the mount-detection signal S64. The mount-detection signal S64 is converted to the mount-detection data D64 in the I/O port 51. The mount-detection data D64 is output from the I/O port 51 to the CPU 55. The mount-detection sensor 64 outputs, for example, the mount-detection data D64 of H level when the wire rod cartridge 10 is mounted thereon and outputs the mount-detection data D64 of L level when the wire rod cartridge 10 is not mounted thereon.

The wire rod detection sensor 65 other than the mount-detection sensor 64 is connected to the I/O port 51 and detects whether there is the wire rod 1 wound on the drum 12 or not to output the wire rod detection signal S65. The wire rod detection signal S65 is converted to the wire rod detection data D65 in the I/O port 51. The wire rod detection data D65 is output from the I/O port 51 to the CPU 55. The wire rod detection sensor outputs, for example, the wire rod detection data D65 of H level when the wire rod remains and outputs the wire rod detection data D65 of L level when the wire rod does not remain.

The monitor 76 constituting an example of the display part other than the paper-sheet sensor 61, the mount-detection sensor 64 and the wire rod detection sensor 65 is connected to the I/O port 51. The CPU 55 receives the paper-sheet detection data D61, the mount-detection data D64 and the wire rod detection data D65 to control a display on the monitor 76. For example, the monitor 76 displays a message such that "the bundle of paper-sheets 3 is not mounted on the binding mechanism 40" based on the paper-sheet detection data D61. The monitor also displays a message such that "the wire rod cartridge 10 is not mounted" based on the mount-detection data D64 of L level. The monitor 76 further displays whether or not there is the wire rod 1 on the drum 12 based on the wire rod detection data D65.

In this example, it displays character information or the like for promote the mounting of the wire rod cartridge 10 based on the mount-detection data D64 of L level or displays character information or the like for promote the exchange of the wire rod cartridge 10 based on the wire rod detection data D65 of L level when the wire rod does not remain. This allows any shorts of the wire rod 1 (consumables) to be known through the mediation of no person (mechanically).

The CPU 55 is connected to the I/O port 51 to which the motor-driving sections 71 through 74 are connected. The CPU 55 decides the diameter of the spiral coil 11 to be used on the basis of the above-mentioned reference values and the information on the number of the paper-sheets in the control data D20 and then, controls the drives of the motor-driving sections 71 through 74 based on the decided result thereof.

In the motor-driving section 71 connected to the above-mentioned I/O port 51, from the three sections #Ø8, #Ø11 and #Ø14 each like an arc of a circle in the forming adaptor 28*a* of the coil-forming mechanism 20, any one section like an arc of a circle corresponding to the thickness of the bundle of paper-sheets is selected on the basis of the motor control data D71.

For example, the motor 701 is connected to the motor-driving section 71. The motor-driving section 71 generates a motor control signal (voltage) S71 from the motor control data D71 and outputs the motor control signal S71 to the motor 701. The motor 701 rotates counter-clockwise based on the motor control signal S71 to rotate the forming adaptor 28*a* for setting the diameter of the coil and select the semi-circle cut-away section #Ø8 like an arc of a circle or the like. The motor control data D71 is output from the control section 50 to the motor-driving section 71.

The motor-driving section 73 other than the motor-driving section 71 is connected to the I/O port 51 and sets the position of the spiral coil 11 in the binding mechanism 40 based on the motor control data D73. For example, the motor 703 is connected to the motor-driving section 73. The motor-driving section 73 generates a motor control signal (voltage) S73 from the motor control data D73 and outputs the motor control signal S73 to the motor 703. The motor 703 rotates the guide-switching cam 34*b* counter-clockwise to move the screw guide 49 to the direction that is perpendicular to the advanced direction of the coil. This movement is because the screw guide 49 is set corresponding to the diameter of the coil. The motor control data D73 is output from the control section 50 to the motor-driving section 73.

In this example, when the control data D20 from the high ranking control system indicates the setting of the position of the spiral coil 11*a* having the small diameter, the CPU 55 at least controls the feed roller 31 to move by the first distance d1 to the vertical direction and controls the screw guide 49 to move by the first distance d1' to a direction in which it comes close to the punched holes 3*a* of the bundle of paper-sheets 3.

When the control data D20 indicates the setting of the position of the spiral coil 11*b* having the middle diameter, it controls the feed roller 31 to move by the second distance d2 to the vertical direction and controls the screw guide 49 to move by the second distance d2' to a direction in which the guide comes close to the punched holes 3*a* of the bundle of paper-sheets 3. When the control data D20 indicates the setting of the position of the spiral coil 11*c* having the large diameter, it controls the feed roller 31 to move by the third distance d3 to the vertical direction (d1>d2>d3). At the same time thereof, the CPU 55 controls the screw guide 49 to move by the third distance d3' to a direction in which it comes close to the punched holes 3*a* of the bundle of paper-sheets 3 (d1'>d2'>d3'). This enables the positions of the feed roller 31 and the screw guide 49 to be adjusted after the clamping by the binding mechanism 40 based on the motor control data D73 (see FIG. 16B).

The motor-driving section 72 other than the motor-driving sections 71, 73 is connected to the I/O port 51 and rotates the upper and lower dispatching rollers 23*a*, 23*b* of the coil-forming mechanism 20 based on the motor control data D72. For example, the motor 702 is connected to the motor-driving section 72. The motor-driving section 72 generates a motor control signal (voltage) S72 from the motor control data D72 and outputs the motor control signal S72 to the motor 702. The motor 702 rotates counter-clockwise to rotate the lower dispatching roller 23*b* clockwise through the lower large diameter gear 24*b* and to rotate the upper dispatching roller 23*a* counter-clockwise through the large diameter gear 24*a*. The motor control data D72 is output from the control section 50 to the motor-driving section 72.

It is to be noted that the wire rod tension mechanism 15 is connected to the I/O port 51 and outputs tension control data D15 to the driving portion 15*c* thereof. The driving portion 15*c* controls the tension roller 15*a* based on the tension control data D15. The HP sensor 15*d* is provided in the wire rod tension mechanism 15 in response to the setting of the wire rod detection sensor 65 or 65'. When the wire rod detection sensor 65' is installed in the paper-sheet-handling apparatus 100, the HP sensor 15*d* and the wire rod detection sensor 65' are connected to the I/O port 51. It is configured that the HP sensor 15*d* outputs the on/off signal S5*d* to the I/O port 51 of the control section 50. In the I/O port 51, the on/off signal S5*d* is converted from analog to digital to become on/off data D5*d* which is output to the CPU 55.

The motor-driving section 74 other than the motor-driving sections through 73 is connected to the I/O port 51. The motor-driving section generates a motor control signal (voltage) S74 from the motor control data D74 and outputs the motor control signal S74 to the motor 704. The motor 704 rotates the spiral coil 11 in the binding mechanism 40 based on the motor control signal S74. For example, the motor 704 rotates the feed roller 31 counter-clockwise to rotate the spiral coil 11 clockwise. The motor control data D74 is output from the control section 50 to the motor-driving section 74.

In this example, the CPU 55 controls the binding speed of the spiral coil 11 by setting a rotation speed V1 of the spiral coil 11 dispatched from the coil-forming part 28 and a rotation speed V2 of the spiral coil 11 in the binding mechanism 40 to be V1·V2. The rotation speed V1 is set in the motor-driving section 73 via the motor control data D73. The motor-driving section 73 controls the motor 703 in the coil-forming mechanism 20 to be the rotation speed V1 based on the motor control data D73.

The rotation speed V2 is set in the motor-driving section 74 via the motor control data D74. The motor-driving section 74 controls the motor 704 in the binding mechanism 40 to be the rotation speed V2 based on the motor control data D74. When the rotation speeds V1, V2 are thus set to be V1≤V2, it is possible to insert the spiral coil 11 smoothly so that the forward end of the spiral coil 11 inserted into a punched hole at an end of the bundle of paper-sheets 3 can reach a punched hole at the other end of the bundle of paper-sheets 3 without any jam on its way.

The reach detection sensor 62 constituting a function of a first detection part is connected to the I/O port 51. The reach detection sensor detects reaching of the forward end of the spiral coil 11 in the binding mechanism 40 and outputs a forward end detection signal S62. The forward end detection signal S62 is converted to the forward end detection data D62 in the I/O port 51. The forward end detection data D62 is output from the I/O port 51 to the CPU 55.

The CPU 55 controls the motor-driving section 73 based on the forward end detection data D62 received from the I/O port 51. If such a reach detection sensor 62 is disposed in the binding mechanism 40, it is possible to carry out any stop control of the coil carriage when the forward end of the spiral coil 11 inserted into a punched hole at one end of the bundle of paper-sheets 3 reaches to the other end of the bundle of paper-sheets 3.

In this example, the passage detection sensor 63 constituting a function of a second detection part other than the reach detection sensor is connected to the I/O port 51 and detects a passage of the forward end of the spiral coil 11 to output a forward-end-passage signal S63. The forward-end-passage signal S63 is converted to forward-end-passage data D63 in the I/O port 51. The forward-end-passing data D63 is output from the I/O port 51 to the CPU 55. The CPU 55 controls the motor-driving section 74 based on the forward-end-passage data D63 received from the I/O port 51. It is to be noted that in connection with the detection of the passage of the forward end of the spiral coil 11, a dispatched amount thereof may be detected by a number of revolution of the motor 704.

If such a passage detection sensor 63 is disposed in the binding mechanism 40, it is possible to carry out any slow-down control of the coil carriage before the forward end of the spiral coil 11 inserted into a punched hole at one end of the bundle of paper-sheets 3 has reached the other end of the bundle of paper-sheets 3.

The cutting-and-bending mechanism 75 other than the motor-driving sections 71 through 74 is connected to the I/O port 51 and operates to cut the spiral coil 11 in the binding mechanism 40 based on the cut control data D75. For example, it is configured that a motor, not shown, is provided in the cutting-and-bending mechanism 75 and the motor rotates to a predetermined direction so that the cutter can operate to cut the coil and bend the forward end and a tail end thereof. The cut control data D75 is output from the control section 50 to the cutting-and-bending mechanism 75.

Thus, in the paper-sheet-handling apparatus 100, the coil-forming device according to the invention is provided and the coil pitch of the spiral coil 11 may be limited so as to be a fixed pitch thereof when the bundle of paper-sheets 3 having a predetermined thickness is bound and the spiral coil 11 is formed from the wire rod 1 having a predetermined thickness. Thus, it is possible to dispatch the spiral coil 11 having no changed pitch even if the diameter of the coil changes with good reproducibility.

In the binding mechanism 40, the bundle of paper-sheets 3 is bound by the spiral coil 11*a* or the like having a predetermined diameter of the coil and a fixed pitch, which is obtained from the coil-forming part 28. Accordingly, it is possible to select the spiral coil 11 having a desired diameter of the coil corresponding to the thickness when the pitch between the punched holes of the paper-sheet P is the same and the thicknesses of the bundles of paper-sheets 3 are different so that the binding processing using the spiral coil 11 may be performed with good reproducibility. This enables to be provided the finisher 100' to which a coil-forming device having a simple configuration is applied.

Further, the configuration of the coil-forming part 28 may be made simplified so that the whole of system may be made compact. The sections each like an arc of a circle are automatically switched so that it can be also used together with the image-forming device 200 and any general office equipment such as a printer.

Further, according to the paper-sheet-handling apparatus 100, it is configured that the control section 50 that inputs diameter-of-coil-setting information for setting the diameter of the coil is provided and it controls the positions of the movable feed roller 31 and the screw guide 49 at a moving adjustable side based on the diameter-of-coil-setting information.

Accordingly, it is possible to move the feed roller 31 and the screw guide 49 at a moving adjustable side to the guided position of the spiral coil 11*a* or the like indicated by the diameter-of-coil-setting information. This enables the spiral coil 11*a*, 11*b* or 11*c* having different diameter 8 mm, 11 mm or 14 mm to pass through the punched holes 3*a* of the bundle of paper-sheets 3 stably.

Further, according to the paper-sheet-handling apparatus 100, the paper-sheet-attaching pin 46*d* that limits to align the forward ends of respective paper-sheets in the bundle of paper-sheets 3 mounted on the paper-sheet-mounting base 46 and the paper-sheet-aligning guide 41 that limits to align the side edge 3*b* of each of the paper-sheets P, which has been limited by the paper-sheet-attaching pin 46*d*, in the bundle of paper-sheets 3 mounted on the paper-sheet-mounting base 46 are provided. This paper-sheet-aligning guide 41 includes the paper-sheet-aligning surface that has a predetermined inclination with respect to the surface of the paper-sheet-mounting base 46, on which the paper-sheets are mounted, so that the side edge 3*b* of the bundle of paper-sheets 3 is obliquely limited along the inclination of the paper-sheet-aligning surface.

Accordingly, the punched holes 3*a* can be out of line in the bundle of paper-sheets 3 so that it is possible to pass the spiral coil 11 or the like smoothly through the punched holes 3*a* of the bundle of paper-sheets 3, which have been out of line.

Further, according to the paper-sheet-handling apparatus 100, it is configured that the cutting-and-bending mechanism 75 is provided and the end of the spiral coil 11 or the like is pinched and held by the hitting-for-pinching portion 75*a* and the receiving-for-pinching portion 75*b*, and the pinched and held end of the spiral coil 11 is cut and bent to a predetermined direction.

Accordingly, it is possible to dispose the cutting-and-bending mechanism 75 at a position in which the spiral coil 11*a* starts passing through the punched holes 3*a* of the bundle of paper-sheets 3. It is also possible to perform the cutting-and-bending process on the end of the spiral coil 11*a* passed through the punched holes 3*a* thereof surely while the end thereof is held and fixed. This enables to be provided the finisher or the like that realizes a series of steps in processes from the coil-forming process to the coil-cutting process through the coil-binding processing within one case.

Further, on the paper-sheet-handling apparatus 100, the wire rod cartridge 10 according to the invention is mounted so that the CPU 55 can control the coil-forming mechanism 20 and the binding mechanism 40 based on the wire rod detection data D65 obtained from the wire rod detection sensor 65.

Accordingly, it is possible to determine whether or not the binding processing can be continuously performed on the bundle of paper-sheets 3 by the spiral coil 11 as it stands based on the wire rod detection data D65 output from the wire rod detection sensor 65 or to inform a user of the exchange of the wire rod cartridge 10 or the like.

The following will describe a paper-sheet-handling method in an image-forming system 101 according to the invention.

Embodiment 1

Figure 40:
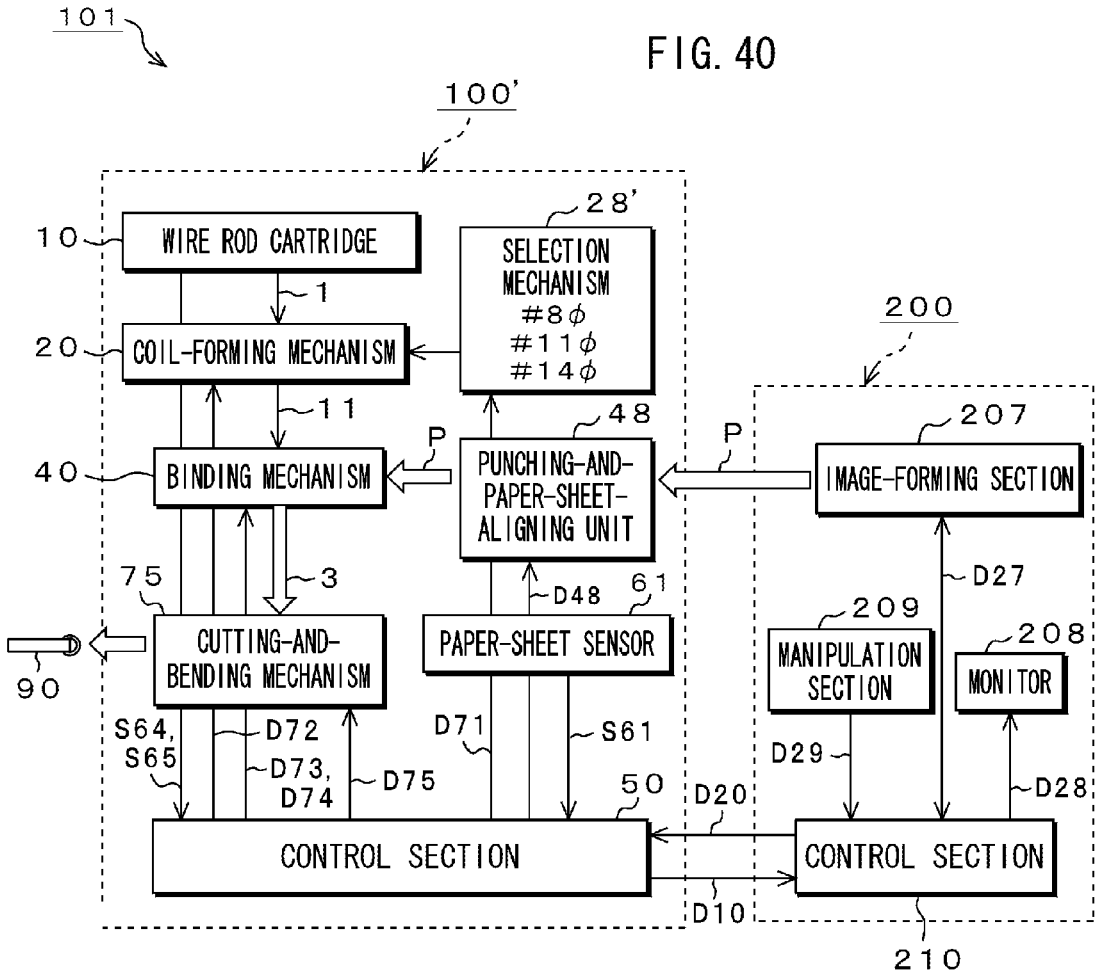
FIG. 40 is a block diagram showing a configuration example of an image-forming system 101 as a first embodiment.

The following will describe a configuration example of an image-forming system 101 as a first embodiment of the invention with reference to FIG. 40. The image-forming system 101 shown in FIG. 40 is provided with the finisher 100' according to the invention and the image-forming apparatus 200 such as copy machine and a printer. This image-forming system 101 is a binding processing system in which the paper-sheets P released from the image-forming apparatus 200 are bundled; the spiral coil 11 is formed from the wire rod 1 having a predetermined thickness; and the bundle of paper-sheets 3 is bound by the coil.

The image-forming apparatus 200 is such that images are formed on the predetermined paper-sheets P to release them. The image-forming apparatus 200 is configured to have an image-forming section 207, a monitor 208, a manipulation section 209 and a control section 210. The image-forming section 207 is such that image control data D27 is received and a black-and-white image and/or a color image are formed on the predetermined paper-sheets P to release them. For the image-forming section 207, an image-forming unit of an electrophotographic system or an ink jet system is used.

The monitor 208 is such that display data D28 is received and image-forming conditions such as a density, a species of the paper-sheet, a number thereof and the like when forming the black-and-white image and/or the color image and existence or nonexistence of the request for the binding processing are displayed. The manipulation section 209 is manipulated so as to set the image-forming conditions and existence or nonexistence of the request for the binding process. Manipulation data D29 set by the manipulation of the manipulation section 209 or the like is output to the control section 210. For the manipulation section 209, numeric keys, a touch panel disposed on the monitor 208 or the like is used.

The control section 210 controls input/output of each of the image-forming section 207, the monitor 208 and the manipulation section 209. For example, the control section 210 receives the manipulation data D29 from the manipulation section 209 and outputs the image control data D27 to the image-forming section 207 to perform the image-forming control or outputs the display data D28 to the monitor 208 to perform the display control.

In this image-forming system 101, the control data D20 is output from the image-forming apparatus 200 to the finisher 100'. The control data D20 includes size information of the paper-sheet, number information of the carried paper-sheets, starting information of the paper-sheet carriage, carrying speed information of the paper-sheets and/or finishing information of the paper-sheet carriage. It is configured that by this control data D20, operation of the finisher 100' is controlled in the image-forming apparatus 200.

The finisher 100' (post-processing apparatus) constitutes a function of the first paper-sheet-handling apparatus and is configured to have the wire rod cartridge 10, the coil-forming mechanism 20, the selection mechanism 28', the binding mechanism 40, a punching-and-paper-sheet-aligning unit 48, the control section 50, the paper-sheet sensor 61 and the cutting-and-bending mechanism 75. The finisher 100' has the function of the paper-sheet-handling apparatus 100 as the embodiment of the invention, which has been described on FIGS. 1 through 39. To the punching-and-paper-sheet-aligning unit 48, the punch-processing unit in the paper-sheet-handling apparatus, which the applicant has formerly filed in Japan (as Japanese Patent Application No. 2005-216562), and the binding-processing unit in the paper-sheet-handling apparatus, which the applicant has then filed in Japan (as Japanese Patent Application No. 2005-222215), can be applied.

In the finisher 100', the wire rod cartridge 10 supplies the wire rod 1 to the coil-forming mechanism 20 and has an attachable and detachable shape with respect to the finisher 100' (see FIG. 1). The selection mechanism 28' receives the control data D20 from the image-forming apparatus 200 and operates to select any one diameter of the coil of 8 mm or the like corresponding to the thickness of the bundle of paper-sheets 3 from the three species of the sections #Ø8, #Ø11 and #Ø14 each like an arc of a circle for setting the diameter of the coil. At this moment, the paper-sheet-existence-or-nonexistence signal S61 obtained by detecting the existence or nonexistence of the bundle of paper-sheets 3 by the paper-sheet sensor 61 may be output to the control section 50 and the control section 50 may select any one diameter of the coil of 8 mm or the like corresponding to the thickness of the bundle of paper-sheets 3 from the three species of the sections #Ø8, #Ø11 and #Ø14 each like an arc of a circle for setting the diameter of the coil.

In the coil-forming mechanism 20, the wire rod 1 is pushed into the section #Ø8 like an arc of a circle or the like selected by the selection mechanism 28' so that the spiral coil 11 becomes formed. In the punching-and-paper-sheet-aligning unit 48, the punched holes 3*a* are perforated for each of the paper-sheets P, in each of which an image has been formed, released from the image-forming apparatus 200 and they are aligned to become the bundle of paper-sheets 3. In the binding mechanism 40, the coil-binding processing is performed on the bundle of paper-sheets 3 aligned in the punching-and-paper-sheet-aligning unit 48 by means of the spiral coil 11 formed by the coil-forming mechanism 20.

In this image-forming system 101, when the spiral coil 11 is formed from the wire rod 1 having a predetermined thickness and the coil-binding processing is performed on the bundle of paper-sheets 3 by the coil 11, a first part step of selecting the section #Ø8, #Ø11 or #Ø14 like an arc of a circle includes a step of detecting the thickness of the bundle of paper-sheets 3 before the binding processing.

Further, before the binding processing, there is provided with a step of selecting any one section #Ø8, #Ø11 or #Ø14 like an arc of a circle corresponding to the thickness of the bundle of paper-sheets 3 from the three species of the sections #Ø8, #Ø11 and #Ø14 each like an arc of a circle for setting a diameter of the coil; a step of pushing the wire rod 1 into the selected section #Ø8, #Ø11 or #Ø14 like an arc of a circle to form the spiral coil 11*a*, 11*b* or 11*c*; and a step of performing the binding processing on the bundle of paper-sheets 3 by the formed spiral coil 11*a*, 11*b* or 11*c*.

Controlling the finisher 100' thus from the image-forming apparatus 200 in the image-forming system 101 allows the diameter of the spiral coil 11 to be automatically selected and allows the automatic coil-binding processing to be performed on the bundle of paper-sheets 3 corresponding to the thickness of the bundle of paper-sheets (fist control method).

Figure 41:
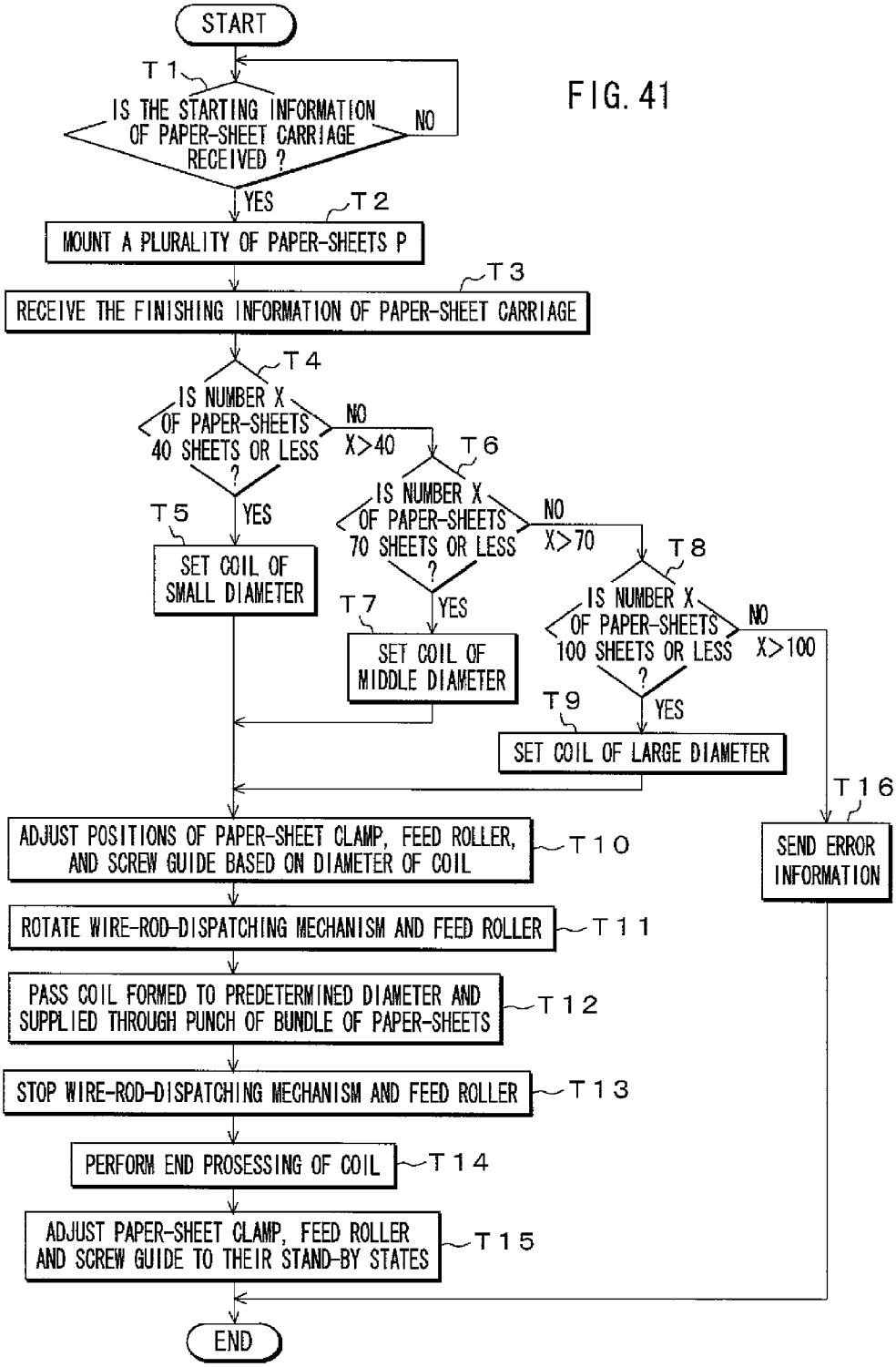
FIG. 41 is a flowchart showing an operation example of the paper-sheet-handling apparatus 100 in the image-forming system 101.

The following will describe an operation example of the finisher 100' in the image-forming system 101 with reference to FIG. 41.

In this embodiment, power is applied to the control section 50 and the CPU 55 reads the control programs out of the memory section 54 to extract it to RAM 53. The CPU 55 controls the binding mechanism 40 to position the feed roller 31 shown in FIG. 20 to its home position HP (stand-by state). To the finisher 100', the control section 210 of the image-forming apparatus 200 such as a printer, which is shown in FIG. 40, is connected. To the coil-forming mechanism 20, the wire rod cartridge 10 on which the wire rod 1 is wound is mounted.

Under a binding-processing condition of them, at a step T1 in a flowchart shown in FIG. 41, the CPU 55 of the finisher 100' determines whether or not the starting information of the paper-sheet carriage to indicate a start of the binding processing is received from the image-forming apparatus 200.

In this embodiment, the CPU 55 receives the control data D20 including the starting information of paper-sheet carriage through the input/output terminal 91 shown in FIG. 39. When receiving no control data D20, the CPU 55 again determines whether or not the control data D20 is received. When receiving the control data D20, the process shifts to a step T2.

At the step T2, the image-forming apparatus 200 forms an image on each of the predetermined paper-sheets P to transfer them to the finisher 100'. In the finisher 100', it is configured that the punching-and-paper-sheet-aligning unit 48 perforates the punched holes 3*a* for each of the paper-sheets P and a plurality of the paper-sheets P is mounted on the paper-sheet-mounting base 46 in the binding mechanism 40 with them being aligned.

For example, when the paper-sheets P supplied from the punching-and-paper-sheet-aligning unit 48 enter into the paper-sheet-mounting base 46, a multi-paddle like rotation member, not shown, is used to align the forward end and the side edge 3*b* of each of the paper-sheets P to the reference position. This rotation member forces each of the paper-sheets P to strike the forward end of each of the paper-sheets P each having the punched holes 3*a* to the paper-sheet-attaching pin 46*d* and to strike the side edge 3*b* of paper-sheet to the paper-sheet-aligning guide 41 so that the paper-sheets P can be aligned to the reference position, and then, the process shifts to a step T3.

At the step T3, the CPU 55 receives from the image-forming apparatus 200 the control data D20 including the finishing information of paper-sheet carriage, which indicates a finish of the paper-sheet carriage, and the information on the number of paper-sheets, which indicates a number of carried paper-sheets P, and the process shifts to a step T4.

At the step T4, the CPU 55 determines whether the information on the number of paper-sheets of the control data D20 received at the step T3 indicates, for example, 40 sheets or less. At this moment, the CPU 55 compares the information on the number of paper-sheets received from the image-forming apparatus 200 with the reference value, 40, set in the control program stored on the memory section 54. After the comparison thereof, when it is determined that the information on the number of paper-sheets indicates the reference value, 40, or less, the process shifts to a step T5 where the setting of the position of the spiral coil 11*a* having the small diameter is performed.

At the step T5, the CPU 55 controls the selection mechanism 28' to select the section #Ø8 like an arc of a circle for the small diameter and controls the motor-driving section 73 to bind the bundle of paper-sheets 3 by the spiral coil 11*a* having the small diameter. At this moment, in the motor-driving section 71, any one section like an arc of a circle corresponding to the thickness of the bundle of paper sheets is selected from the three sections #Ø8, #Ø11 and #Ø14 each like an arc of a circle in the forming adapter 28*a* of the coil-forming mechanism 20 based on the motor control data D71. For example, the motor-driving section 71 generates the motor control signal (voltage) S71 from the motor control data D71 and outputs the motor control signal S71 to the motor 701. The motor 701 rotates counter-clockwise based on the motor control signal S71 to rotate the forming adaptor 28*a* for setting the diameter of the coil and select the semi-circle cut-away section #Ø8 like an arc of a circle or the like (diameter-of-coil-selecting function).

Further, the CPU 55 also outputs the motor control data D73 for the small diameter to the motor-driving section 73. The motor-driving section 73 generates the motor control signal S73 for the small diameter of the coil based on the motor control data D73 received from the CPU 55 and outputs the motor control signal S73 to the motor 703 for the position adjustment and the process shifts to a step T10.

At the step T10, the motor 703 adjusts the positions of the paper-sheet clamp 45, the feed roller 31 and the screw guide 49 based on the motor control signal S73 generated for the spiral coil 11*a* having the small diameter. In this embodiment, the motor 703 rotates a rotation shaft of the motor 703 by a predetermined amount thereof to rotate the guide-switching cams 34*a*, 34*b* (see FIG. 20) engaged with the rotation shaft. By the rotations of the guide-switching cams 34*a*, 34*b*, the positions of the feed roller 31, the screw guide 49 and the paper-sheet clamp 45, which are engaged with the guide-switching cams 34*a*, 34*b*, move from the home position HP shown in FIG. 20 to the set position of the spiral coil 11*a* having the small diameter shown in FIG. 21 (by the first distance d1).

For example, the feed roller 31 positioned at the uppermost of the vertical long opening 80*b* of the side surface plate 43*b* in the binding mechanism 40 moves from one end of the long cam opening 37*b* of the guide-switching cam 34*b* to the other end thereof to fall down so that it moves on a vertical direction from the uppermost of the vertical long opening 80*b* to the lowermost thereof. This enables the feed roller 31 to be set to a position where it comes into contact with the top surface of the spiral coil 11*a* having the small diameter.

By rotation of the guide-switching cam 34*b*, the screw guide 49 positioned at a right side of the horizontal long opening 82*b* with respect to the surface of the figure at the above-mentioned stand-by state shown in FIG. 20 moves from one end of the curved long cam opening 35*b* of the guide-switching cam 34*b* to the other end thereof to fall back (come close to the spiral coil 11*a*) so that it moves on a horizontal direction from the right side of the horizontal long opening 82*b* to the left side thereof (by the first distance d1'). This enables the screw guide 49 to be set to a position where it comes into contact with the front surface of the spiral coil 11*a*.

By the rotation of this guide-switching cam 34*b*, the paper-sheet clamp 45 positioned at the uppermost of the vertical long opening 38*b* at the above-mentioned stand-by state moves from the uppermost of the vertical long opening 38*b* to the lowermost thereof on an almost vertical direction because the linking rod 39 of the paper-sheet clamp 45 is fallen down by the outer circumferential cam surface 34*d*. This enables the paper-sheet clamp 45 to be set to a position where it clamps the bundle of paper-sheets 3 constituted of paper-sheets of 40 sheets or less. Next, the process shifts to a step T11.

At the step T11, the CPU 55 controls the wire-rod-dispatching mechanism 22 of the coil-forming mechanism 20 to rotate and controls the feed roller 31 of the binding mechanism 40 to rotate. For example, the motor-driving section 72 rotates the upper and lower dispatching rollers 23*a*, 23*b* in the coil-forming mechanism 20 based on the motor control data D72.

In this embodiment, the motor-driving section 72 generates the motor control signal (voltage) S72 from the motor control data D72 and outputs the motor control signal S72 to the motor 702. The motor 702 rotates counter-clockwise to rotate the lower dispatching roller 23*b* clockwise through the lower large diameter gear 24*b* and to rotate the upper dispatching roller 23*a* counter-clockwise through the large diameter gear 24*a* (wire-rod-dispatching control).

Further, the CPU 55 outputs the motor control data D74 to the motor-driving section 74. The motor-driving section 74 generates the motor control signal S74 based on the motor control data D74 received from the CPU 55 and outputs the motor control signal S74 to the motor 704 for rotating the roller. The motor 704 rotates at a predetermined speed based on the motor control signal S74 output from the motor-driving section 74 to rotate the feed roller 31 through the pulley 36*a*, the driven pulleys 36*b*, 36*c* and the belt 36*a*, as shown in FIG. 1 and the process shifts to a step T12.

At this moment, the CPU 55 controls the binding speed of the spiral coil 11 by setting the rotation speed V1 of the spiral coil 11 dispatched from the coil-forming part 28 and the rotation speed V2 of the spiral coil in the binding mechanism 40 to be V1≤V2. The rotation speed V1 is set in the motor-driving section 72 via the motor control data D72. The motor-driving section 72 controls the motor 702 in the coil-forming mechanism 20 to be the rotation speed V1 based on the motor control data D72. The rotation speed V2 is set in the motor-driving section 74 via the motor control data D74. The motor-driving section 74 controls the motor 704 in the binding mechanism 40 to be the rotation speed V2 based on the motor control data D74 (rotation speed control).

Next, at the step T12, the feed roller 31 and the screw guide 49 pass the spiral coil 11 formed to have a predetermined diameter and supplied from the coil-forming mechanism 20 through the punched holes 3*a* of the bundle of paper-sheets 3 with it being guided. For example, the feed roller 31 feeds the spiral coil 11*a* having the small diameter supplied from the coil-forming mechanism 20 to the punched holes 3*a* of the bundle of paper-sheets 3 mounted on the paper-sheet-mounting base 46 with it being rotated.

The fed spiral coil 11*a* passes through between the projections 49*c* of the guide projection portion 49*b* of the screw guide 49 shown in FIG. 19A through 19C. At this moment, the spiral coil 11*a* is limited in its advanced direction by each projection 49*c* so that it passes through between the convex teeth 46*b* of the screw guide 46*a* (fixed side) of the paper-sheet-mounting base 46.

It is configured that the spiral coil 11*a* then passes through between the convex teeth 46*b* of the screw guide 46*a* and passes through the punched hole 3*a*. It is configured that after the passage trough the punched hole 3*a*, the spiral coil 11*a* is again limited in its advanced direction by the guide projection portion 49*b* so that it passes through between the convex teeth 46*b* of the screw guide 46*a*, and then passes through between the convex teeth 46*b* and passes the punched hole 3*a*. This enables the spiral coil 11*a* to pass through each of the punched holes 3*a* of the bundle of paper-sheets 3 securely.

In this embodiment, the forward-end-passage signal S63 is output from the passage detection sensor 63 to the I/O port 51. The forward-end-passage signal S63 is converted to the forward-end-passage data D63 in the I/O port 51. The forward-end-passage data D63 is output from the I/O port 51 to the CPU 55. The CPU 55 controls the motor-driving section 74 based on the forward-end-passage data D63 received from the I/O port 51 (coil-movement-slow-down control).

The CPU 55 detects the passage of the forward end of the coil after rotating the feed roller 31 and when the passage of the spiral coil 11*a* having the small diameter through the punched holes 3*a* of the bundle of paper-sheets 3 is complete, it outputs the motor control data D74 for stopping to the motor-driving section 74 and outputs the motor control data D73 for stand-by to the motor-driving section 73.

In this embodiment, the forward end detection signal S62 is output from the reach detection sensor 62 to the I/O port 51. The forward end detection signal S62 is converted to the forward end detection data D62 in the I/O port 51. The forward end detection data D62 is output from the I/O port 51 to the CPU 55. The CPU 55 controls the motor-driving section 72 based on the forward end detection data D62 received from the I/O port 51 (coil-movement-stop control).

Next, the process shifts to a step T13. At the step T13, the CPU 55 controls the motor-driving sections 72, 74 to stop the rotations of the wire-rod-dispatching mechanism 22 and the feed roller 31. For example, the CPU 55 outputs the motor control data D72 for stopping to the motor-driving section 72 and outputs the motor control data D74 for stopping to the motor-driving section 74, respectively.

The motor-driving section 72 generates the motor control signal S72 for stopping based on the motor control data D72 for stopping, which is received from the CPU 55, and outputs the motor control signal S72 to the motor 702. The motor-driving section 74 generates the motor control signal S74 for stopping based on the motor control data D74 for stopping, which is received from the CPU 55, and outputs the motor control signal S74 to the motor 704 for rotating the roller.

These motors 702, 704 stop their rotations based on the motor control signals S72, S74 output from the motor-driving sections 72, 74. Thus, the rotations of the wire-rod-dispatching mechanism 22 and the feed roller 31 stop. Next, the process shifts to a step T14.

Next, at the step T14, an end processing of the spiral coil 11*a* is performed by the cutting-and-bending mechanism 75 in the screw guider 49 shown in FIG. 28A. For example, by rotating the lever 75*f* clockwise, the hitting-for-pinching portion 75*a* moves in close to the receiving-for-pinching portion 75*b* so that the hitting-for-pinching portion 75*a* and the receiving-for-pinching portion 75*b* hold the spiral coil 11*a* with it being pinched. At this moment, the spiral coil 11*a* is pinched between the cutter 75*c* and the cutter-receiving portion 75*d*.

Then, by further rotating the lever 75*f* clockwise while the spiral coil 11*a* is pinched by the hitting-for-pinching portion 75*a* and the receiving-for-pinching portion 75*b*, solely the cutter 75*c* rotates clockwise so that it cuts the spiral coil 11*a* pinched between the cutter 75*c* and the cutter-receiving portion 75*d*.

After the cutting, by additionally rotating the lever 75*f* clockwise, the cut end 11' of the spiral coil 11 pinched between the bending portion 75*e* and the receiving-for-pinching portion 75*b* is bent from the base thereof inward the spiral coil 11 only by about 90 degrees. This enables the coil-binding booklet 90 to be realized. After such an end processing of the spiral coil 11*a* has been performed, the process shifts to a step T15. It is to be noted that the lever 75*f* is configured so as to operate by a cam, a motor, a solenoid and the like, which are not shown. Of course, when utilizing the manual mode, the lever 75*f* may operate by hand (see second embodiment).

Next, at the step T15, the CPU 55 controls the motor-driving section 73 to adjust the paper-sheet clamp 45, the feed roller 31 and the screw guide 49 to their stand-by positions. For example, the CPU 55 outputs the motor control data D73 for stand-by to the motor-driving section 73. The motor-driving section 73 generates the motor control signal S73 for stand-by based on the motor control data D73 and outputs the motor control signal S73 to the motor 703 for the position adjustment.

The motor 703 rotates the rotation shaft of the motor 703 by a predetermined amount thereof rightwards to rotate the guide-switching cams 34*a*, 34*b* engaged with the gear 33*b* of the rotation shaft leftwards. By the leftward rotations of the guide-switching cams 34*a*, 34*b*, the positions of the feed roller 31, the screw guide 49 and the paper-sheet clamp 45, which are engaged with the guide-switching cams 34*a*, 34*b*, return to their home positions HP (stand-by position) shown in FIG. 20 from the set position of the spiral coil 11*a* having the small diameter shown in FIG. 21 (the first distance d1) so that the processing to passing the spiral coil 11*a* through the bundle of paper-sheets 3 finishes.

Further, when it is determined that the information on the number of paper-sheets exceeds 40 and is not the reference value of 40 or less at the above-mentioned step T4, it is decide that the spiral coil 11*a* having the small diameter is not set and the process shifts to a step T6. At the step T6, the CPU 55 determines whether or not the information on the number of paper-sheets exceeds 40 sheets and is 70 sheets or less. For example, the CPU 55 compares the information on the number of paper-sheets with the reference value of 70 stored in the memory section 54. After the comparison thereof, when it is determined that the information on the number of paper-sheets is not more than the reference value of 70, the process shifts to a step T7 where the setting of the position of the spiral coil 11*b* having the middle diameter is performed.

Next, at the step T7, the CPU 55 controls the motor-driving section 73 to bind the spiral coil lib having the middle diameter. In this embodiment, the CPU 55 outputs the motor control data D73 for the middle diameter to the motor-driving section 73. The motor-driving section 73 generates the motor control signal S73 for the middle diameter based on the motor control data D73 received from the CPU 55 and outputs the motor control signal S73 to the motor 703 for the position adjustment and the process shifts to a step T10. At the step T10, it adjusts the positions of the paper-sheet clamp 45, the feed roller 31 and the screw guide 49 based on the motor control signal S73 generated for the spiral coil 11*b* having the middle diameter.

In this embodiment, the motor 703 rotates the rotation shaft of the motor by a predetermined amount to rotate the guide-switching cams 34*a*, 34*b* (see FIG. 20) engaged with the rotation shaft. By the rotations of the guide-switching cams 34*a*, 34*b*, the positions of the feed roller 31, the screw guide 49 and the paper-sheet clamp 45, which are engaged with the guide-switching cams 34*a*, 34*b*, move from their home positions HP shown in FIG. 20 to the set position of the spiral coil 11*b* having the middle diameter shown in FIG. 22 (by the second distance d2). After the movement, the binding is performed by passing the spiral coil 11*b* through the punched holes 3*a* of the bundle of paper-sheets 3 via the above-mentioned steps T11 through T15.

Further, when it is determined that the bundle of paper-sheets 3 exceeds 70 sheets and the information on the number of paper-sheets is not the reference value of 70 or less at the above-mentioned step T6, it is decide that the spiral coils 11*a*, 11*b* having the small and middle diameters are not set and the process shifts to a step T8. At the step T8, the CPU 55 determines whether or not the information on the number of paper-sheets exceeds 70 sheets and is 100 sheets or less. For example, the CPU 55 compares the information on the number of paper-sheets with the reference value of 100 stored in the memory section 54. After the comparison thereof, when it is determined that the information on the number of paper-sheets is not more than the reference value of 100, the process shifts to a step T9 where the setting of the position of the spiral coil 11*c* having the large diameter is performed.

Next, at the step T9, the CPU 55 controls the motor-driving section 73 to bind the bundle of paper-sheets 3 by the spiral coil 11*c* having the large diameter. In this embodiment, the CPU 55 outputs the motor control data D73 for the large diameter to the motor-driving section 73. The motor-driving section 73 generates the motor control signal S73 for the large diameter based on the motor control data D73 received from the CPU 55 and outputs the motor control signal S73 to the motor 703 for the position adjustment and the process shifts to a step T10. At the step T10, it adjusts the positions of the paper-sheet clamp 45, the feed roller 31 and the screw guide 49 based on the motor control signal S73 generated for the spiral coil 11*c* having the large diameter.

In this embodiment, the motor 703 rotates the rotation shaft of the motor 703 by a predetermined amount thereof to rotate the guide-switching cams 34*a*, 34*b* (see FIG. 20) engaged with the rotation shaft. By the rotations of the guide-switching cams 34*a*, 34*b*, the positions of the feed roller 31, the screw guide 49 and the paper-sheet clamp 45, which are engaged with the guide-switching cams 34*a*, 34*b*, move from their home positions HP shown in FIG. 20 to the set position of the spiral coil 11*c* having the large diameter shown in FIG. 23 (by the third distance d3). After the movement, the binding is performed by passing the spiral coil 11*c* through the punched holes 3*a* of the bundle of paper-sheets 3 via the above-mentioned steps T11 through T15. This enables the automatic binding processing on the bundle of paper-sheets 3 to be realized with the spiral coil 11*c* having the automatically selected diameter of the coil corresponding to the thickness of the bundle of paper-sheets 3.

It is to be noted that when it is determined that the information on the number of paper-sheets is not the reference value of 100 or less, namely, the information on the number of paper-sheets is the reference value of 101 or more, there is no spiral coil 11 having applicable diameter. In this case, the process shifts to a step T16 where the CPU 55 sends communication data D10 on error to the image-forming apparatus 200 via the input/output terminal 91 and the process is complete.

Thus, according to the image-forming system 101 as the first embodiment relating to the invention, the paper-sheet-handling apparatus relating to the invention is provided so that it is possible to provide the image-forming system 101 which is provided with the finisher 100' with coil diameter automatic selection function, which bundles the paper-sheets P released from the image-forming apparatus 200 such as a copy machine and a printer and performs coil-binding processing by the spiral coil 11*a* or the like.

The finisher 100' also receives from the image-forming apparatus 200 the control data D20 such as the size information of the paper-sheet, the number information of the carried paper-sheets, the starting information of the paper-sheet carriage, the carrying speed information of the paper-sheets and/or the finishing information of the paper-sheet carriage, and bundles the paper-sheets (recorded paper) P released from the image-forming apparatus 200 based on the control data D20. The finisher 100' also forms the spiral coil 11 from the wire rod 1 having a predetermined thickness so that it is possible to perform the binding processing on the bundle of paper-sheets 3 by the coil 11. Accordingly, the image-forming system 101 including the coil-binding function, which is usable from the image-forming apparatus 200 to the finisher 100' consistently by a general user, may be built.

Further, in the image-forming system 101, the communication data D10 is output from the finisher 100' to the image-forming apparatus 200. The communication data D10 includes jam information, coil diameter information, cover-open information, detection information of wire rod cut waste and/or detection information of punched waste. Therefore, jam condition, a size of the diameter of the coil, cover-open condition, wire rod cut waste condition and/or punched waste condition in the finisher 100' may be confirmed by visual inspection by the monitor 208 or the like of the image-forming apparatus 200. In the image-forming apparatus 200, the user may confirm the operation state of the finisher 100'.

Embodiment 2

Figure 42:
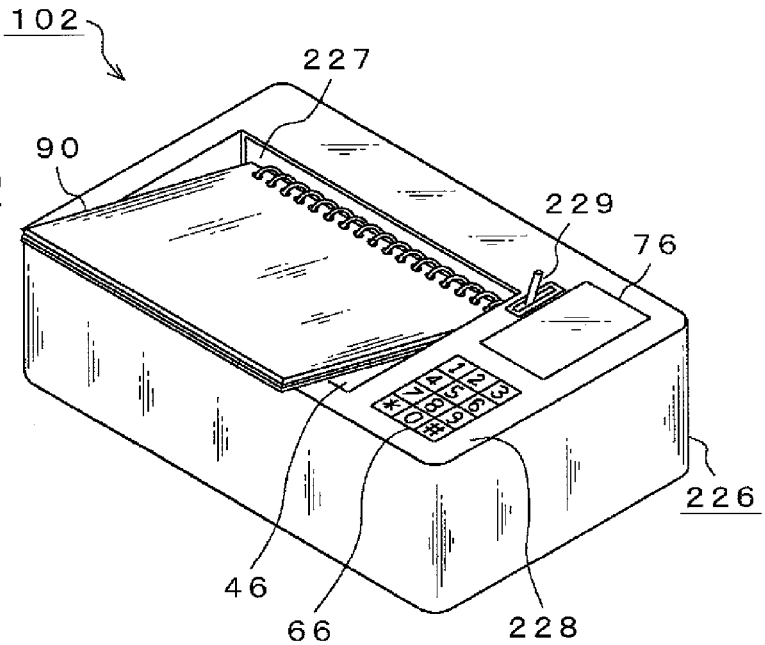
FIG. 42 is a perspective view showing a configuration example of a coil binder 102 as a second embodiment.

The following will describe a configuration example of a coil binder as a second embodiment with reference to FIG. 42. The coil binder 102 shown in FIG. 42 constitutes a function of second paper-sheet-handling apparatus and is such that the punching processing function and automatic cutting-and-bending function is omitted from the finisher 100' shown in FIG. 40 and the manual mode is performed therein.

The coil binder 102 is the paper-sheet-handling apparatus that is applicable to the second image-forming system. In the second image-forming system, it is treated that the perforation is separately performed on paper-sheets P released from the image-forming apparatus 200 such as copy machine and a printer, which has been described in the first image-forming system 101, by a special or commercial puncher and the punched paper-sheets P are then bundled and set on the coil binder 102.

The coil binder 102 has, for example, a plastic case 226. In the case 226, various kinds of functions such as the coil-forming mechanism 20, the binding mechanism 40 and the like, which have been described in FIGS. 1 through 39, are installed. A manipulation panel 228 is provided on a top surface of the case 226. On the manipulation panel 228, the paper-sheet-mounting base 46, the manipulation section 66, the monitor 76, a cutting handle 229 and the like are disposed. The paper-sheet-mounting base 46 is obliquely disposed so that it has a predetermined inclination angle as going toward an interior thereof with respect to the manipulation panel 228 and its terminal is configured so as to be a binding processing opening 227. In the binding processing opening 227, the feed roller 31 and the screw guide 49, which are not shown, are disposed.

The bundle of paper-sheets 3 bundling the paper-sheets P, in each of which the punched holes 3*a* are perforated, are set on the paper-sheet-mounting base 46. The bundle of paper-sheets 3 is aligned so that a side thereof in which the punched holes 3*a* are perforated faces the binding processing opening 227.

The manipulation section 66 is set so as to select any one section #Ø8, #Ø11 or #Ø14 like an arc of a circle corresponding to the thickness of the bundle of paper-sheets 3 from the three species of the sections #Ø8, and #Ø14 each like an arc of a circle for setting a diameter of the coil. For the manipulation section 66, a numeric keypad constituted of keys of "0" through "9", "#" and "*".

Of course, it is not limited thereto: a selection button for selecting any one section #Ø8, #Ø11 or #Ø14 like an arc of a circle corresponding to the thickness of the bundle of paper-sheets 3 from the sections #Ø8, and #Ø14 each like an arc of a circle for setting a diameter of the coil may be provided.

The monitor 76 receives the paper-sheet detection data D61, the mounting-detection data D64 and the wire rod detection data D65 under the display control of the CPU 55 to perform any displays. For example, the monitor 76 displays a massage such that the bundle of paper-sheets 3 is not mounted on the binding mechanism 40 based on the paper-sheet detection data D61. The monitor 76 also displays a massage such that the wire rod cartridge 10 is not mounted based on the mounting-detection data D64 of L level. The monitor 76 also displays existence or nonexistence of the wire rod 1 in the drum 12 based on the wire rod detection data D65.

The cutting handle 229 is provided, for example, on the manipulation panel 228 between an end of the binding processing opening 227 and the monitor 76 and a forward end thereof is engaged with the lever 75*f* of the cutting-and-bending mechanism 75 shown in FIG. 28B. It is configured that the handle 229 is manipulated by the user after the spiral coil 11*a* or the like passes through the bundle of paper-sheets 3 and cuts a predetermined position of the spiral coil 11*a*. It is configured that when further pushing down the handle 229 to a predetermined direction, an end of the spiral coil 12*a* is bent (see FIGS. 30A through 33).

In this embodiment, in the control section 50 shown in FIG. 39, the first part step of selecting the section #Ø8, #Ø11 or #Ø14 like an arc of a circle includes a step of inputting an instruction of selecting any one section #Ø8, #Ø11 or #Ø14 like an arc of a circle corresponding to the thickness of the bundle of paper-sheets 3 from the plural species of the sections #Ø8, #Ø11 and #Ø14 each like an arc of a circle for setting a diameter of the coil. Controlling the coil binder 102 thus allows the diameter of the spiral coil 11 to be manually selected and allows the coil-binding processing to be realized on the bundle of paper-sheets 3 corresponding to the manual setting (second control method).

Figure 43A:
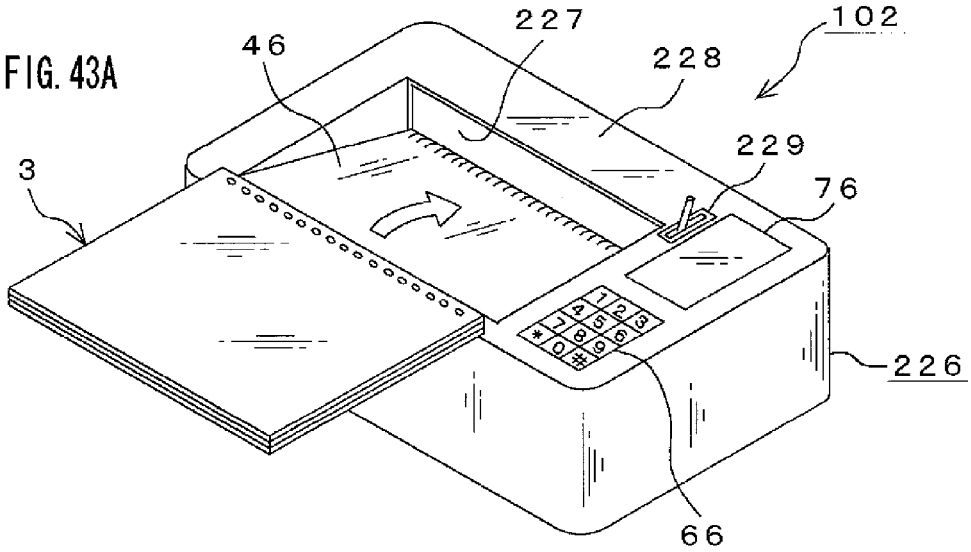
FIG. 43A is a perspective view showing a handling example of the coil binder 102 when inserting the bundle of paper-sheets thereinto.
Figure 43B:
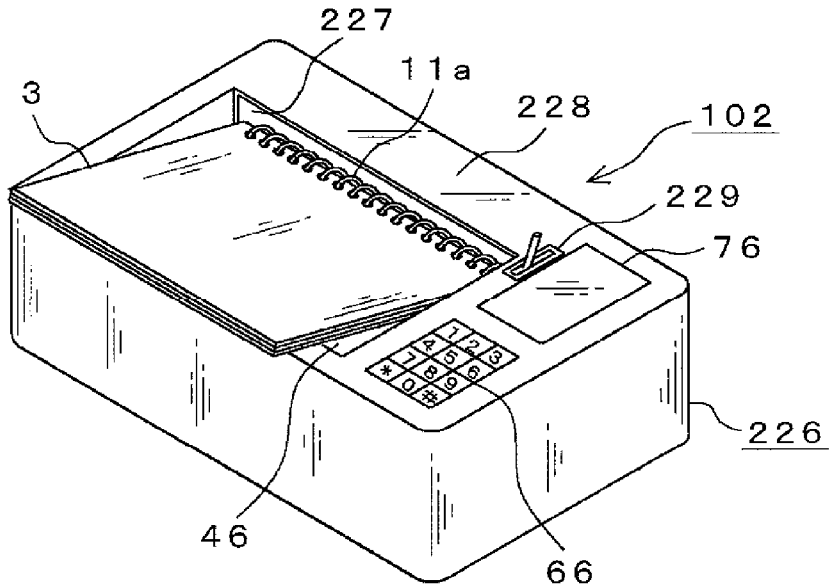
FIG. 43B is a perspective view showing a handling example of the coil binder 102 when performing the binding processing on the bundle of paper-sheets.
Figure 43C:
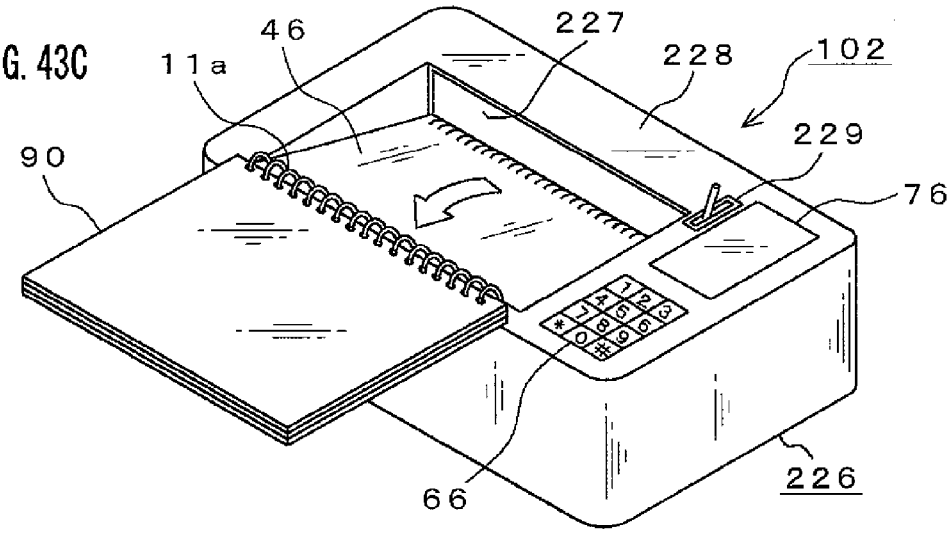
FIG. 43C is a perspective view showing a handling example of the coil binder 102 when taking out the booklet.
Figure 44:
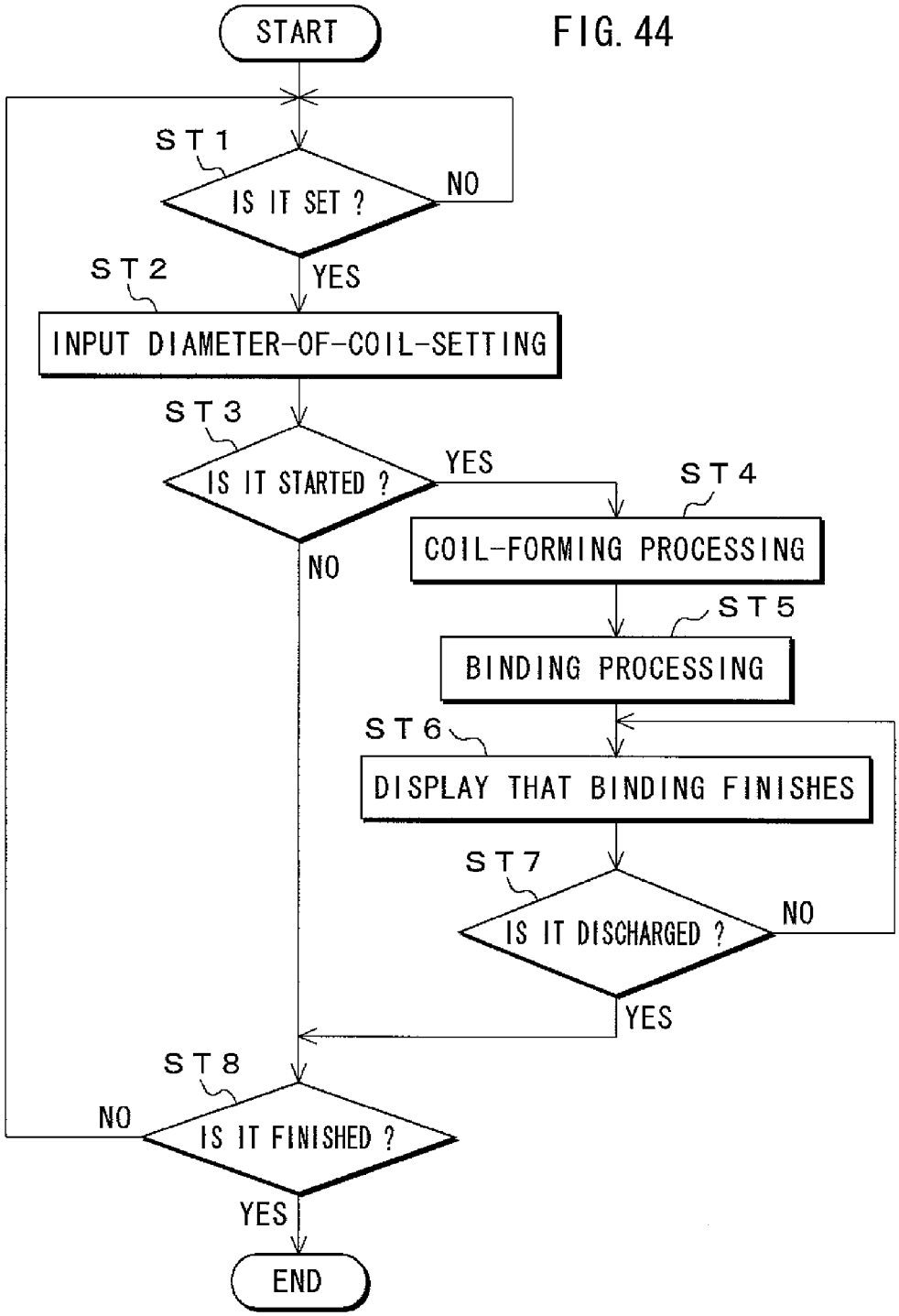
FIG. 44 is a flowchart showing a control example of the coil binder 102.

The following will describe a control method of the coil binder 102 with reference to FIGS. 43A through 44. FIGS. 43A through 43C are process drawings indicating an example of treating the coil binder 102. FIG. 44 is a flowchart showing a control example thereof.

In this embodiment, it is treated that the punched holes 3*a* are perforated on paper-sheets P by a special or commercial puncher and the punched paper-sheets P are then bundled and set on the coil binder 102 shown in FIG. 43A. It is assumption where the spiral coil 11 is then formed from the wire rod 1 having a predetermined thickness in the coil binder 102 shown in FIG. 43B and the binding processing is performed on the bundle of paper-sheets 3 by the spiral coil 11.

Under a binding-processing condition of them, at a step ST1 in a flowchart shown in FIG. 44, the control section 50 determines whether or not the bundle of paper-sheets 3 is set on the paper-sheet-mounting base 46. At this moment, the control section 50 compares the paper-sheet detection data D61 (the paper-sheet-existence-or-nonexistence signal S61) obtained from the paper-sheet sensor 61 shown in FIG. 39 with a threshold value for determining the signal level to detect whether or not the bundle of paper-sheets 3 is set. If the paper-sheet detection data D61 exceeds the threshold value, it is detected that the bundle of paper-sheets 3 is set.

Next at a step ST2, the control section 50 performs input processing of the diameter-of-coil-setting. At this moment, it is configured that the user manipulates the manipulation section 66 to select any one section #Ø8, #Ø11 or #Ø14 like an arc of a circle corresponding to the thickness of the bundle of paper-sheets 3 from the three species of the sections #Ø8, #Ø11 and #Ø14 each like an arc of a circle for setting a diameter of the coil. By this selection manipulation, the manipulation data D66 indicating the setting of the diameter of the coil is output from the manipulation section to the CPU 55 through the I/O port 51.

Then, at a step ST3, the control section 50 waits for a start instruction. At this moment, the CPU 55 conducts any time limit input processing. The user manipulates the manipulation section 66 to input the start instruction (boot-up command). The manipulation section 66 outputs the control data D66 indicating the start to the CPU 55 through the I/O port 51.

Next, at a step ST4, the control section 50 conducts the coil-forming processing based on the control data D66. At this moment, in the coil-forming mechanism 20, the wire rod 1 is pushed down into the one section #Ø8 like an arc of a circle section or the like selected from the section #Ø8, #Ø11 or #Ø14 each like an arc of a circle by the manipulation section 66 so that the spiral coil 11*a* or the like is formed. The control section 50 conducts the wire-rod-dispatching control (see FIGS. 39 and 41).

Further, at a step ST5, the control section 50 conducts the binding processing. At this moment, in the binding mechanism 40, the binding processing is performed on the bundle of paper-sheets 3 by the spiral coil 11*a* formed by the coil-forming mechanism 20. The control section 50 conducts the rotation speed control, the coil-movement-slow-down control, the coil-movement-stop control and the like (see FIGS. 39 and 41). The bundle of paper-sheets 3 bound by the spiral coil 11*a* or the like becomes the booklet 90.

Then, at a step ST6, the control section 50 conducts the control to display that "the binding process finishes". For example, the CPU 55 outputs the display data D76 to the monitor 76. The monitor 76 displays that "the binding process finishes" based on the display data D76. At the same time, a manipulation method of the handle 229 is displayed on the monitor 76. It is designed that the user manipulates the handle 229 with reference to the message or the like displayed on the monitor 76 to cut the predetermined position of the spiral coil 11*a*. It is designed that when the handle 229 is further pushed down to the predetermined direction, the end of the spiral coil 11*a* is bent (see FIGS. 30A through 33).

Next, at a step ST7, the control section 50 determines whether or not the booklet 90 is discharged from the paper-sheet-mounting base 46. At this moment, the control section 50 compares the paper-sheet detection data D61 (the paper-sheet-existence-or-nonexistence signal S61) obtained from the paper-sheet sensor 61 shown in FIG. 39 with a threshold value for determining the signal level to detect whether or not the booklet 90 is discharged. If the paper-sheet detection data D61 is less than the threshold value, it is detected that the booklet 90 has been discharged. The process then shifts to a step ST8.

It is to be noted that the start is not instructed at the step ST3 even if a period of set time has been elapsed, the process shifts to the step ST8 where the control section 50 determines whether or not the coil-binding processing finishes. For example, when detecting the power-off information, the coil-binding processing finishes. When detecting no power-off information, the process returns to the step ST1 where the above-mentioned processing is repeated following the processing of determining whether or not the bundle of paper-sheets 3 is set on the paper-sheet-mounting base 46.

Thus, in the coil binder 102 according to the second embodiment, there is provided the second paper-sheet-handling apparatus according to the invention and the second control method is applied thereto. This enables the binding processing to be performed on the bundle of paper-sheets by the spiral coil 11*a* or the like having a diameter of the coil specified by the user corresponding to the thickness of the bundle of paper-sheets when forming the spiral coil 11*a* or the like from the wire rod 1 having the predetermined thickness and performing the binding processing on the bundle of paper-sheets 3 by the spiral coil 11*a*.

Accordingly, it is possible to provide the coil-binding-processing system which is provided with the coil binder with coil diameter manual selection function, which bundles the paper-sheets P released from the image-forming apparatus 200 such as a copy machine and a printer and performs binding processing by the spiral coil 11*a* or the like. It is to be noted that although the above-mentioned cutting-and-bending mechanism 75 has been illustrated to have a configuration such that the cutting and bending of the spiral coil 11 are conducted in the same apparatus, it may have a configuration such that a mechanism for the cutting and a mechanism for the bending are separately provided as the independent mechanisms and may conduct them by different steps.

INDUSTRIAL APPLICABILITY

The present invention is very preferably applied to a coil-binder, a finisher or the like, which performs the binding processing on the bundle of paper-sheets bundling the paper-sheets with a plurality of holes for binding at a predetermined part by passing the spiral coil through the holes thereof.

The invention claimed is:

1. A paper-sheet-handling apparatus that performs a binding processing on a bundle of paper-sheets by passing a spiral coil through plural holes for binding which are perforated on predetermined portions of each of the paper-sheets, the bundle of paper-sheets bundling the paper-sheets, the apparatus comprising:

a frame;

a rotating guide part that is rotatable relative to the frame and is movable linearly relative to the frame in a first direction that intersects with the spiral coil advancing along a coil advance direction, rotates the spiral coil passing through the plural holes of the bundle of paper-sheets, and guides the spiral coil to feed it in the coil advance direction, wherein the rotating guide part comprises a rotation member having a cylindrical shape, which rotates to feed the spiral coil in the coil advance direction;

a first screw guide part that is movable linearly relative to the frame in a second direction that intersects with the first direction and intersects with the spiral coil advancing along the coil advance direction and guides and conducts a forward end of the spiral coil fed by the rotating guide part in the coil advance direction into the holes of the bundle of paper-sheets, wherein the first screw guide part has an edge that is parallel to the rotation member of the rotating guide part and at which the first screw guide part is provided with plural projections that are uniformly spaced apart along said edge of the first screw guide part; and a control part that receives diameter-of-coil-setting information for setting a diameter of a coil of the spiral coil and controls positions of the rotating guide part and the first screw guide part, based on the diameter-of-coil-setting information;

wherein the coil advance direction is along said edge of the first screw guide part;

and wherein the rotating guide part includes:

a rotation shaft rod to which the rotation member is attached;

wherein the rotation shaft rod and the rotation member attached thereto are rotatable relative to the frame about an axis that is parallel to the coil advance direction; and wherein the frame comprises first and second side plates and the apparatus comprises a paper-sheet-mounting base located between the first and second side plates for supporting the bundle of paper-sheets, the first and second side plates are formed with first and second slot-form openings respectively, and first and second opposite ends of the rotation shaft rod are fitted in the first and second slot-form openings respectively, allowing linear movement of the rotation member relative to the frame in said first direction.

2. The paper-sheet-handling apparatus according to claim 1, wherein the first screw guide part comprises a screw guide having first and second opposite ends and first and second shaft rods projecting from the first and second ends respectively of the screw guide, the first and second side plates are formed with third and fourth slot-form openings respectively, disposed perpendicular to the first and second slot-form openings respectively, and the first and second shaft rods are fitted in the third and fourth slot-form openings respectively, allowing linear movement of the first screw guide part relative to the frame in said second direction.

* * * * *